US007946698B2

(12) United States Patent
Makuta et al.

(10) Patent No.: US 7,946,698 B2
(45) Date of Patent: May 24, 2011

(54) INK JET RECORDING METHOD AND INK JET RECORDING DEVICE

(75) Inventors: Toshiyuki Makuta, Ashigarakami-gun (JP); Yusuke Nakazawa, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 772 days.

(21) Appl. No.: 11/905,331

(22) Filed: Sep. 28, 2007

(65) Prior Publication Data

US 2008/0084466 A1 Apr. 10, 2008

(30) Foreign Application Priority Data

Sep. 28, 2006 (JP) ..... 2006-264607
Mar. 30, 2007 (JP) ..... 2007-095395

(51) Int. Cl.
*B41J 2/01* (2006.01)

(52) U.S. Cl. ..... 347/101; 347/17; 347/102

(58) Field of Classification Search ..... 347/17, 347/101, 102
See application file for complete search history.

(56) References Cited

U.S. PATENT DOCUMENTS 7,374,280 B2 * 5/2008 Kusunoki ..... 347/102
(Continued)

FOREIGN PATENT DOCUMENTS

JP 63-60783 A 3/1988
(Continued)

OTHER PUBLICATIONS

EP Communication, dated Jul. 13, 2010, issued in corresponding EP Application No. 07016628.5, 8 pages.

*Primary Examiner* — Daniel Petkovsek
(74) *Attorney, Agent, or Firm* — Sughrue Mion, PLLC

(57) ABSTRACT

An ink jet recording method comprising: applying an undercoating liquid containing a monomer represented by the formulae (I) or (II) onto a recording medium; partially curing the undercoating liquid that has been applied onto the recording medium; and recording an image by ejecting an ink that is curable by irradiation with actinic energy onto the partially cured undercoating liquid. In formulae (I) and (II), $R^1$ represents a hydrogen atom, halogen atom, or alkyl group having 1 to 4 carbon atoms; $X^1$ represents a divalent linking group; $R^2$ and $R^3$ represent a substituent; n represents an atom group that is necessary for formation of a cyclic hydrocarbon structure that may contain —C(O)— and/or —C(O)O— together with a hydrocarbon linkage; k represents an integer of from 1 to 6; and q and r represent an integer of from 0 to 5, and wherein k, q and/or r are 2 or more, two or more of $R^1$, $X^1$, $R^2$ and/or $R^3$ may be the same as or different from each other.

(I)

(II)

19 Claims, 9 Drawing Sheets

U.S. PATENT DOCUMENTS

| | | | | |
|---|---|---|---|---|
| 7,658,489 | B2 * | 2/2010 | Yamanobe | 347/102 |
| 2006/0033794 | A1 | 2/2006 | Yamanobe | |
| 2006/0203024 | A1 | 9/2006 | Kusunoki | |

FOREIGN PATENT DOCUMENTS

| | | | |
|---|---|---|---|
| JP | 8-174997 | A | 7/1996 |
| JP | 8-218018 | A | 8/1996 |
| JP | 3642152 | B2 | 10/1998 |
| JP | 2000-135781 | A | 5/2000 |
| JP | 3478495 | B2 | 6/2001 |
| JP | 2001-348519 | A | 12/2001 |
| JP | 2002-370445 | A | 12/2002 |
| JP | 2003-12971 | A | 1/2003 |
| JP | 2003-145745 | A | 5/2003 |
| JP | 2004-42525 | A | 2/2004 |
| JP | 2004-42548 | A | 2/2004 |
| JP | 2004-276322 | A | 10/2004 |
| JP | 2005-96254 | A | 4/2005 |

* cited by examiner

INK JET RECORDING METHOD AND INK JET RECORDING DEVICE

CROSS-REFERENCE TO RELATED APPLICATION

This application claims priority under 35 USC 119 from Japanese Patent Application Nos. 2006-264607 and 2007-95395, the disclosures of which are incorporated by reference herein.

BACKGROUND OF THE INVENTION

1. Field of the Invention

The invention relates to an ink jet recording method and an ink jet recording device that are favorably used for formation of a high-quality image at high speed.

2. Description of the Related Art

An ink jet method of ejecting ink in the form of liquid droplets from an ink ejector has been used in various kinds of printers for the reasons of being compact and less expensive, capable of forming an image without contacting a recording medium, and the like. Among these ink jet methods, there are a piezo ink jet method utilizing deformation of piezoelectric elements to eject ink and a thermal ink jet method utilizing a boiling phenomenon of ink due to thermal energy to eject the ink in the form of droplets, which have the characteristics of high resolution and high-speed printability.

Improvements in speed and image quality have currently become important objectives, upon printing by ejecting ink droplets onto a plain paper sheet or a non-water absorbing recording medium made of plastics or the like with an ink jet printer.

Ink jet recording is a method of ejecting ink droplets according to image data to form a line or an image on a recording medium with the liquid droplets. However, there have been problems in practical use, particularly in a case of recording on the above-described non-absorbing recording medium, e.g., bleeding of an image easily occurs, or mixing of adjacent ink droplets occurs on the recording medium to inhibit formation of a sharp image, when it takes time for the liquid droplets to dry or penetrate into the recording medium after having been ejected. When the liquid droplets mix with each other, the ejected adjacent liquid droplets coalesce with each other to shift from the positions at which they have landed, thereby causing unevenness in line width in a case of forming fine lines or unevenness in color in a case of forming a colored area, or the like. Further, since the degree of occurrence of unevenness in line width or color unevenness in a colored area varies depending on ink absorption and wettability of the surface of the recording medium, there has also been a problem in that different images are formed on different types of recording media, even when the same ink is used under the same ejection conditions.

As a method of suppressing image bleeding or nonuniformity of line width, there is a method of promoting fixation of liquid droplets. For example, there have been disclosed methods of using inks of two-liquid type having reactivity and allowing them to react with each other on a recording medium to achieve a depicting property with high definition, such as a method of recording with ink containing an anionic dye after application of a liquid containing a basic polymer (for example, refer to Japanese Patent Application Laid-Open (JP-A) No. 63-60783), or a method of applying ink containing an anionic compound and a coloring material after application of a liquid composition containing a cationic substance (for example, refer to JP-A No. 8-174997).

An ink jet recording method has also been proposed in which an ultraviolet-curable ink is used as the ink, the ink dots ejected onto a recording medium are irradiated with ultraviolet rays in conformity with the timing of ejection, then the dots are pre-cured to be thickened to such an extent that the adjacent dots do not mix with each other, and thereafter the dots are further irradiated with ultraviolet rays to be completely cured (for example, refer to JP-A No. 2004-42548).

Further, a method has been proposed that improves visibility or bleeding of color ink or a problem such as variation in the obtained images formed on different types of recording media, by applying a radiation curable white ink to form a uniform undercoating layer on a transparent or semi-transparent non-absorbing recording medium, then curing or thickening the layer by irradiating with radiation rays, and thereafter recording with a radiation curable color ink (for example, refer to JP-A No. 2003-145745 and JP-A No. 2004-42525). There has also been proposed a method in which a substantially transparent actinic ray-curable ink is applied onto a recording medium in place of the above radiation curable white ink by an ink jet head (for example, refer to JP-A No. 2005-96254).

There have also been disclosed ink jet recording methods of curing type such as a method in which printing is performed by ejecting two types of solutions and irradiating with ultraviolet rays to form print dots (for example, refer to Japanese Patent No. 3478495) and others (for example, refer to JP-A Nos. 8-218018 and 2001-348519, Japanese Patent No. 3642152, JP-A Nos. 2000-135781 and 2003-12971).

However, in the method described in JP-A No. 2004-42548, although bleeding can be suppressed, there still remains a problem of variation in images among various types of recording media, and thus problems of unevenness in line width, color or the like due to mixing of ink droplets has not been sufficiently solved. These problems of unevenness in line width, color or the like due to mixing of ink droplets have also not been sufficiently solved by any of the methods described in JP-A Nos. 2003-145745 or 2004-42525. Further, there still remains a problem of unevenness in line width, color or the like due to mixing of ink droplets in the method described in JP-A No. 2005-96254.

Further, it is difficult to maintain the same shape and size of the dots forming an ejected area at the border between the ejected region in which an ink has been ejected and the non-ejected region. Therefore, there is a problem that the ejected ink flows toward the area around the border with less amount of the ink, thereby causing change in density along the border. In such a case, the image has an appearance as if it is outlined with a frame.

The invention has been made in view of the above problems and is intended to provide an ink jet recording method and an ink jet recording device by which images having excellent uniformity can be recorded on various types of recording media, ink bleeding or unevenness in line width or color due to coalescence between droplets can be suppressed (i.e., having dot reproducibility), and at the same time, the dot shape at the border of ejected region and non-ejected region can be maintained, thereby recording an image well reproduced to details irrespective of the form of the image.

The invention has been achieved based on the findings that when ink is simply ejected onto a liquid, a leveling effect of the liquid at the border of the ejected region and non-ejected region tends to occur, due to which a change in dot shape of the ejected ink is easily caused; and that the change in dot shape plays an important role in maintaining the density reproduction to details, over the whole image.

SUMMARY OF THE INVENTION

The invention has been made in view of the above problems and provides an ink jet recording method and an ink jet recording device.

According to a first aspect of the invention, there is provided an ink jet recording method comprising:

applying an undercoating liquid comprising a monomer represented by the following formula (I) or formula (II) onto a recording medium;

partially curing the undercoating liquid that has been applied onto the recording medium; and recording an image by ejecting an ink that is curable by irradiation with actinic energy rays onto the partially cured undercoating liquid, (I)

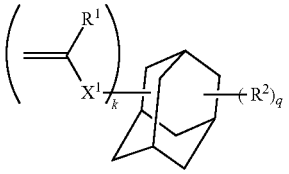

(II)

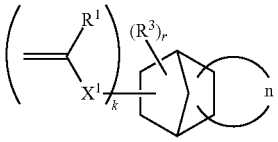

wherein, in formulae (I) and formula (II): $R^1$ represents a hydrogen atom, a halogen atom, or an alkyl group having from 1 to 4 carbon atoms; $X^1$ represents a divalent linking group; $R^2$ and $R^3$ each independently represent a substituent; n represents an atom group that is necessary for formation of a cyclic hydrocarbon structure that may contain a carbonyl linkage (—C(O)—) and/or an ester linkage (—C(O)O—) together with a hydrocarbon linkage; k represents an integer of from 1 to 6; q and r each independently represent an integer of from 0 to 5, and wherein k, q and/or r are 2 or more, two or more of $R^1$, $X^1$, $R^2$ and/or $R^3$ may be the same as or different from each other.

According to a second aspect of the invention, there is provided an ink jet recording device comprising:

an undercoating liquid application unit that applies an undercoating liquid containing a monomer represented by the following formula (I) or formula (II) onto a recording medium;

an undercoating liquid curing unit that is provided downstream in the recording medium moving direction of the undercoating liquid application unit and that partially cures the undercoating liquid by imparting energy to at least a portion of the undercoating liquid; and an image recording unit that is provided downstream in the recording medium moving direction of the undercoating liquid curing unit and that forms an image by ejecting, onto the partially cured undercoating liquid, an ink that is curable by irradiation with actinic energy rays, (I)

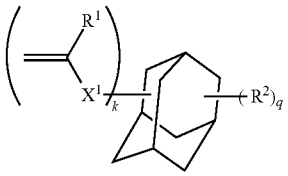

(II)

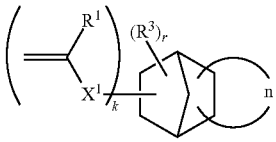

wherein, in formulae (I) and (II): $R^1$ represents a hydrogen atom, a halogen atom, or an alkyl group having carbon atoms of from 1 to 4; $X^1$ represents a divalent linking group; $R^2$ and $R^3$ each independently represent a substituent; n represents an atom group that is necessary for formation of a cyclic hydrocarbon structure that may contain a carbonyl linkage (—C(O)—) and/or an ester linkage (—C(O)O—) together with a hydrocarbon linkage; k represents an integer of from 1 to 6; q and r each independently represent an integer of from 0 to 5, and wherein k, q and/or r are 2 or more, two or more of $R^1$, $X^1$, $R^2$ and/or $R^3$ may be the same as or different from each other.

BRIEF DESCRIPTION OF THE DRAWINGS

Exemplary embodiments of the present invention will be described in detail based on the following figures, wherein.

DETAILED DESCRIPTION OF THE INVENTION

Figure 1A:
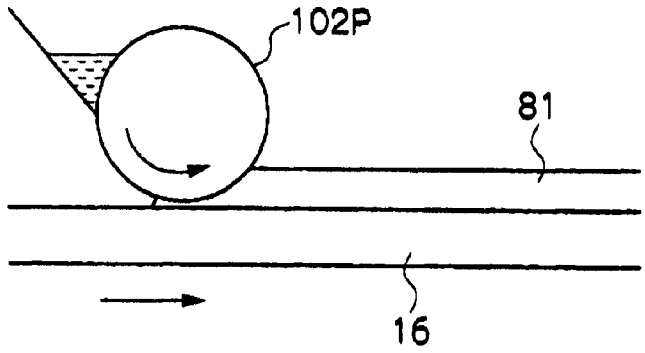
FIGS. 1A to 1D are flow charts showing the mechanism of forming an image.

The ink jet recording method of the invention includes the processes of applying an undercoating liquid containing a monomer represented by the following formula (I) or formula (II) (hereinafter, referred to as "specific monomer") onto a recording medium; partially curing the applied undercoating liquid; and forming an image by ejecting an ink capable of being cured by irradiation with actinic energy rays onto the partially cured undercoating liquid. The method may further include other processes such as partially curing of the ink, as necessary.

(I)

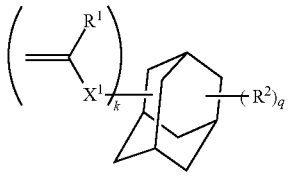

(II)

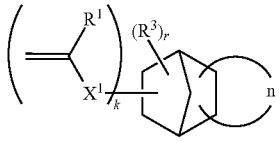

wherein, in formulae (I) and (II): $R^1$ represents a hydrogen atom, a halogen atom, or an alkyl group having carbon atoms of from 1 to 4; $X^1$ represents a divalent linking group; $R^2$ and $R^3$ each independently represent a substituent; n represents an atom group that is necessary for formation of a cyclic hydrocarbon structure that may contain a carbonyl linkage (—C(O)—) and/or an ester linkage (—C(O)O—) together with a hydrocarbon linkage; k represents an integer of from 1 to 6; q and r each independently represent an integer of from 0 to 5, and wherein k, q and/or r are 2 or more, two or more of $R^1$, $X^1$, $R^2$ and/or $R^3$ may be the same as or different from each other.

Generally, in an ink jet recording method, ink droplets are ejected so as to partly overlap each other in order to obtain a high degree of image density, and the adjacent ink droplets contact each other before being dried while staying on a recording medium. Therefore, image bleeding or unevenness in line width of fine lines may easily occur due to the coalescence of the ink droplets to prevent the formation of an image having high sharpness. However, according to the ink jet recording method of the invention, in which an undercoating liquid is applied onto a recording medium and partially cured, coalescence between the adjacent ink droplets can be suppressed by the interaction between the undercoating liquid and the ink droplets, even when the ink droplets are applied onto the partially cured undercoating liquid so as to partly overlap each other. Consequently, image bleeding and unevenness in line width of fine lines are effectively prevented.

Further, by including the specific monomer in the undercoating liquid, the partially cured state can be formed not only the inside of the liquid but also the surface thereof, which is in contact with the air, by suppressing the influence of inhibiting polymerization by oxygen at the time of partially curing. Therefore, in a case where the image is composed of the regions with and without ink, such as a checkered pattern, the flow of the ink from the ejected position to a non-ejected position can be suppressed and the dot shape at the border of the ejected and non-ejected regions can be retained, thereby maintaining the density of the whole image with favorable reproducibility to details and improving the reproducibility of a clear and high-quality image.

The invention is particularly effective when images are formed on a non-permeable or slowly-permeable recording medium having low liquid absorbability.

In the invention, the expression "adjacent ink droplets" refers to the liquid droplets of a single color ink that have been ejected from ink ejecting ports so as to have overlapping portions thereof, or the liquid droplets of inks of different colors respectively ejected from ink ejecting ports so as to have overlapping portions thereof. The adjacent ink droplets may be the liquid droplets that are ejected at the same time, or may be a combination of the liquid droplets that are ejected first, and the liquid droplets that are ejected subsequent to the first ejected liquid droplets.

In the invention, at least one kind of ink and at least one kind of undercoating liquid are used as the liquids for formation of an image. The undercoating liquid preferably has a different composition from that of the ink. The undercoating liquid is preferably applied onto the region that is equal to, or larger than, the region where an image is to be formed by the ejection of the ink droplets onto a recording medium.

Further, the ink in the invention is preferably used as inks of plural colors in a multicolor ink set. In a case of using the multicolor ink set, partial curing of the ink droplets may be performed after each ejection of the ink of each color.

One of the specific configurations of the ink jet recording method of the invention includes the steps of applying, onto a recording medium, an undercoating liquid containing a polymerizable or crosslinkable material together with the specific monomer in the invention (to be described later) in advance in the region that is equal to, or larger than, the region where an image is to be formed with the above-described ink droplets; applying energy rays or heat to the undercoating liquid that has been applied onto the recording medium to partially cure the undercoating liquid; and after partially curing the undercoating liquid, ejecting ink droplets of plural colors onto the undercoating liquid that has been applied onto the recording medium, wherein the ink droplets contain a polymerizable or crosslinkable material for formation of the image and have a different composition from that of the undercoating liquid.

The above method preferably includes a step of fixing the recorded image to further promote the curing of the undercoating liquid and the ink by applying energy or the like, after the undercoating liquid has been applied and at least all of the desired inks (preferably inks of plural colors) have been ejected, from the viewpoint of achieving excellent fixing properties.

—Application of Undercoating Liquid and Recording—

In the undercoating liquid application process, an undercoating liquid is applied onto a recording medium. The undercoating liquid contains at least the specific monomer represented by the above-described formulae (I) or (II), and preferably contains a radical polymerizable compound and a surfactant. The undercoating liquid may further contain other components. Details of the components that constitute the undercoating liquid layer will be discussed later.

In the recording process, images are recorded by ejecting an ink that is curable by irradiation with actinic energy rays onto a partially cured undercoating liquid that has been partially cured in a partially curing process to be described later. The ink is applied onto the partially cured undercoating liquid in the form of droplets by using an ink jet nozzle or the like.

In the ink jet recording method of the invention, the undercoating liquid can be applied onto the recording medium using a coating device, an ink jet nozzle, and the like.

(i) Application Using an Application Device

In a preferable embodiment of the invention, images are recorded by applying an undercoating liquid onto a recording medium using an application device, and thereafter ink droplets are ejected using an ink jet nozzle. Details of the ink jet nozzle will be discussed later.

The type of the application device is not particularly limited and can be selected from known application devices as appropriate according to purposes. Examples of the application devices include an air doctor coater, blade coater, lot coater, knife coater, squeeze coater, immersion coater, reverse roll coater, transfer roll coater, gravure coater, kiss roll coater, cast coater, spray coater, curtain coater and extruding coater. Details of these coating devices are described in Yuji Harasaki, "Coating Engineering", (1978).

(ii) Ejection by Ink Jet Nozzle

In the invention, an embodiment is also preferable in which images are recorded by ejecting an undercoating liquid from ink jet nozzles, and thereafter ink droplets are ejected by ink jet nozzles. Details of the ink jet nozzles will be discussed later.

As the conditions for applying the undercoating liquid by the ink jet nozzles, it is preferable that the undercoating liquid is ejected by a head capable of ejecting a greater amount per droplet and having lower nozzle density as compared with the head used for the ink, and the head is arranged as a full-line head unit in a width direction of the recording medium. Such a head capable of ejecting a great amount per droplet generally has a high degree of ejection power and is therefore compatible with an undercoating liquid having high viscosity, which is also advantageous in terms of avoiding nozzle clogging. Further, using a head capable of ejecting a great amount per droplet is also advantageous from the viewpoint that a low-cost head having lower driving frequency can be applied, since the droplet resolution of the undercoating liquid in a direction in which a recording medium is conveyed can be reduced.

In either case of the above embodiments, liquids other than the undercoating liquid and ink can be further applied. Any means such as an application device or an ink jet nozzle can be applied to the application of such liquids, and the timing thereof is also not particularly limited. When a colorant is contained in the liquid other than the undercoating liquid and ink, the liquid is preferably applied by ejecting with ink jet nozzles, and is preferably applied after the undercoating liquid has been applied.

Next, a method of ejecting using ink jet nozzles (ink jet recording method) will be discussed.

In the invention, known ink jet recording methods are preferably used, such as an electrostatic induction method in which ink is ejected by the use of electrostatic power, drop-on-demand method (pressure-pulse method) utilizing vibration pressure of a piezoelectric element, acoustic ink jet method in which ink is ejected by means of radiation pressure caused by irradiating the ink with acoustic beams which has been converted from an electric signal, and a thermal ink jet method of utilizing pressure generated by heating ink to form air bubbles.

In the invention, the ink is preferably ejected onto the partially cured undercoating liquid to a droplet size of from 0.1 pL (picoliter; hereinafter the same) to 100 pL. When the droplet size is within the above range, an image with high sharpness and density can be effectively formed. The droplet size is more preferably in the range of from 0.5 pL to 50 pL.

The amount of the undercoating liquid to be applied in terms of mass ratio per area is preferably from 0.05 to 5, more preferably from 0.07 to 4, and still more preferably from 0.1 to 3.

The ejection interval between the application of the undercoating liquid and the ejection of the ink droplets is preferably in the range of from 5μ seconds to 10 seconds. When the ejection interval is within the above range, the effect of the invention can be remarkably achieved. The ejection interval of the ink droplet is more preferably in the range of from 10μ seconds to 5 seconds, and particularly preferably from 20μ seconds to 5 seconds.

Further, in the recording process, multicolor images can be recorded using an ink set including inks of multiple colors. In this case, in terms of reproducibility of a fine image or color tone, a step of partially curing at least one of the inks of multiple colors that has been ejected onto a recording medium is preferably provided.

—Partially Curing Process—

In the partially curing process, the undercoating liquid that has been applied in the above-described application process is partially cured.

In the invention, the curing process is provided after the application of the undercoating liquid and before the ejection of at least one ink.

In the invention, the expression "partially curing" refers to a state in which the undercoating liquid is partially, but not completely, cured. When the undercoating liquid that has been applied onto a recording medium (substrate) is partially cured, the degree of the curing may be uneven. For example, the curing is preferably more developed at a deeper point in a depth direction.

When a radical polymerizable undercoating liquid layer is used in the air or the air that has partly been substituted by an inert gas, the radial polymerization at the surface of the undercoating liquid layer tends to be inhibited by the action of oxygen to inhibit the radial polymerization. As a result, the degree of the curing becomes uneven and the curing tends to be more developed in the inside of the undercoating liquid layer than at the surface thereof.

In a case where a cationic polymerization liquid layer is used in the air containing moisture, the curing also tends to be more developed in the inside of the undercoating liquid layer than at the surface thereof, due to the action of the moisture to inhibit the cationic polymerization.

In the invention, when a radical photopolymerizable undercoating liquid layer is used under coexistence of oxygen having the nature of inhibiting radical polymerization and is partially photo-cured, the degree of curing of the undercoating liquid layer becomes higher at the outside than in the inside thereof.

When an ink (hereinafter, referred to as "colored liquid" sometimes) is ejected onto an undercoating liquid layer that has been partially cured, favorable effects can be achieved in the quality of an image that has been formed onto a recording medium. The mechanism of this action can be determined by observing a section of the recording medium.

Hereinafter, explanation will be given taking the case where an ink of about 12 pL is ejected onto a partially cured undercoating liquid layer having a thickness of 5 μm as an example.

Figure 6:
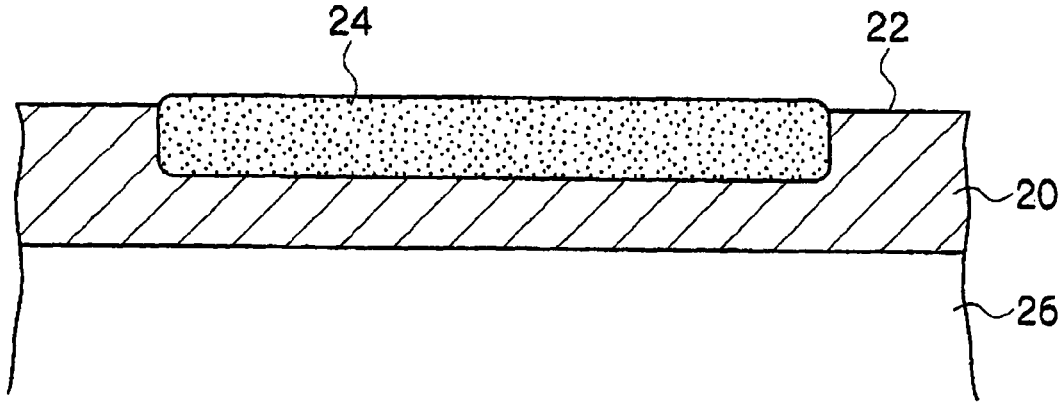
FIG. 6 is a schematic sectional view showing a recording medium on which an image is formed by ejecting an ink onto a partially cured undercoating liquid.

In the invention, an undercoating liquid layer is partially cured and the degree of curing thereof is higher at a point that is closer to a substrate, relative to that at a point more remote from the substrate. In this case, three features can be observed: that is, as shown in FIG. 6, (1) a part of an ink 24 is exposed on the surface; (2) a part of the ink 24 is submerged in an undercoating liquid layer 20; and (3) the undercoating liquid layer 20 exists between the ink 24 and the substrate 26. Therefore, the recording medium on which an image is formed by applying the ink 24 onto the partially cured undercoating liquid layer 20 has a section as schematically shown in FIG. 6. In a case where all of the above conditions (1), (2) and (3) are satisfied, it can be determined that the ink 24 has been applied onto the undercoating liquid layer 20 in a partially cured state. In this case, the ink droplets that have been ejected with high density coalesce with each other to form a colored film, and a uniform and high degree of color density can be achieved.

Figure 7A:
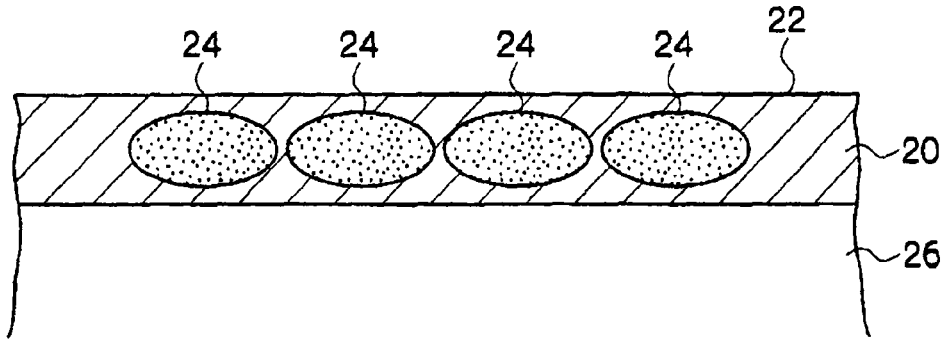
FIGS. 7A and 7B are schematic sectional views showing a recording medium on which an image is formed by ejecting an ink onto an undercoating liquid that has not been cured.
Figure 7B:
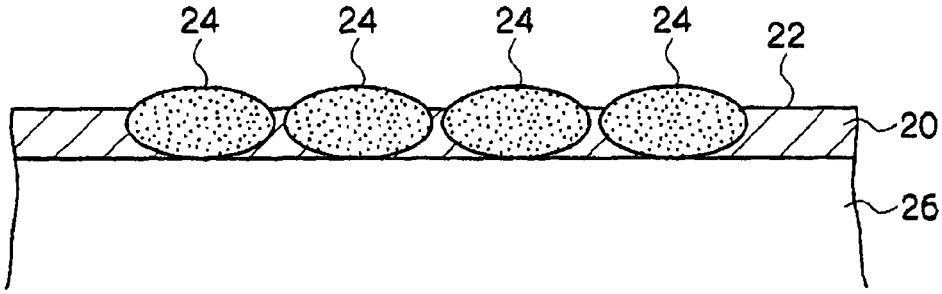

On the other hand, as shown in FIGS. 7A and 7B, when the ink 24 is ejected onto the undercoating liquid layer 20 that has not been cured, the ink 24 submerges entirely in the undercoating liquid layer 20, and/or the undercoating liquid layer 20 does not exist between the ink 24 and the substrate 26. In this case, the droplets remain independent from each other even when the ink is applied with high density, thereby becoming a factor of reduced color density. The recording medium on which an image is formed by applying the ink 24 onto the uncured undercoating liquid layer 20 has a section as schematically shown in FIGS. 7A and 7B.

Figure 7C:
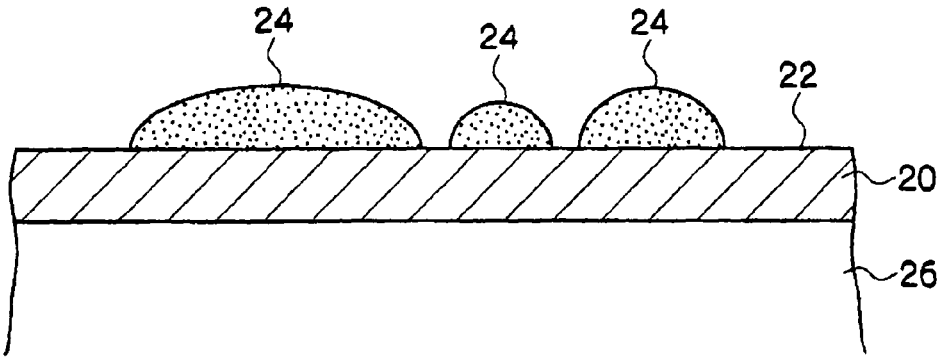
FIG. 7C is a schematic sectional view showing a recording medium on which an image is formed by ejecting an ink onto an undercoating liquid that has been completely cured.

When the ink 24 is ejected onto a completely cured undercoating liquid layer 20, the ink 24 does not submerge in the undercoating liquid layer 20, as shown in FIG. 7C. Such a situation may become a factor of interdroplet interference, thereby failing to form a uniform colored liquid film and causing reduction in color reproducibility. The recording medium on which an image is formed by applying the ink 24 onto the completely cured undercoating liquid layer 20 has a section as schematically shown in FIG. 7C.

It is preferable that the amount per area of the uncured part of the undercoating liquid layer is sufficiently smaller than the largest amount per area of the applied ink, from the viewpoint that when the ink droplets are applied with high density, they do not remain independent of each other, and form a uniform liquid layer of the ink; and that the occurrence of interdroplet interference is prevented. Therefore, the mass per area of the uncured part of the undercoating liquid layer "M (undercoating liquid)" and the largest mass per area of the applied ink droplets "m (ink)" preferably satisfies a relation "m (ink)/30<M (undercoating liquid)<m (ink)", further preferably satisfies a relation "m (ink)/20<M (undercoating liquid)<m (ink)/3", and still more preferably satisfies a relation "m (ink)/10<M (undercoating liquid)<m (ink)/5". The largest mass per area of the ink to be ejected here refers to the largest mass of each case of respective colors. When a relation "m (ink)/30<M (undercoating liquid)" is satisfied, occurrence of interdroplet interference can be prevented and excellent dot size reproducibility can be achieved. Further, when a relation "M (undercoating liquid)<m (ink)" is satisfied, uniform liquid layer of the ink can be formed and high density can be obtained.

The mass per area of the uncured part of the undercoating liquid can be determined by a transferring test, in which a permeable medium such as a plain paper sheet is pressed against the partially cured undercoating liquid, at a point after the completion of the partially curing process (e.g., after irradiation with actinic energy rays) and prior to the ejection of the ink droplets, and the mass of the undercoating liquid that has been transferred onto the permeable medium from the undercoating layer is measured.

For example, when the largest ejection amount of the ink droplets in an ejection density of 600×600 dpi is 12 pL per pixel, the largest mass per area of the ejected ink "m (ink)" is determined to be 7.4 g/cm$^2$ (here, the density of the ink is assumed to be 1.1 g/cm$^3$). Therefore, the preferable mass per area of the uncured part of the undercoating liquid is greater than 0.25 g/cm$^2$ and less than 7.4 g/cm$^2$, more preferably greater than 0.37 g/cm$^2$ and less than 2.5 g/cm$^2$, and still more preferably greater than 0.74 g/cm$^2$ and less than 1.48 g/cm$^2$.

Figure 8:
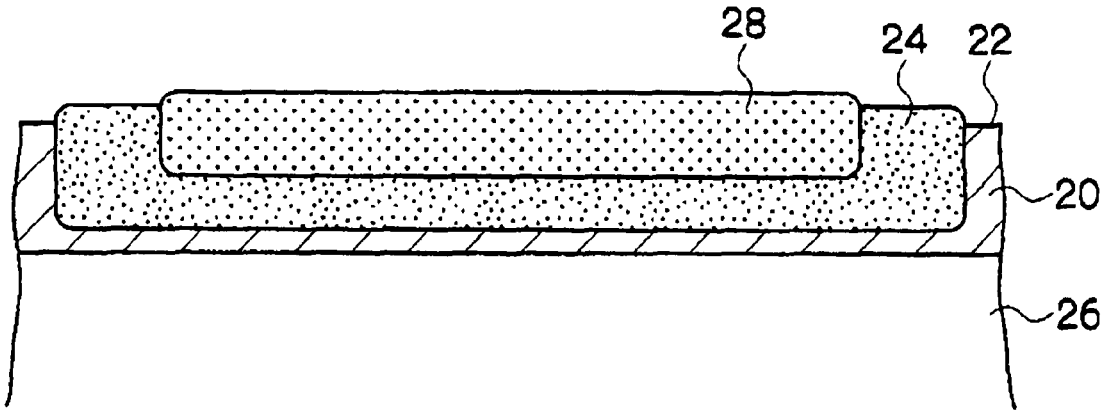
FIG. 8 is a schematic sectional view showing a recording medium on which an image is formed by ejecting an ink B onto a partially cured ink A.

Further, in a case of forming a secondary color from the inks of two colors (hereinafter, referred to as an ink A and an ink B), one of the inks can be applied onto the other ink that has been partially cured, e.g., applying the ink B onto the partially cured ink A. When the ink B is ejected onto the partially cured ink A, a part of the ink B28 submerges in the ink A24, and at the same time, the ink A24 exists under the ink B28. Therefore, a recording medium on which an image is formed by applying the ink B28 onto the partially cured ink A24 has a section as schematically shown in FIG. 8. By laminating the cured layers of the inks A and B, favorable color reproduction can be achieved.

Figure 9A:
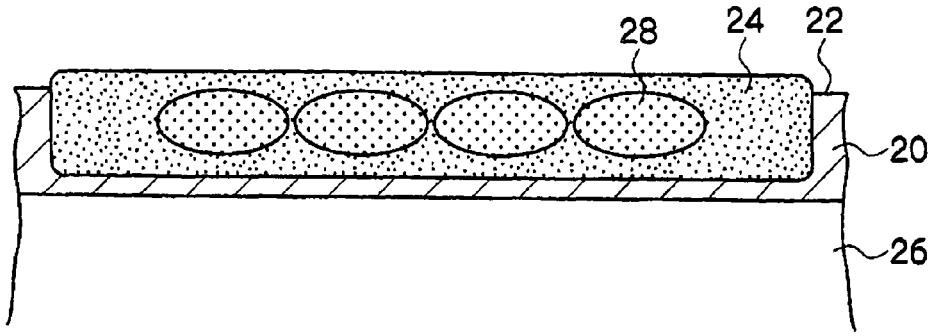
FIGS. 9A and 9B are schematic sectional views showing a recording medium on which an image is formed by ejecting an ink B onto an ink A that has not been cured.
Figure 9B:
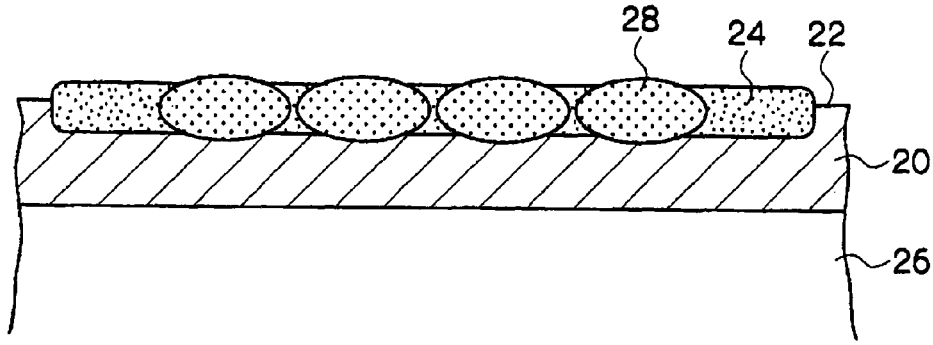

On the other hand, when the ink B is ejected onto the uncured ink A, the ink B28 submerges entirely in the ink A24, as shown in FIG. 9A, and/or the ink A24 does not exist under the ink B28, as shown in FIG. 9B. In this case, the droplets remain independent from each other even when the ink B is applied with high density, thereby becoming a factor of reduced color saturation of the secondary color. The recording medium on which an image is formed by applying the ink B28 onto the uncured ink A24 thus has a section as schematically shown in FIGS. 9A and 9B.

Figure 9C:
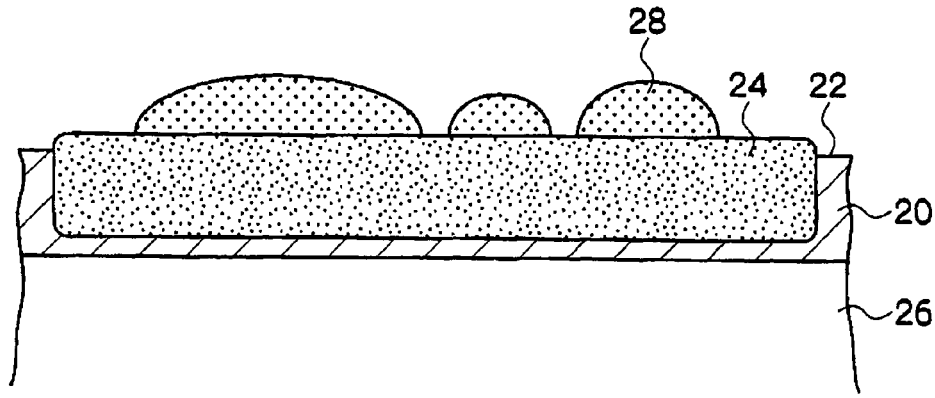
FIG. 9C is a schematic sectional view showing a recording medium on which an image is formed by ejecting an ink B onto an ink A that has been completely cured.

When the ink B is ejected onto the completely cured ink A, ink B28 does not submerge in the ink A24, as shown in FIG. 9C. Such a situation may become a factor of interdroplet interference, thereby failing to form a uniform ink film and causing reduction in color reproducibility. The recording medium on which an image is formed by applying the ink B28 onto the completely cured ink A24 thus has a section as schematically shown in FIG. 9C.

It is preferable that the amount per area of the uncured part of the ink A is sufficiently smaller than the largest amount per area of the applied ink B, from the viewpoint that the droplets of the ink B applied with high density does not remain independent of each other, and form a uniform liquid layer of ink B, and that occurrence of interdroplet interference is prevented. Therefore, the mass per area of the uncured part of ink A layer "M (ink A)" and the largest mass per area of the applied droplets of the ink B "m (ink B)" preferably satisfies a relation "m (ink B)/30<M (ink A)<m (ink B)", further preferably satisfies a relation "m (ink B)/20<M (ink A)<m (ink B)/3", and still more preferably satisfies a relation "m (ink B)/10<M (ink A)<m (ink B)/5". When a relation "m (ink B)/30<M (ink A)" is satisfied, occurrence of interdroplet interference can be prevented, and excellent dot size reproducibility can be achieved. Further, when a relation "M (ink A)<m (ink B)" is satisfied, uniform liquid layer of an ink can be formed and high density can be obtained.

The mass per area of the uncured part of the ink A can be determined by a transferring test, in which a permeable medium such as a plain paper sheet is pressed against the partially cured layer of ink A, at a point after the completion of the partially curing process (e.g., after irradiation with actinic energy rays) and prior to the ejection of the droplets of ink B, and the mass of the liquid that has been transferred onto the permeable medium from the layer of the ink A is measured.

For example, when the largest ejection amount of the droplets of the ink B in an ejection density of 600×600 dpi is 12 pL per pixel, the largest mass per area of the ejected ink B "m (ink)" is determined to be 7.4 g/cm$^2$ (here, the density of the ink B is assumed to be 1.1 g/cm$^3$). Therefore, the mass per area of the uncured part of the layer of the ink A is preferably greater than 0.25 g/cm$^2$ and less than 7.4 g/cm$^2$, more preferably greater than 0.37 g/cm$^2$ and less than 2.5 g/cm$^2$, and still more preferably greater than 0.74 g/cm$^2$ and less than 1.48 g/cm$^2$.

When the curing reaction is based on an ethylene unsaturated compound or a cyclic ether, the unpolymerization rate can be quantitatively measured from the reaction rate of the ethylene unsaturated compound or the cyclic ether.

When the above-described partially cured state of the undercoating liquid and/or the ink is achieved by polymerization reaction of a polymerizable compound that starts polymerization by irradiation with actinic energy rays or heating, the unpolymerization rate defined as "A (after polymerization)/A (before polymerization)" is preferably from 0.2 to 0.9, more preferably from 0.3 to 0.9, and still more preferably from 0.5 to 0.9, in terms of improving abrasion resistance of a printed material.

In the above discussion, "A (after polymerization)" indicates an absorbance at an infrared absorption peak of a polymerizable group after polymerization, and "A (before polymerization)" indicates an absorbance at an infrared absorption peak of a polymerizable group before polymerization. For example, when the polymerizable compound contained in the undercoating liquid and/or the ink is an acrylate monomer or a methacrylate monomer, an absorption peak based on a polymerizable group (acrylate group or methacrylate group) can be observed in the vicinity of 810 cm$^{-1}$, and the unpolymerizaion rate is preferably determined by the absorbance at this peak. On the other hand, when the polymerizable compound is an oxetane compound, an absorption peak based on a polymerizable group (oxetane group) can be observed in the vicinity of 986 cm$^{-1}$, and the unpolymerizaion rate is preferably determined by the absorbance at this peak. Further, when the polymerizable compound is an epoxy compound, an absorption peak based on a polymerizable group (epoxy group) can be observed in the vicinity of 750 cm$^{-1}$, and the unpolymerizaion rate is preferably determined by the absorbance at this peak.

As the device for measuring an infrared absorption spectrum, any commercially available infrared spectrometer of transmission type or reflection type may be used and selected according to the form of the sample. For example, an infrared spectrometer (FTS-6000, manufactured by BIO-RAD Laboratories, Inc.) can be used for the measurement.

Further, preferable partially cured state can be determined by observing the section of ink droplets ejected onto a partially cured undercoating liquid. The method of observation is not particularly limited, but for example, a commercially available microtome and an optical microscope can be used. The size of the ink droplet ejected onto the partially cured undercoating liquid is preferably in the range of from 1 pL to 100 pL, and is further preferably equal to the size of the ink droplet to be practically used. Further, the partially cured film is preferably solidified by a method of some kind, at the time of observation. The method for the solidification is not particularly limited, but may be performed by freezing, polymerization or the like.

The methods for partially curing the undercoating layer can be any known methods for increasing viscosity such as: (1) a method of utilizing a so-called aggregation phenomenon performed by adding a basic compound to an acidic polymer, or adding an acidic compound or metallic compound to a basic polymer; (2) a method of adjusting the viscosity of the undercoating liquid by preliminarily preparing an undercoating liquid to have high viscosity, then adding a low boiling point organic solvent to the undercoating liquid to decrease the viscosity thereof, and thereafter bringing the undercoating liquid back to have high viscosity by evaporating the low boiling point organic solvent; (3) a method of adjusting the viscosity of the undercoating liquid by heating the undercoating liquid which has previously been prepared to have high viscosity, then cooling the undercoating liquid back to have high viscosity; and (4) a method of causing curing reaction by applying actinic energy rays or heat to the undercoating liquid. Among these, (4) a method of causing curing reaction by applying actinic energy rays or heat to the undercoating liquid is most preferable.

The method of causing a curing reaction by applying actinic energy rays or heat to an undercoating liquid is a method of causing an insufficient polymerization reaction of a polymerizable compound at the surface of the undercoating liquid applied onto a recording medium. At the surface of the undercoating layer, the polymerization reaction is easily inhibited under the influences of oxygen in the air, as compared with the inside of the undercoating layer. Therefore, partial curing of the undercoating layer can be caused by regulating the conditions of application of actinic energy rays or heat.

The amount of the energy required for the partial curing of the undercoating liquid varies depending on the type or content of the polymerization initiator, but is generally preferably from about 1 to about 500 mJ/cm$^2$ when energy is applied by actinic energy rays. When energy is applied by heating, it is preferable to heat a recording medium under the conditions where the surface temperature of the recording medium becomes in the range of from 40 to 80° C., for a period of from 0.1 to 1 second.

By applying actinic energy rays or heat such as active light or heat, generation of active species can be promoted by decomposition of the polymerization initiator, and the curing reaction can also be promoted due to polymerization or crosslinking of a polymerizable or crosslinkable material resulting from the active species, by the increased active species or elevated temperature. Increasing of viscosity can also be favorably performed by irradiating with active light or heating.

In the above, cases of partial curing of the undercoating liquid have been mainly discussed, but the same will apply to the cases of partially curing of the ink sometimes).

The viscosity of the partially cured undercoating liquid (25° C.) is preferably 5,000 mPa·s or more and less than 100,000 mPa·s. The viscosity of the undercoating liquid can be measured by a commercially available viscometer (e.g., a portable digital viscometer for laboratory use, VISCO-STICK, manufactured by MARUYASU INDUSTRIES Co., Ltd.), in the sample obtained by scraping up the undercoating liquid layer (25° C.).

Further, the viscosity of the inside of the partially cured undercoating liquid (25° C.) is preferably at least 1.5 times higher, more preferably at least 2 times higher, and still more preferably at least 3 times higher than that of the surface portion of the partially cured undercoating liquid (25° C.) from the viewpoint of suppressing coalesce between adjacent ink droplets by means of interaction of the undercoating liquid and the ink droplets.

The polymerization rate of the polymerizable compound in the partially cured undercoating liquid is preferable from 1% to 70%, more preferably from 5% to 60%, and still more preferably from 10% to 50%. The polymerization rate can be measured by IR or the like.

Specific examples of the actinic energy rays are the same as those used in the later discussed fixing process and include ultraviolet rays, visible rays, α-rays, γ-rays, X-rays and electron beams, wherein ultraviolet rays and visible rays are preferable and ultraviolet rays are particularly preferable, from the viewpoint of cost or safety.

—Fixing Process—

A fixing process is preferably carried out after the processes of above discussed undercoating liquid applying, partially curing and recording. In the fixing process, curing of the undercoating liquid and ejected ink is further promoted by applying energy or the like, thereby fixing the recorded image.

When a polymerizable or crosslinkable material is contained in the image, the curing reaction due to the polymerization or crosslinking of the material is promoted by applying energy, and therefore an image having higher strength can be formed more efficiently. For example, in a case of a system containing a polymerization initiator, generation of active species is promoted by the decomposition of the polymerization initiator, and the curing reaction resulting from polymerization or crosslinking of polymerizable or crosslinkable materials due to the active species is promoted by the increased active species or elevated temperature.

Application of energy can favorably be performed by irradiating with actinic energy rays or heating. As the actinic energy, similar ones to the later discussed active lights for image fixation can be used, such as ultraviolet rays, visible rays, α-rays, γ-rays, X-rays and electron beams, wherein ultraviolet rays and visible rays are preferable and ultraviolet rays are particularly preferable, from the viewpoint of cost or safety.

Further, the heating can be performed using a non-contact type heating device, and preferable ones include a heating device in which the recording medium passes through, such as an oven, or a heating device in which exposure is performed over the whole area with light in the range of ultraviolet light—visible light—infrared light, or the like. Examples of the preferable light sources for use in exposure as a heating device include a metal halide lamp, xenon lamp, tungsten lamp, carbon arc lamp and mercury lamp.

When the energy is applied by irradiation with actinic light, the amount of the energy required for curing reaction varies depending on the type or content of the polymerization initiator, but is generally preferably from about 100 to about 10,000 mJ/cm$^2$. When the energy is applied by heating, it is preferable to heat a recording medium under such conditions that the surface temperature of the recording medium becomes from 40 to 80° C., for a period of from 0.1 to 1 second.

(Curing Sensitivity of Ink and Undercoating Liquid)

In the invention, the curing sensitivity of the ink is preferably equal to, or higher than, the curing sensitivity of the undercoating liquid. More preferably, the curing sensitivity of the ink is not less than the curing sensitivity of the undercoating liquid and not more than 4 times as high as the curing sensitivity of the undercoating liquid. Further preferably, the curing sensitivity of the ink is not less than the curing sensitivity of the undercoating liquid and not more than twice as high as the curing sensitivity of the undercoating liquid or less.

The curing sensitivity here refers to the amount of the energy necessary to completely cure the ink and/or the undercoating liquid using a mercury lamp of super high pressure, high pressure, medium pressure or the like, preferably a super high pressure mercury lamp. Smaller amount of the energy indicates that the sensitivity is higher. Therefore, the curing sensitivity being twice as high indicates that the amount of energy is ½ as much.

When one of the two curing sensitivities is not more than twice as high as the other, the two curing sensitivities are regarded as being equal.

(Physical Properties of Ink and Undercoating Liquid)

Regarding the physical properties of the ink (liquid droplet) to be ejected onto a recording medium in an ink jet recording method, the viscosity at 25° C. thereof is preferably in the range of from 5 to 100 mPa·s, and more preferably in the range of from 10 to 80 mPa·s, although the value may vary dependent on the type of the devices. The viscosity at 25° C. of the undercoating liquid before being subjected to partially curing is preferably in the range of from 100 to 5,000 mPa·s, and more preferably in the range of from 200 to 3,000 mPa·s.

In the invention, the undercoating liquid preferably contains a surfactant from the viewpoint of forming dots of desired size onto a recording medium, and preferably satisfies all of the conditions (A), (B), and (C) described below:

(A) The surface tension of the undercoating liquid is smaller than that of at least one of the inks.

(B) At least one surfactant contained in the undercoating liquid satisfies the following relation:

$$\gamma s(0)-\gamma s(\text{saturated})>0\ (\text{mN/m}).$$

(C) The surface tension of the undercoating liquid satisfies the following relation:

$$\gamma s<(\gamma s(0)+\gamma s(\text{saturated})^{max})/2.$$

In the above relations, γs is the value of the surface tension of the undercoating liquid; γs (0) is the value of the surface tension of the liquid having a composition of the undercoating liquid from which all surfactants are excluded; γs (saturated) is the value of the surface tension of the liquid, wherein the liquid is obtained by adding one of the surfactants contained in the undercoating liquid to the above "liquid excluding all of the surfactants", the value being measured when the surface tension reaches a point of saturation as the density of the surfactant is increased; and γs (saturated)$^{max}$ is the maximum value among the values of γs (saturated) respectively measured for all kinds of the surfactants which are contained in the undercoating liquid that satisfy the above condition (B).

<Condition (A)>

In the invention, the surface tension γs of the undercoating liquid is preferably smaller than the surface tension γk of at least one of the inks in order to form ink dots of desired size onto the recording medium as described above.

Further, from the viewpoint of preventing spreading of the ink dots during the period from the landing of the ink droplets up to the exposure more effectively, the values of γs and γk preferably satisfy the relation of γs<γk−3 (mN/m), and more preferably satisfy the relation of γs<γk−5 (mN/m).

In a case of printing a full-color image, from the viewpoint of improving sharpness of the image, the surface tension of the undercoating liquid γs is preferably at least smaller than the surface tension of the ink containing a coloring agent with high visibility, and more preferably smaller than the surface tensions of all of the inks. The coloring agent with high visibility is, for example, a coloring agent that exhibits the color of magenta, black, or cyan.

Even though the values of the surface tension of the ink γk and the surface tension of the undercoating liquid γs satisfy the above-described relations, when both of the values are less than 15 mN/m, formation of the liquid droplets may become difficult at the time of ejecting the ink, and the ejection may not be carried out. On the other hand, when the above values are greater than 50 mN/m, wettability with the ink jet head may be deteriorated to cause a failure in ejection. Therefore, it is preferable that each of the surface tension of the ink γk and the surface tension of the undercoating liquid γs is within the range of from 15 mN/m to 50 mN/m, more preferably in the range of from 18 mN/m to 40 mN/m, and particularly preferably in the range of from 20 mN/m to 38 mN/m.

The surface tension mentioned here is a value measured in accordance with a Wilhelmy method at a liquid temperature of 20° C. and at 60% RH, by a commonly used surface tensiometer (for example, surface tensiometer CBVP-Z, manufactured by KYOWA INTERFACE SCIENCE Co., Ltd.).

<Conditions (B) and (C)>

In the invention, the undercoating liquid preferably contains at least one kind of surfactant in order to form the ink dots of desired size onto a recording medium. In this case, it is preferable that at least one kind of surfactant contained in the undercoating liquid satisfies the condition (B) described below:

$$\gamma s(0)-\gamma s(\text{saturated})>0(\text{mN/m}) \qquad \text{Condition (B)}$$

Further, it is preferable that the surface tension of the undercoating liquid preferably satisfies the condition (C) described below:

$$\gamma s<(\gamma s(0)+\gamma s(\text{saturated})^{max})/2 \qquad \text{Condition (C)}$$

As mentioned above, γs is the value of the surface tension of the undercoating liquid; γs (0) is the value of the surface tension of the liquid having a composition of the undercoating liquid from which all surfactants are excluded; γs (saturated) is the value of the surface tension of the liquid, wherein the liquid is obtained by adding one kind of the surfactants contained in the undercoating liquid to the above "liquid excluding all of the surfactants", and wherein the value is measured when the surface tension reaches a point of saturation as the density of the surfactant is increased; and γs (saturated)$^{max}$ is the maximum value among the values of γs (saturated) respectively measured for all kinds of surfactants contained in the undercoating liquid that satisfy the above condition (B).

The value γs (0) can be obtained by measuring the value of the surface tension of the liquid having the composition of the undercoating liquid from which all surfactants are excluded. The value γs (saturated) can be obtained by adding one kind of the surfactant contained in the undercoating liquid to the "liquid excluding all of the surfactants", then increasing the concentration of the surfactant by the increment of 0.01% by mass, and measuring the surface tension at the point where the change in the degree of the surface tension relative to the change in the concentration of the surfactant becomes 0.01 mN/m or less.

Details of the values γs (0), γs (saturated) and γs (saturated)$^{max}$ will be discussed below by reference to the case where the components of the undercoating liquid (Example 1) are: a high boiling point solvent (diethyl phthalate, manufactured by Wako Pure Chemical Industries, Ltd.); a polymerizable material (dipropylene glycol diacrylate, manufactured by Akcros Chemicals Ltd.), a polymerization initiator (TPO, shown below as "Initiator-1"); a fluorine-based surfactant (MEGAFAC F475, manufactured by Dainippon Ink and Chemicals, Inc.); and a hydrocarbon-based surfactant (sodium di-2-ethylhexyl sulfosuccinate).

Initiator-1

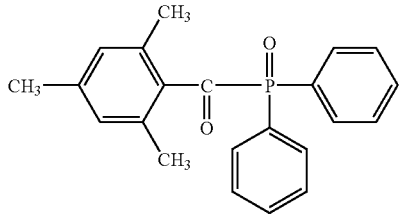

In the above example, the values of γs (O), γs (saturated)$^1$ (when the fluorine-based surfactant is added), γs (saturated)$^2$ (when the hydrocarbon-based surfactant is added), γs (saturated), and γs (saturated)$^{max}$ are determined as follows.

The value of γs (0), indicating the surface tension of the liquid having a composition of the undercoating liquid from which all surfactants are excluded, is determined as 36.7 mN/m.

The value of γs (saturated)$^1$, which is the saturated value of the surface tension of the liquid when the fluorine-based surfactant is added and the concentration thereof is increased, is determined as 20.2 mN/m.

The value of γs (saturated)$^2$, which is the saturated value of the surface tension of the liquid when the hydrocarbon-based surfactant is added and the concentration thereof is increased, is determined as 30.5 mN/m.

Since the undercoating liquid (Example 1) contains two kinds of the surfactants that satisfy the above-described condition (B), there are two values of γs (saturated), i.e., the value when the fluorine-based surfactant is added (γs (saturated)$^1$) and the value when the hydrocarbon-based surfactant is added (γs (saturated)$^2$). Here, the value of γs (saturated)$^{max}$, i.e., the maximum value between γs (saturated)$^1$ and γs (saturated)$^2$, is determined as the value of γs (saturated)$^2$.

The above results are summarized as follows:

$\gamma s(0)=36.7$ mN/m $\gamma s(\text{saturated})^1=20.2$ mN/m (when the fluorine-based surfactant is added)

$\gamma s(\text{saturated})^2=30.5$ mN/m (when the hydrocarbon-based surfactant is added)

$\gamma s(\text{saturated})^{max}=30.5$ mN/m

From the above results, the surface tension of the undercoating liquid γs preferably satisfies the relationship:

$$\gamma s<(\gamma s(0)+\gamma s(\text{saturated})^{max})/2=33.6 \text{ mN/m}.$$

As for the above-described condition (C), from the viewpoint of preventing spreading of the ink droplets during the period from the landing of the liquid droplets up to the exposure, the surface tension of the undercoating liquid more preferably satisfies the relationship:

$$\gamma s<\gamma s(0)-3\times\{\gamma s(0)+\gamma s(\text{saturated})^{max}\}/4$$

and particularly preferably satisfies the relationship:

$$\gamma s<\gamma s(\text{saturated})^{max}$$

The compositions of the ink and the undercoating liquid may be selected so that the desired surface tension can be obtained, but it is preferable that these liquids contain a surfactant. As described above, in order to form the ink dots of desired size onto a recording medium, the undercoating liquid preferably contains at least one kind of surfactant. Details of the surfactants will be explained below.

(Surfactant)

The surfactant used in the invention is a substance having strong surface activity to at least one solvent selected from hexane, cyclohexane, p-xylene, toluene, ethyl acetate, methylethylketone, butyl carbitol, cyclohexanone, triethylene glycol monobutyl ether, 1,2-hexanediol, propylene glycol monomethyl ether, isopropanol, methanol, water, isobornyl acrylate, 1,6-hexane diacrylate, and polyethylene glycol diacrylate; preferably a substance having strong surface activity to at least one kind of solvent from hexane, toluene, propylene glycol monomethylether, isobonylacrylate, 1,6-hexanediacrylate, and polyethylene glycol diacrylate, more preferably a substance having a strong surface activity to at least one solvent selected from propylene glycol monomethyl ether, isobornyl acrylate, 1,6-hexane diacrylate, and polyethylene glycol diacrylate; and particularly preferably a substance having strong surface activity to at least one solvent selected from isobornyl acrylate, 1,6-hexane diacrylate, and polyethylene glycol diacylate.

Whether a compound has strong surface activity to the solvents listed above can be determined by the procedures as described below.

(Procedures)

One solvent is selected from the solvents listed above and measure the surface tension thereof $\gamma_{solvent}(0)$. Add the objective compound in the same solvent used to measure the $\gamma_{solvent}(0)$, increase the concentration of the compound by the increment of 0.01% by mass, and measure the surface tension of the solution $\gamma_{solvent}$ (saturated) at the point when the change in the surface tension with respect to the change in the concentration of the compound becomes 0.01 mN/m or less.

If the relationship between the $\gamma_{solvent}(0)$ and the $\gamma_{solvent}$ (saturated) satisfies the following relation, the compound can be determined to have strong surface activity to the solvent:

$$\gamma_{solvent}(0)-\gamma_{solvent}(\text{saturated})>1\ (\text{mN/m}).$$

Specific examples of the surfactants contained in the undercoating liquid include anionic surfactants such as dialkylsulfosuccinates, alkylnaphthalenensulfonates and fatty acid salts; nonionic surfactants such as polyoxyethylenealkyl ethers, polyoxyethylenealkylallyl ethers, acetylene glycols and polyoxyethylene-polyoxypropylene block copolymers; cationic surfactants such as alkylamine salts and quaternary ammonium salts; and fluorine-based surfactants. Examples of other surfactants include the surfactants described in JP-A No. 62-173463 and JP-A No. 62-183457.

—Recording Medium—

Any recording medium of permeable, non-permeable or slowly-permeable can be used as the recording medium in the ink jet recording method in the invention. Among these, a non-permeable and a slowly-permeable recording medium are preferable from the viewpoint that the effect of the invention can be remarkably displayed. The permeable recording medium refers to, for example, a recording medium having such properties that when a liquid droplet of 10 pL is dropped onto the recording medium, the permeation time for the total amount of the droplet is 100 ms or less. The description "substantially does not permeate" refers to, for example, the conditions where the permeability of the liquid droplets after the lapse of one minute is 5% or less. The slowly-permeable recording medium refers to a recording medium having such properties that when a liquid droplet of 10 pL is dropped onto the recording medium, the permeating time for the total amount of the droplet is 100 ms or more.

Examples of the permeable recording media include plain paper, porous paper, and other recording media that are capable of absorbing a liquid.

Examples of the materials of the recording media which are non-permeable or slowly-permeable include art paper, synthetic resin, rubber, resin coated paper, glass, metal, ceramic, and wood. In the invention, a composite recording medium composed of some of the above materials in combination can also be used for the purpose of adding functions.

Any kind of synthetic resin can be used as the synthetic resin, and examples thereof include polyesters such as polyethylene terephthalate and polybutadiene terephthalate, polyolefins such as polyvinyl chloride, polystyrene, polyethylene, polyurethane, and polypropylene, acrylic resins, polycarbonate, acrylonitrile-butadiene-styrene copolymers, diacetate, triacetate, polyimide, cellophane, and celluloid. The thickness and shape of the recording medium when a synthetic resin is used are not particularly limited and the medium may be any shape of film, card and block, and may be either transparent or opaque.

As to the form of usage, the synthetic resin is preferably used in the form of a film for so-called light wrapping, and various non-absorbing plastics and a film thereof can be used. Examples of the plastic films include a PET film, an OPS film, an OPP film, a PNy film, a PVC film, a PE film, a TAC film, and a PP film. Examples of other plastics include polycarbonate resins, acrylic resins, ABS resins, polyacetal resins, PVA resins, and rubbers.

Examples of the resin coated papers include a transparent polyester film, an opaque polyester film, an opaque polyolefin resin film, and a paper supporting body having both sides laminated with a polyolefin resin. A paper supporting body having both sides laminated with a polyolefin resin is particularly preferable.

The kind of the metals is not particularly limited and preferable examples thereof include aluminum, iron, gold, silver, copper, nickel, titanium, chromium, molybdenum, silicon, lead, zinc, stainless steel, and composite materials thereof.

Further, ink jet recording can be performed on the label side of read-only optical disks such as CD-ROMs and DVD-ROMs, write-once optical disks such as CD-Rs and DVD-Rs, rewritable optical disks and the like.

—Ink and Undercoating Liquid—

The ink and the undercoating liquid used in the ink jet recording method in the invention will be explained in detail.

The ink has such a composition that images are at least formed. The ink preferably contains at least one polymerizable or crosslinkable material, and a polymerization initiator, lipophilic solvent, coloring agent or other components may further be contained depending on necessity.

The undercoating liquid preferably contains at least a monomer (specific monomer) represented by the formula (I) or formula (II) described below, and has a different composition from that of the ink. The undercoating liquid preferably contains at least one polymerizable or crosslinkable material, and a polymerization initiator, lipophilic solvent, coloring agent or other components may further be contained depending on necessity.

The polymerization initiator preferably is capable of initiating polymerization reaction or crosslinking reaction by means of actinic energy rays. By using the polymerization initator, the undercoating liquid applied onto the recording medium can be cured by irradiation with actinic energy rays.

Further, the undercoating liquid preferably contains a radical polymerizable composition. The radical polymerizable composition in the invention contains at least one radical polymerizable material and at least one radical polymerization initiator. By using the radical polymerizable composition, the curing reaction of the undercoating liquid can be carried out with high sensitivity, in a short time.

The ink in the invention preferably contains a coloring agent. The undercoating liquid to be used in combination with the ink preferably contains no coloring agent; a coloring agent to the amount of less than 1% by mass; or a white pigment as a coloring agent. The following are the details of each component constituting these liquids.

(Monomer)

The undercoating liquid of the invention includes at least one monomer (specific monomer) represented by the following formula (I) or formula (II). Typically, progression of polymerization curing tends to delay at the surface of the undercoating liquid, due to the influence of oxygen that inhibits polymerization, as compared with the inside thereof. However, by including the specific monomer in the undercoating liquid, especially those having an adamantane or norbornene skeleton, polymerization at the surface of the undercoating liquid at the time of partial curing can maintain its progressive state. That is, the surface of the liquid can also be partially cured as well as the inside thereof in the process of partially curing, thereby effectively preventing the ink from flowing out from the position where the ink has been ejected to the non-ejected position (which occurs when the ink is ejected onto the surface of the uncured undercoating liquid), and maintaining the dot shape at the border of the ejected and non-ejected regions of the ink.

(I)

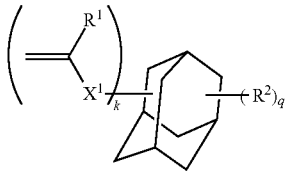

(II)

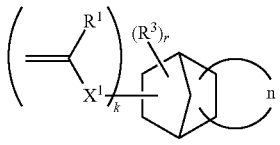

In formulae (I) and (II), $R^1$ represents a hydrogen atom, a halogen atom (such as chlorine atom, fluorine atom or a bromine atom), or an alkyl group having carbon atoms of from 1 to 4 (such as a group of methyl, ethyl, n-propyl, isopropyl, n-butyl, isobutyl or t-butyl). From the viewpoint of affordability of raw material, $R^1$ is preferably a hydrogen atom or an alkyl group having carbon atoms of from 1 to 4, further preferably a hydrogen atom or a methyl group. When k is 2 or more, two or more of $R^1$ may be the same as or different from each other.

In formula (I) and formula (II), $X^1$ represents a divalent linking group. Examples of the divalent linking groups include an ether group (—O—), ester group (—C(O)O— or —OC(O)—), amide group (—C(O)NR'—), carbonyl group (—C(O)—), imino group (—NR'—), alkylene groups having from 1 to 15 carbon atoms (such as methylene, ethylene, butylene and octylene) which may have a substituent or may not, and a combination of two or more thereof. R' represents a hydrogen atom, an alkyl group of straight, branched or cyclic structure having from 1 to 20 carbon atoms (such as methyl, ethyl, n-propyl, isopropyl, n-butyl, isobutyl, t-butyl, n-octyl, isooctyl, t-octyl, dodecanyl, octadecanyl and cyclohexyl), or an aryl group having from 6 to 20 carbon atoms (such as phenyl, naphthyl and anthracenyl). When k is 2 or more, two or more of $X^1$ may be the same as or different from each other.

Further, the end of $X^1$ that links to the vinyl group is preferably an ester group or an amide group in which the carbonyl carbon of $X^1$ and the vinyl group link to each other. In this case, the other part of $X^1$ that links to the adamantane or norbornene skeleton may be a single bond, or may be appropriately selected from the above-mentioned groups.

In formula (I) and formula (II), the substitution number k of the vinyl part including $R^1$ and $X^1$ ($H_2C{=}C(R^1)—X^1—$) represents an integer of from 1 to 6. The vinyl part including $R^1$ and $X^1$ may link at any position on the alicyclic hydrocarbon structure. The expression "alicyclic hydrocarbon structure" here refers to the adamantane structure in formula (I), norbornene structure in formula (II), and cyclic hydrocarbon structure in formula (II).

Further, from the viewpoint of improving compatibility with a dye, the end of $X^1$ in formula (I) and formula (II) that links to the vinyl group is preferably an oxygen atom, more preferably an ether-type oxygen atom. $X^1$ in formula (I) and formula (II) is further preferably a structure represented by $—C(O)O(CH_2CH_2O)_p—$ (p denotes 1 or 2).

$R^2$ and $R^3$ in formula (I) and formula (II) each independently represent a substituent that may link at any position on the alicyclic hydrocarbon structure. The substitution number q of $R^2$ and the substitution number r of $R^3$ each independently represent an integer of from 1 to 5. When q and/or r are 2 or more, two or more of $R^2$ and/or two or more of $R^3$ may be the same as or different from each other.

The $R^2$(s) and $R^3$(s) may each independently be a monovalent or polyvalent substituent. Examples of the preferable monovalent substituents include a hydrogen atom, hydroxyl group, substituted or non-substituted amino group, thiol group, ciloxane group, substituted or non-substituted hydrocarbon group having carbon atoms of up to 30 in total (such as methyl, ethyl, n-propyl, isopropyl, n-butyl, isobutyl, t-butyl, n-octyl, isooctyl, t-octyl, dodecanyl, octadecanyl and cyclohexyl), or a heterocyclic group (such as 3-pyrydyl, 2-furyl, 2-thienyl, 2-pyrydyl, 2-pyrymidinyl and 2-benzothiazolyl), and an oxy group (=O) is a preferable example of the polyvalent groups.

In formula (II), n represents an atom group that is necessary for formation of a cyclic hydrocarbon structure, the ends of which may be substituted at any position of the norbornene skeleton, and the structure of which may be monocyclic or polycyclic. The atom group may contain a carbonyl linkage (—C(O)—) and/or an ester linkage (—C(O)O—) together with a hydrocarbon linkage, as the cyclic hydrocarbon structure.

Further, in formula (I), a carbon atom in the adamantane skeleton may be substituted by a carbonyl linkage (—C(O)—) and/or an ester linkage (—C(O)O—), and in formula (II), a carbon atom in the norbornene skeleton may be substituted by an ether linkage (—O—) and/or an ester linkage (—C(O)O—).

In formula (I), it is particularly preferable that $R^1$ is a hydrogen atom or a methyl group, $X^1$ is $—C(O)O(CH_2CH_2O)_p—$ (p denotes 1 or 2), k is 1, and $R^2$ is a hydrogen atom.

The monomer represented by the above formula (II) is preferably the monomer represented by the following formulae (III), (IV) or (V).

(III)

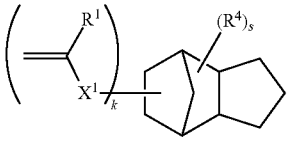

(IV)

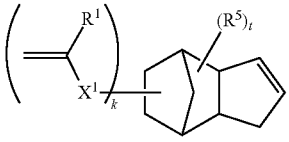

(V)

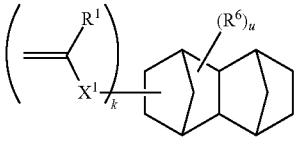

In formulae (III), (IV) and (V), $R^1$ represents a hydrogen atom, a halogen atom, or an alkyl group having from 1 to 4 carbon atoms; $X^1$ represents a divalent linking group; $R^4$, $R^5$ and $R^6$ each independently represent a substituent; k represents an integer of from 1 to 6; s, t and u each independently represent an integer of from 0 to 5. When k, s, t and/or u are 2 or more, two or more of $R^1$, $X^1$, $R^4$, $R^5$ and/or $R^6$ may be the same as or different from each other.

$R^1$, $X^1$, and k in formulae (III), (IV) and (V) are defined in the same manner as in formulae (I) and (II), as well as the preferable ranges and examples thereof.

In formulae (III), (IV) and (V), the vinyl group including $R^1$ and $X^1$ may link at any position in the alicyclic hydrocarbon structures shown below:

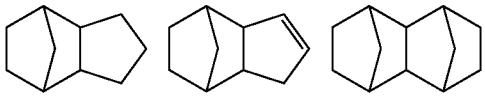

In formulae (III), (IV) and (V), $R^4$, $R^5$ and $R^6$ each independently represent a substituent, which may link at any position in the above alicyclic hydrocarbon structures. The substituents represented by $R^4$, $R^5$ and $R^6$ are defined in the same manner as in formulae (I) and (II), as well as the preferable ranges and examples thereof.

In formulae (III), (IV) and (V), s, t and u each independently represent an integer of from 0 to 5, and when s, t and/or u are 2 or more, two or more of $R^4$, $R^5$ and/or $R^6$ may be the same as or different from each other.

In formulae (III), (IV) and (V), it is particularly preferable that $R^1$ is a hydrogen atom or a methyl group, $X^1$ is —C(O)O$(CH_2CH_2O)_p$— (p denotes 1 or 2), k is 1, and $R^4$ in formula (III), $R^5$ in formula (IV) and $R^6$ in formula (V) are a hydrogen atom, respectively.

The following are the preferable specific examples of the monofunctional monomers (exemplary compounds M-1 to M-29) represented by formulae (I) and (II). In some of the exemplary compounds, carbon atoms (C) and hydrogen atoms (H) in a hydrocarbon chain are not illustrated for simplification.

(M-1)

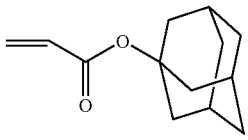

(M-2)

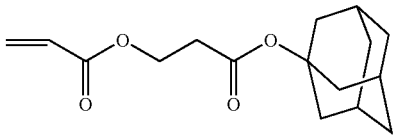

(M-3)

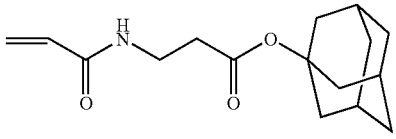

(M-4)

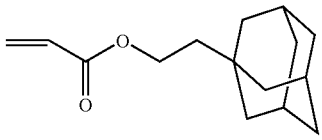

(M-5)

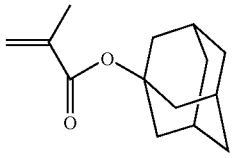

(M-6)

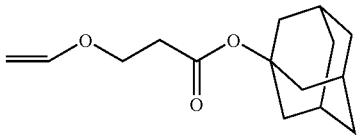

(M-7)

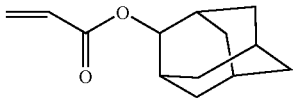

(M-8)

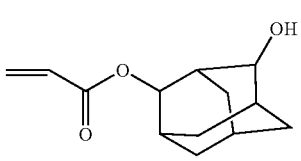

(M-9)

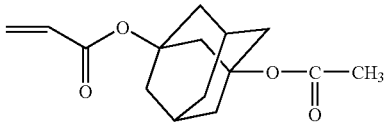

(M-10)

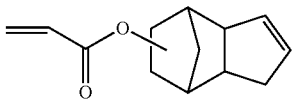

(M-11)

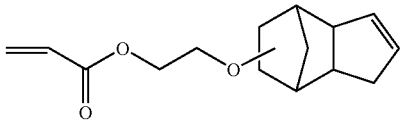

-continued
(M-12)
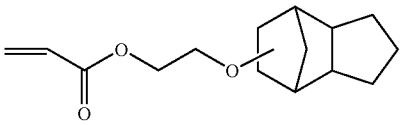
(M-13)
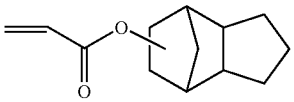
(M-14)
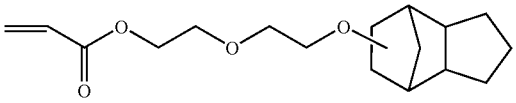
(M-15)
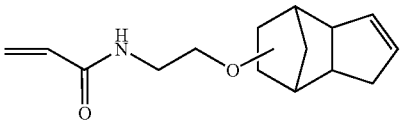
(M-16)
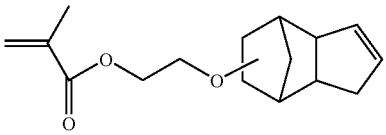
(M-17)
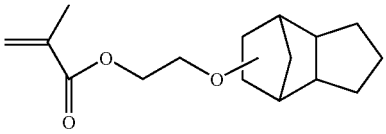
(M-18)
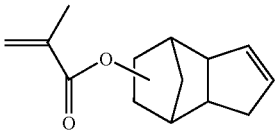
(M-19)
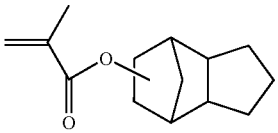
(M-20)
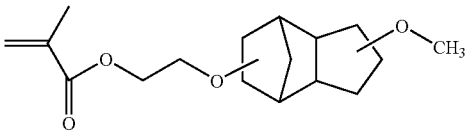
(M-21)
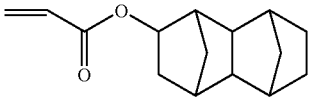
-continued
(M-22)
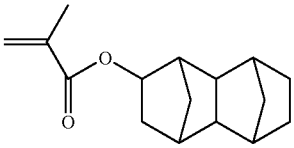
(M-23)
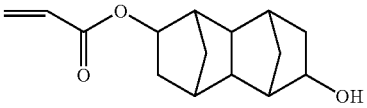
(M-24)
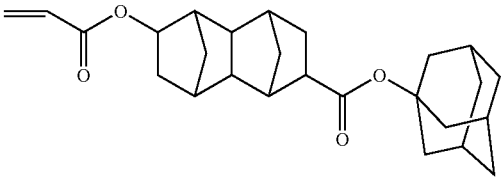
(M-25)
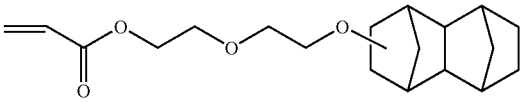
(M-26)
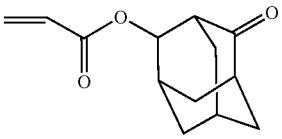
(M-27)
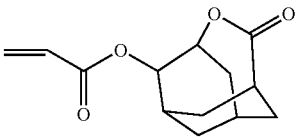
(M-28)
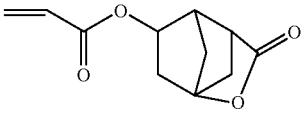
(M-29)
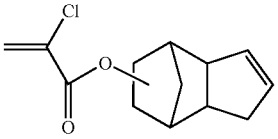
The Following are the Preferable Specific Examples of the Polyfunctional Monomers (exemplary compounds M-30 to M-38) represented by formulae (I) and (II). In some of the exemplary compounds, carbon atoms (C) and hydrogen atoms (H) in a hydrocarbon chain are not illustrated for simplification.

(M-30)

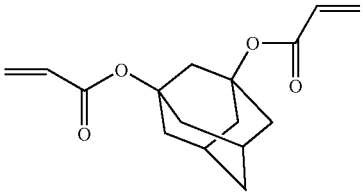

(M-31)

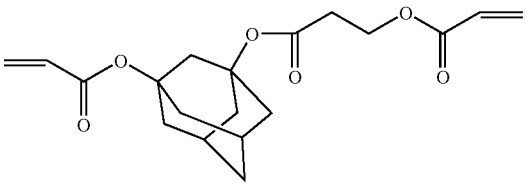

(M-32)

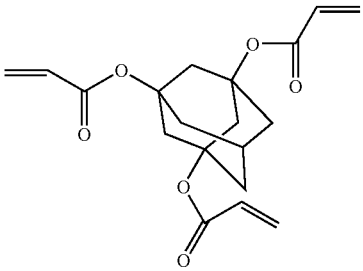

(M-33)

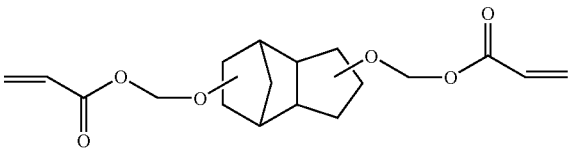

(M-34)

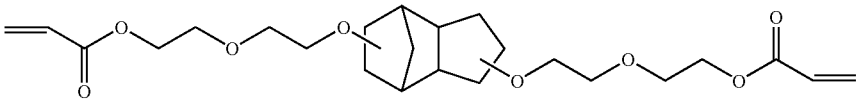

(M-35)

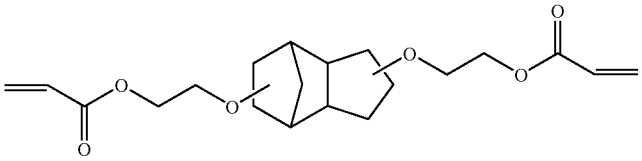

(M-36)

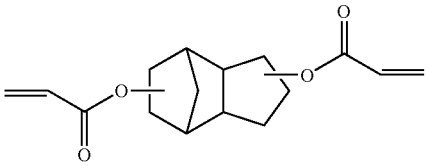

(M-37)

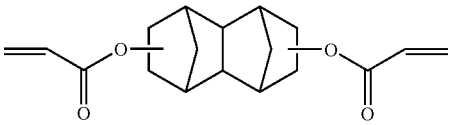

(M-38)

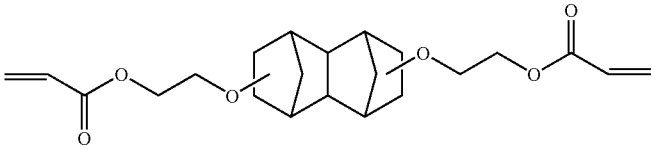

Among the above monofunctional and polyfunctional monomers, it is particularly preferable to use the exemplary monomers M-1, M-10, M-11, M-12, M-13, M-16 and M-35, in terms of preventing polymerization inhibition due to oxygen, when used in the undercoating liquid in the invention.

Examples of commercially available specific monomers include those represented by formula (II), such as FA511A, FA512A, FA513A, FA512M and FA513M (manufactured by HITACHI CHEMICAL Co., Ltd.), IRR214 (manufactured by DAICEL-CYTEC Company, Ltd), and R-684 (manufactured by NIPPON KAYAKU Co., Ltd.).

The monomer (specific monomer) represented by formulae (I) or (II) may be used alone or in combination of two or more.

The content of the specific monomer in the undercoating liquid is preferably 50% by mass or more, more preferably 70% by mass or more, and still more preferably 90% by mass or more, with respect to the total mass of the undercoating liquid. The upper limit thereof is not particularly limited, but is preferably up to 98% by mass. When the content of the specific monomer is within the above range, the undercoating liquid having excellent curing properties and an appropriate degree of viscosity, capable of effectively maintaining the dot shape at the border of the ejected and non-ejected regions of the ink, and thereby improving reproducibility of clear and favorable images by preventing change in density outlining the border or image bleeding, and maintaining the density over the whole image with good reproducibility to details.

It is preferable that at least one monomer represented by formulae (I) or (II) is a monofunctional monomer, which is more preferably a monofunctional acrylate. When the monofunctional monomer is used, favorable curing properties of the undercoating liquid or flexibility of the cured film can be obtained.

(Polymerizable or Crosslinkable Material)

The polymerizable or crosslinkable material that can be used together with the monomer represented by the above formulae (I) or (II) in the invention has a function of causing polymerization or crosslinking by the action of an initiating species such as a radical generated from a polymerization initiator described later, thereby curing a composition containing the initiating species.

Known polymerizable or crosslinkable materials that cause a polymerization or crosslinking reaction such as a radical polymerization reaction or dimerization reaction can be used as the polymerizable or crosslinkable material. Examples of the polymerizable or crosslinkable materials include an addition polymerizable compound having at least one ethylenically unsaturated double bond, a polymer compound having a maleimide group in a side chain, and a polymer having a group having an unsaturated double bond positioned adjacent to an aromatic core and is capable of photodimerization, such as a cinnamyl group, a cinnamylidene group, a chalcone group or the like, in a side chain. Among these, an addition polymerizable compound having at least one ethylenically unsaturated double bond is more preferable, and particularly preferably a compound selected from the compounds having at least one and more preferably two or more of terminal ethylenically unsaturated bonds (monofunctional or polyfunctional compound). It can be appropriately selected from the widely known compounds in the industrial field to which the invention is related, and examples thereof include a compound having a chemical form of a monomer, a prepolymer (i.e., a dimer, a trimer, and an oligomer), a mixture thereof, and a copolymer of these compounds.

The polymerizable or crosslinkable materials may be used alone or in combination of two or more.

The polymerizable or crosslinkable materials in the invention are particularly preferably various known radical polymerizable monomers that cause a polymerization reaction by an initiating species generated from a radical initiator.

Examples of the radical polymerization monomers include (meth)acrylates, (meth)acrylamides, aromatic vinyls, vinyl ethers, and compounds having an inner double bond (maleic acid, etc.). In this case, "(meth)acrylate" refers to both or either one of "acrylate" and "methacrylate," and "(meth) acryl" refers to both or either one of "acryl" and "methacryl."

Specific examples of the (meth)acrylates include the following compounds.

Specific examples of the monofunctional (meth)acrylates include hexyl (meth)acrylate, 2-ethylhexyl (meth)acrylate, tert-octyl (meth)acrylate), isoamyl (meth)acrylate, decyl (meth)acrylate, isodecyl (meth)acrylate, stearyl (meth)acrylate, isostearyl (meth)acrylate, cyclohexyl (meth)acrylate, 4-n-butylcyclohexyl (meth)acrylate, bornyl (meth)acrylate, isobornyl (meth)acrylate, benzyl (meth)acrylate, 2-ethylhexyl diglycol (meth)acrylate, butoxyethyl (meth)acrylate, 2-chloroethyl (meth)acrylate, 4-bromobutyl (meth)acrylate, cyanoethyl (meth)acrylate, benzyl (meth)acrylate, butoxymethyl (meth)acrylate, 3-methoxybutyl (meth)acrylate, alkoxymethyl (meth)acrylate, alkoxyethyl (meth)acrylate, 2-(2-methoxyethoxy)ethyl (meth)acrylate, 2-(2-butoxyethoxy)ethyl (meth)acrylate, 2,2,2-trifluoroethyl (meth)acrylate, 1H,1H,2H,2H-perfluorodecyl (meth)acrylate, 4-butylphenyl (meth)acrylate, phenyl (meth)acrylate, 2,3,5,6-tetramethylphenyl (meth)acrylate, 4-chlorophenyl (meth) acrylate, phenoxymethyl (meth)acrylate, phenoxyethyl (meth)acrylate, glycidyl (meth)acrylate, glycidyloxybutyl (meth)acrylate, glycidyloxyethyl (meth)acrylate, glycidyloxypropyl (meth)acrylate, tetrahydrofurfuryl (meth)acrylate, hydroxyalkyl (meth)acrylate, 2-hydroxyethyl (meth)acrylate, 3-hydroxypropyl (meth)acrylate, 2-hydroxypropyl (meth)acrylate, 2-hydroxybutyl (meth) acrylate, 4-hydroxybutyl (meth)acrylate, dimethylaminoethyl (meth)acrylate, diethylaminoethyl (meth)acrylate, dimethyaminopropyl (meth)acrylate, diethylaminopropyl (meth) acrylate, trimethoxysilylpropyl (meth)acrylate, trimethylsilylpropyl (meth)acrylate, polyethyleneoxide monomethylether (meth)acrylate, oligoethyleneoxide monomethylether (meth)acrylate, polyethyleneoxide (meth) acrylate, oligoethylenoxide (meth)acrylate, oligoethyleneoxide monoalkylether (meth)acrylate, polyethyleneoxide monoalkylether (meth)acrylate, dipropylene glycol (meth) acrylate, polypropyleneoxide monoalkylether (meth)acrylate, oligopropyleneoxide monoalkylether (meth)acrylate, 2-methacryloyloxyethyl succinic acid, 2-methacryloyloxyhexahydrophthalic acid, 2-methacryloyloxyethyl-2-hydroxypropyl phthalate, butoxydiethylene glycol (meth)acrylate, trifluoroethyl (meth)acrylate, perfluorooctylethyl (meth) acrylate, 2-hydroxy-3-phenoxypropyl (meth)acrylate, EO-modified phenol (meth)acrylate, EO-modified cresol (meth)acrylate, EO-modified nonylphenol (meth)acrylate, PO-modified nonylphenol (meth)acrylate, and EO-modified-2-ethyhexyl (meth)acrylate.

Specific examples of the bifunctional (meth)acrylates include 1,6-hexadiol di(meth)acrylate, 1,10-decanediol di(meth)acrylate, neopentyl glycol di(meth)acrylate, 2,4-dimethyl-1,5-pentanediol di(meth)acrylate, butylethylpropanediol (meth)acrylate, ethoxylated cyclohexanemethanol di(meth)acrylate, polyethylene glycol di(meth)acrylate, oligoethylene glycol di(meth)acrylate, ethylene glycol di(meth) acrylate, 2-ethyl-2-butyl-butanediol di(meth)acrylate, hydroxypivalic neopentyl glycol di(meth)acrylate, EO-modified bisphenol A di(meth)acrylate, bisphenol F polyethoxy di(meth)acrylate, polypropylene glycol di(meth)acrylate, oligopropylene glycol di(meth)acrylate, 1,4-butanediol di(meth)acrylate, 2-ethyl-2-butylpropanediol di(meth)acrylate, 1,9-nonane di(meth)acrylate, propoxylated ethoxylated bisphenol A di(meth)acrylate, and tricyclodecane di(meth) acrylate.

Specific examples of the trifunctional (meth)acrylates include trimethylolpropane tri(meth)acrylate, trimethylolethane tri(meth)acrylate, alkyleneoxide-modified tri(meth) acrylate of trimethylolpropane, pentaerythritol tri(meth)acrylate, dipentaerythritol tri(meth)acrylate, trimethylolpropane tris((meth)acryloyloxypropyl)ether, isocyanuric alkyleneoxide-modified tri(meth)acrylate, propionic dipentaerythritol tri(meth)acrylate, tris((meth)acryloyloxyethyl)isocyanurate, hydroxypivalaldehyde-modified dimethylolpropane tri (meth)acrylate, sorbitol tri(meth)acrylate, propoxylated trimethylolpropane tri(meth)acrylate, and ethoxylated glycerin triacrylate.

Specific examples of the tetrafunctional (meth)acrylates include pentaerythritol tetra(meth)acrylate, sorbitol tetra (meth)acrylate, ditrimethylolpropane tetra(meth)acrylate, propionic dipentaerythritol tetra(meth)acrylate, and ethoxylated pentaerythritol tetra(meth)acrylate.

Specific examples of the pentafunctional (meth)acrylates include sorbitol penta(meth)acrylate and dipentaerythritol penta(meth)acrylate.

Specific examples of the hexafunctional (meth)acrylates include dipentaerythritol hexa(meth)acrylate, sorbitol hexa (meth)acrylate, alkyleneoxide-modified hexa(meth)acrylate of phosphazene, and captolactone-modified dipentaerythritol hexa(meth)acrylate.

Examples of the (meth)acrylamides include (meth)acrylamide, N-methyl(meth)acrylamide, N-ethyl (meth)acrylamide, N-propyl (meth)acrylamide, N-n-butyl (meth)acrylamide, N-t-butyl (meth)acrylamide, N-butoxymethyl (meth) acrylamide, N-isopropyl (meth)acrylamide, N-methylol (meth)acrylamide, N,N-dimethyl (meth)acrylamide, N,N-diethyl (meth)acrylamide, and (meth)acryloylmorphorine.

Specific examples of the aromatic vinyls include styrene, methylstyrene, dimethylstyrene, trimethylstyrene, ethyl styrene, isopropyl styrene, chlormethylstyrene, methoxystyrene, acetoxystyrene, chlorstyrene, dichlorstyrene, bromstyrene, methyl vinylbenzoate, 3-methylstyrene, 4-methylstyrene, 3-ethylstyrene, 4-ethylstyrene, 3-propylstyrene, 4-propylstyrene, 3-butylstyrene, 4-butylstyrene, 3-hexylstyrene, 4-hexylstyrene, 3-octylstyrene, 4-octylstyrene, 3-(2-ethyhexyl)styrene, 4-(2-ethylhexyl)styrene, allylstyrene, isopropenylstyrene, butenylstyrene, octenylstyrene, 4-t-butoxycarbonylstyrene, 4-methoxystyrene, and 4-t-butoxystyrene.

Specific examples of the vinylethers include the following compounds.

Specific examples of the monofunctional vinylethers include methylinylether, ethylvinylether, propylvinylether, n-butylvinylether, t-butylvinylether, 2-ethylhexylvinylether, n-nonylvinylether, laurylvinylether, cyclohexylvinylether, cyclohexylmethylvinylether, 4-methylcyclohexylmethylvinylether, benzylvinylether, dicyclopentenylvinylether, 2-dicyclopentenoxyethylvinylether, methoxyethylvinylether, ethoxyethylvinylether, butoxyethylvinylether, methoxyethoxyethylvinylether, ethoxyethoxyethylvinylether, methoxypolyethylene glycol vinylether, tetrahydrofurfurylvinylether, 2-hydroxyetylvinylether, 2-hydroxypropylvinylether, 4-hydroxybutylvinylether, 4-hydroxymethylcyclohexylmethylvinylether, diethylene glycol monovinylether, polyethylene glycol vinylether, chlorethylvinylether, chlorbutylvinylether, chlorethoxyethylvinylether, phenylethylvinylether, and phenoxypolyethylene glycol vinylether.

Examples of the polyfunctional vinylethers include divinylethers such as ethylene glycol divinylether, diethylene glycol divinylether, polyethylene glycol divinylether, propylene glycol divinylether, butylene glycol divinylether, hexanediol divinylether, bisphenol A alkyleneoxide divinylether and bisphenol F alkyleneoxide divinylether; and polyfunctional vinylethers such as trimethylolethane trivinylether, trimethylolpropane trivinylether, ditrimethylolpropane tetravinylether, glycerin trivinylether, pentaerythritol tetravinylether, dipentaerythritol pentavinylether, dipentaerythritol hexavinylether, ethyleneoxide added trimethylolpropane trivinylether, propyleneoxide added trimethylolpropane trivinylether, ethyleneoxide added ditrimethylolpropane tetravinylether, propyleneoxide added ditrymethylolpropane tetravinylether, ethyleneoxide added pentaerythritol tetravinylether, propyleneoxide added pentaerythritol tetravinylether, ethyleneoxide added dipentaerythritol hexavinylether, and propyleneoxide added dipentaerythritol hexavinylether.

The vinylether compound is preferably a di- or tri-vinylether compound from the viewpoint of curing property, adhesion to a recording medium, surface hardness of the formed image or the like, and particularly preferably a divinylether compound.

Other examples of the radical polymerizable monomers in the invention include vinylesters such as vinyl acetate, vinyl propionate and vinyl versatate; allylesters such as allyl acetate; halogen-containing monomers such as vinylidene chloride and vinyl chloride; cyanide vinyls such as (meth) acrylonitrile; and olefins such as ethylene and propylene.

Among the above, the radical polymerizable monomer is preferably a (meth)acrylate and (meth)acrylamides in view of curing speed, and particularly preferably a (meth)acrylate of tetrafunctional or more in view of curing speed. From the viewpoint of the viscosity of the ink composition, it is preferable to use a polyfunctional (meth)acrylate in combination with a monofunctional or bifunctional (meth)acrylate or (meth)acrylamide.

The content of the polymerizable or crosslinkable material in the ink and the undercoating liquid is preferably in the range of from 50 to 99.6% by mass with respect to the total solid content (mass) in each liquid droplet, more preferably in the range of from 70 to 99.0% by mass, and further preferably in the range of from 80 to 99.0% by mass.

The content of the polymerizable or crosslinkable material in the liquid droplet is preferably in the range of from 20 to 98% by mass with respect to the total mass of each liquid droplet, more preferably in the range of from 40 to 95% by mass, and particularly preferably in the range of from 50 to 90% by mass.

(Polymerization Initiator)

The ink and the undercoating liquid can be preferably composed using at least one polymerization initiator, and it is preferable that at least the undercoating liquid contains the polymerization initiator. This polymerization initiator is a compound that generates initiating species such as a radical by application of active light, heat, or both of these, and allow the polymerization or crosslinking reaction of the above-described polymerizable or crosslinkable materials to initiate, promote and cure.

From the aspect of the polymerizability, the polymerization initiator preferably causes a radical polymerization, and is particularly preferably a photopolymerization initiator.

The photopolymerization initiator is a compound that causes a chemical change by the action of light and an interaction with a sensitizing dye in an electronically excited state and produces at least any one of a radical, acid and base, and a photoradical generator is preferable from the viewpoint that the polymerization can be initiated with a simple means as exposure.

The photopolymerization initiator in the invention can be selected from the photopolymerization initiators having sensitivity to active light rays such as ultraviolet rays of from 400 to 200 nm, far ultraviolet rays, g-rays, h-rays, i-rays, KrF excimer laser beams, ArF excimer laser beams, electron beams, X-rays, molecular beams or ion beams.

Specifically, known photopolymerization initiators in the art can be used without limitation, such as the ones described in Bruce M. Monroe et al., *Chemical Reviews,* 93, 435 (1993); R. S. Davidson, *Journal of Photochemistry and Biology A: Chemistry,* 73. 81 (1993); J. P. Faussier, "Photoinitiated Polymerization—Theory and Applications", *Rapra Review Report*, vol. 9, Rapra Technology (1998); and M. Tsunooka et al., *Prog. Polym. Sci.,* 21, 1 (1996). Further, a group of compounds that oxidatively or reductively generates a bond cleavage through interaction with a sensitizing dye in an electronically excited state as described in F. D. Saeva, *Topics in Current Chemistry,* 156, 59 (1990); G G Maslak, *Topics in Current Chemistry,* 168, 1 (1993); H. B. Shuster et al., *JACS,* 112, 6329 (1990); I. D. F. Eaton et al., *JACS,* 102, 3298 (1980), and the like.

Preferable photopolymerization initiators can be exemplified by: (a) aromatic ketones; (b) aromatic onium salt compounds; (c) organic peroxides; (d) hexaarylbiimidazole compounds; (e) ketoxime ester compounds; (f) borate compounds; (g) azinium compounds; (h) metallocene compounds; (i) active ester compounds; and (j) compounds having a carbon-halogen bond.

Preferable examples of the (a) aromatic ketones include a compound having a benzophenone skeleton or a thioxanthone skelton described in J. P. Fouassier, J. F. Rabek, "Radiation Curing in Polymer Science and Technology", pp. 77-117

(1993). More preferable examples of the (a) aromatic ketones include α-thiobenzophenone compounds described in Japanese Patent Publication (JP-B) No. 47-6416, benzoin ether compounds described in JP-B No. 47-3981, α-substituted benzoin compounds described in JP-B No. 47-22326, benzoin derivatives described in JP-B No. 47-23664, aroylphosphonic esters described in JP-A No. 57-30704, dialkoxybenzophenone described in JP-B No. 60-26483, benzoinethers described in JP-B No. 60-26403 and JP-B No. 62-81345, α-aminobenzophenones described in JP-B No. 1-34242, U.S. Pat. No. 4,318,791 and EP No. 0284561A1, p-di(dimethylaminozenzoyl)benzene described in JP-A No. 2-211452, thio-substituted aromatic ketones described in JP-A No. 61-194062, acylphosphine sulfides described in JP-B No. 2-9597, acylphosphines described in JP-B No. 2-9596, thioxantones described in JP-B No. 63-61950, and coumarins described in JP-B No. 59-42864.

Examples of the (b) aromatic onium salt compounds include aromatic omium salts of the elements in the groups of V, VI, and VII in the periodic table, specifically N, P, As, Sb, Bi, O, S, Se, Te or I. Preferable examples thereof include iodonium salts described in EP No. 104143, U.S. Pat. No. 4,837,124, JP-A No. 2-150848 and JP-A No. 2-96514; sulfonium salts described in EP Nos. 370693, 233567, 297443, 297442, 279210 and 422570, U.S. Pat. Nos. 3,902,144, 4,933,377, 4,760,013, 4,734,444 and 2,833,827; diazonium salts (such as benzene diazoniums that may have a substituent); diazonium salt resins (such as formaldehyde resins of diazophenylamine); N-alkoxypyridium salts (examples thereof include compounds described in U.S. Pat. No. 4,743,528, JP-ANos. 63-138345, 63-142345, 63-142346 and JP-B No. 46-42363, specific examples of which including 1-methoxy-4-phenylpyridium and tetrafluoroborate); and compounds described in JP-B Nos. 52-147277, 52-14278 and 52-14279. Radicals and acids are produced as the active species.

Examples of the (c) "organic peroxides" includes almost all of the organic compounds having one or more oxygen-oxygen bonds in the molecule and can be exemplified by ester peroxide type compounds such as 3,3',4,4'-tetrakis(t-butylperoxycarbonyl)benzophenone,
3,3',4,4'-tetrakis(t-amylperoxycarbonyl)benzophenone,
3,3',4,4'-tetrakis(t-hexylperoxycarbonyl)benzophenone,
3,3',4,4'-tetrakis(t-octylperoxylcarbonyl)benzophenone,
3,3',4,4'-tetrakis(cumylperoxycarbonyl)benzophenone,
3,3',4,4'-tetrakis(p-isopropylcumylperoxycarbonyl)benzophenone, and di-t-butyldiperoxyisophthalate.

Examples of the (d) hexaarylbiimidazoles include the lophin dimers described in JP-B Nos. 45-37377 and 44-86516 such as 2,2'-bis(o-chlorophenyl)-4,4',5,5'-tetraphenylbiimidazole,
2,2'-bis(o-bromophenyl)-4,4',5,5'-tetraphenylbiimidazole,
2,2'-bis(o,p-dichlorophenyl)-4,4',5,5'-tetraphenylbiimidazole,
2,2'-bis(o-chlorophenyl)-4,4',5,5'-tetrakis(m-methoxyphenyl)biimidazole,
2,2'-bis(o,o'-dichlorophenyl)-4,4',5,5'-tetraphenylbiimidazole,
2,2'-bis(o-nitrophenyl)-4,4',5,5'-tetraphenylbiimidazole,
2,2'-bis(o-methylphenyl)-4,4',5,5'-tetraphenylbiimidazole, and
2,2'-bis(o-trifluorophenyl)-4,4',5,5'-tetraphenylbiimidazole.

Examples of the (e) ketoxime esters include 3-benzoyloxyiminobutane-2-one, 3-acetoxyimonobutane-2-one, 3-propionyloxyiminobutane-2-one, 2-acetoxyiminopentane-3-one, 2-acetoxyimino-1-phenylpropane-1-one, 2-benzoyloxyimino-1-phenylpropane-1-one, 3-p-toluenesulfonyloxyiminobutane-2-one, and 2-ethoxycarbonyloxyimino-1-phenylpropane-1-one.

Examples of the (f) borate compounds include the compounds described in U.S. Pat. Nos. 3,567,453 and 4,343,891, and EP Nos. 109,772 and 109,773.

Examples of the (g) azinium compounds are include the compounds having a N—O bond described in JP-A Nos. 63-138345, 63-142345, No. 63-142346 and 63-143537, and JP-B No. 46-42363.

Examples of the (h) metallocene compounds include the titanocene compounds described in JP-A Nos. 59-152396, 61-151197, 63-41484, 2-249, and 2-4705; and the iron-arene complexes described in JP-A Nos. 1-304453 and 1-152109.

Specific examples of the titanocene compounds include di-cyclopentadienyl-Ti-di-chloride, di-cyclopentadienyl-Ti-bis-phenyl,
di-cyclopentadienyl-Ti-bis-2,3,4,5,6-pentafluoropheny-1-yl,
di-cyclopentadienyl-Ti-bis-2,3,5,6-tetrafluoropheny-1-yl,
di-cyclopentadienyl-Ti-bis-2,4,6-trifluoropheny-1-yl,
di-cyclopentadienyl-Ti-2,6-difluoropheny-1-yl,
di-cyclopentadienyl-Ti-bis-2,4-difluoropheny-1-yl,
di-methylcyclopentadienyl-Ti-bis-2,3,4,5,6-pentafluoropheny-1-yl,
di-methylcyclopentadienyl-Ti-bis-2,3,5,6-tetrafluoropheny-1-yl,
di-methylcyclopentadienyl-Ti-bis-2,4-difluoropheny-1-yl,
bis(cyclopentadienyl)-bis(2,6-difluoro-3-(pyri-1-yl)phenyl) titanium,
bis(cyclopentadienyl)bis[2,6-difluoro-3-(methylsulfoneamide)phenyl]titanium, and
bis(cyclopentadienyl)bis[2,6-difluoro-3-(N-butylbiaroylamino)phenyl]titanium.

Examples of the (i) active ester compounds include the nitrobenzylester compounds described in EP Nos. 0290750, 046083, 156153, 271851 and 0388343, U.S. Pat. Nos. 3,901,710 and 4,181,531, JP-A Nos. 60-198538 and 53-133022; iminosulfonate compounds described in EP Nos. 0199672, 84515, 044115 and 0101122, U.S. Pat. Nos. 4,618,564, 4,371,605 and 4,431,774, JP-A Nos. 64-18143, 2-245756 and 4-365048; and the compounds described in JP-B No. 62-6223, JP-B No. 63-14340, and JP-A No. 59-174831.

Preferable examples of the (j) compounds having a carbon-halogen bond include the compounds described in Wakabayashi et al., *Bull. Chem. Soc. Japan,* 42, 2924 (1969), compounds described in U.K. Patent No. 1388492, compounds described in JP-A No. 53-133428, and the compounds described in German Patent No. 3337024.

Further, preferable examples of the compounds also include the compounds described in F. C. Schaefer et al., *J. Org. Chem.,* 29, 1527 (1964), compounds described in JP-A Nos. 62-58241 and 5-281728, compounds described in German Patent Nos. 2641100 and 3333450, and the compounds described in German Patent Nos. 3021590 and 3021599.

Examples of the photopolymerization initiator in the invention may be the compounds as shown below, but are not limited thereto. In the following formulae, Ar represents an aromatic group.

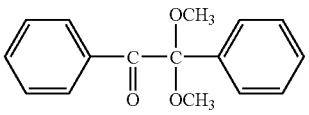

-continued
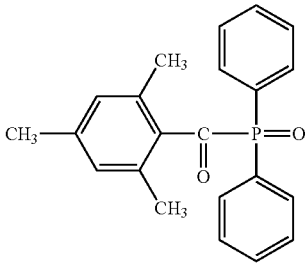
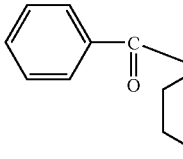
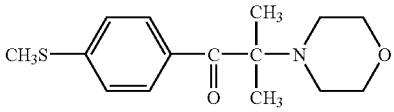
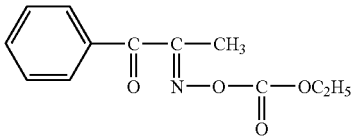
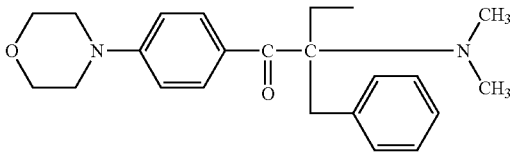
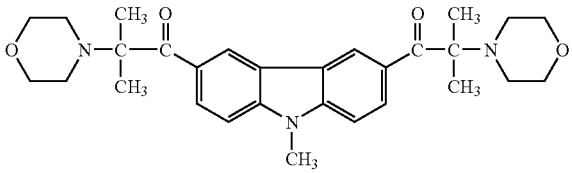
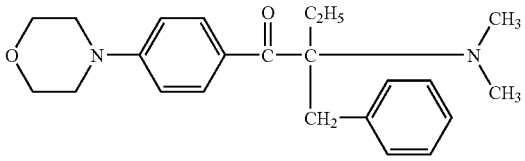
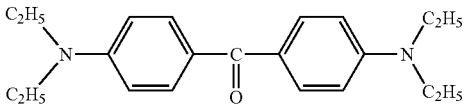
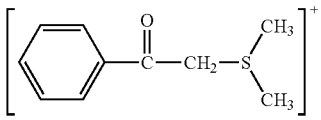
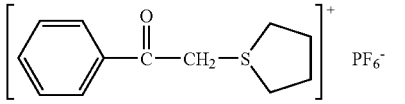
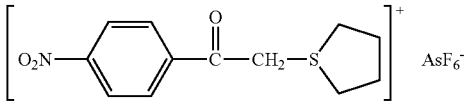
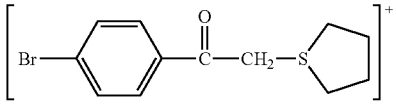
-continued
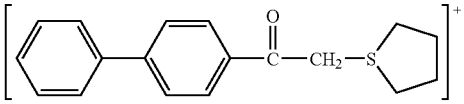
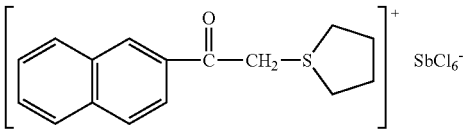
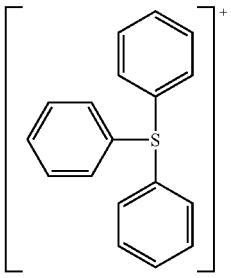
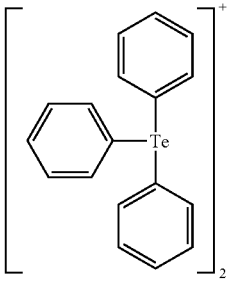
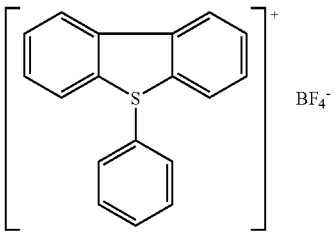
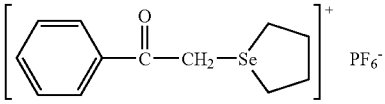
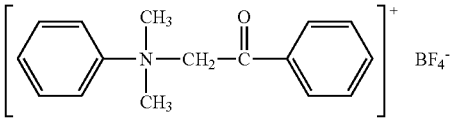
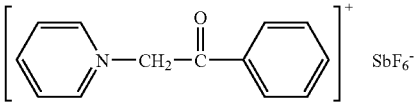
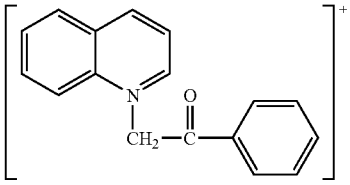

-continued
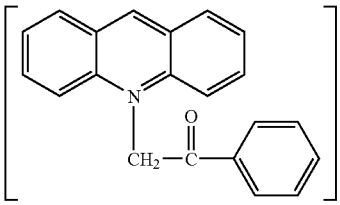
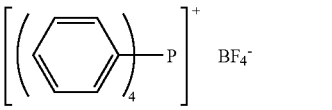
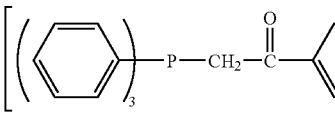
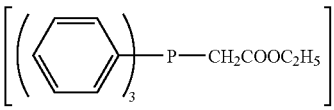
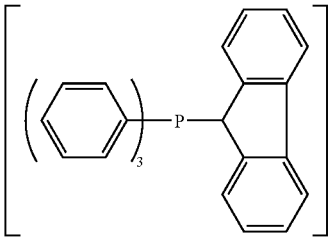
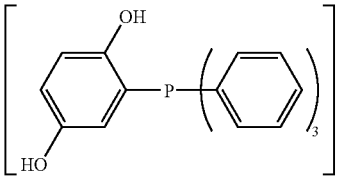
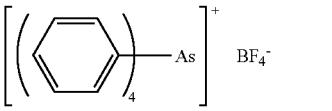
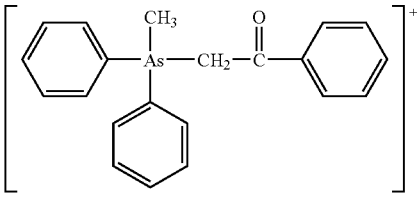
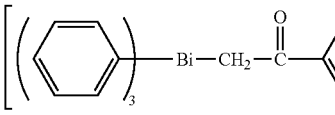
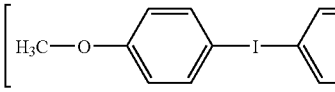
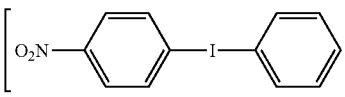
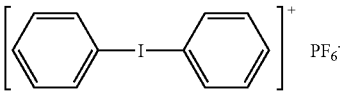
-continued
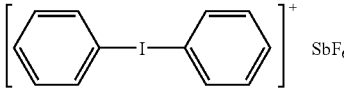
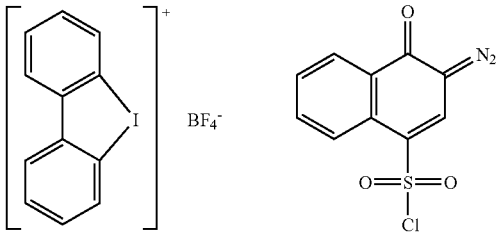
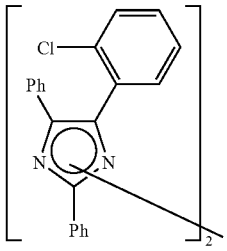
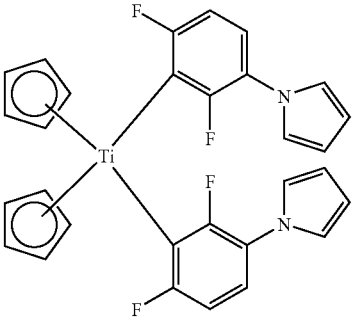
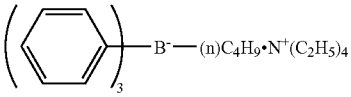
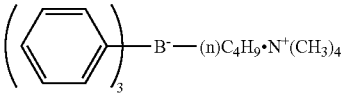
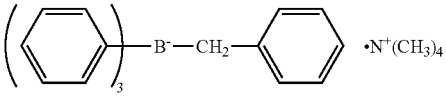
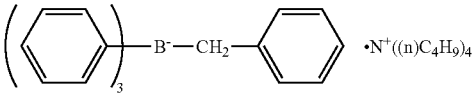
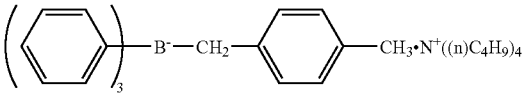
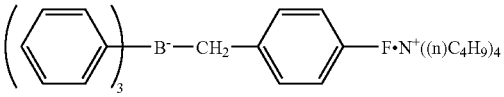
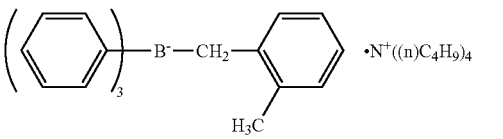
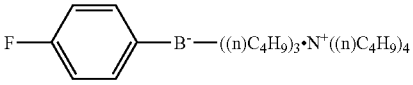

-continued

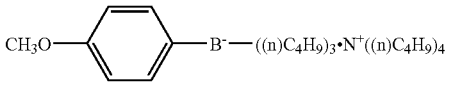

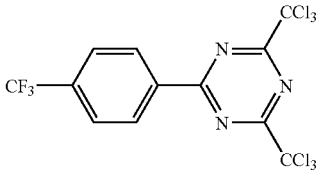

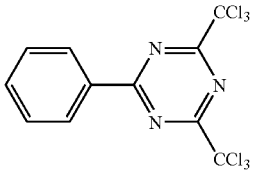

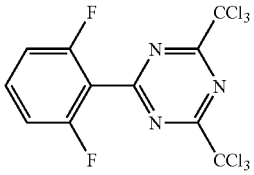

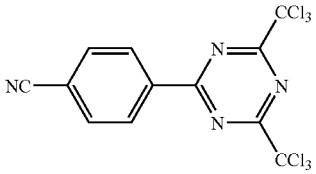

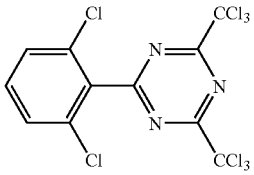

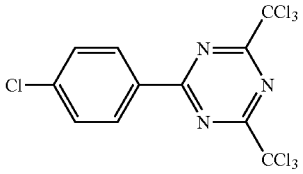

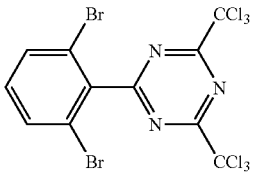

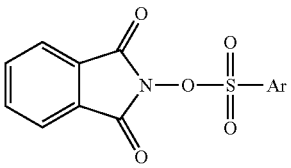

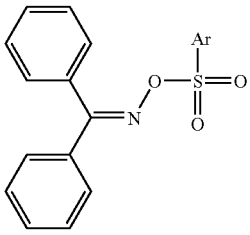

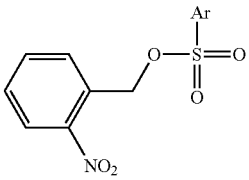

-continued

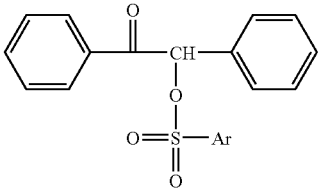

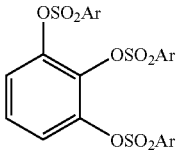

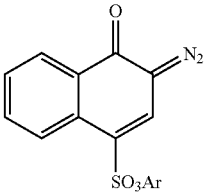

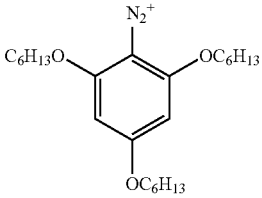

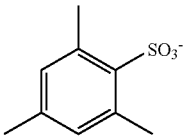

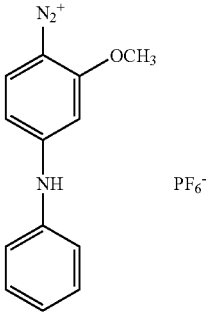

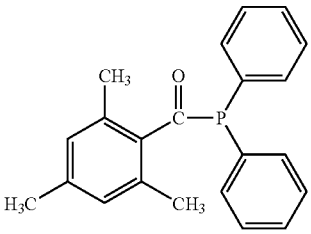

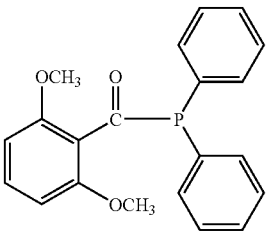

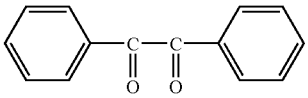

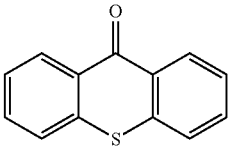

The polymerization initiator preferably has a high degree of sensitivity. However, from the viewpoint of storage stability, the polymerization initiator that does not cause thermal decomposition at a temperature up to 80° C. is preferably selected.

The polymerization initiator may be used alone or in combination of two or more kinds. Known sensitizers may also be used in combination for the purpose of improving the sensitivity as long as the effect of invention is not spoiled.

The content of the polymerization initiator in the undercoating liquid is preferably in the range of from 0.5 to 20% by mass with respect to the amount of the polymerizable material contained in the undercoating liquid, more preferably from 1 to 15% by mass, and particularly preferably from 3 to 10% by mass, from the viewpoint of temporal stability, curing property and curing speed. By containing the polymerization initiator of the amount in the above-described range, occurrence of precipitation or separation with the lapse of time and deterioration in the performances such as ink strength or rubbing resistance after curing can be suppressed.

The polymerization initiator may be contained in the ink as well as in the undercoating liquid, and the content thereof can be appropriately determined in the range where the storage stability of the ink can be maintained at the desired level. The content of the polymerization initiator in the ink droplet is preferably from 0.5 to 20% by mass with respect to the polymerizable or crosslinkable compound in the ink, and more preferably from 1 to 15% by mass.

(Sensitizing Dye)

A sensitizing dye may be added for the purpose of improving the sensitivity of the photopolymerization initiator in the invention. Preferred examples of the sensitizing dyes are the compounds included in the following compounds below and have an absorption wavelength in the range of from 350 nm to 450 nm.

Polynuclear aromatics (for example, pyrene, perylene, and triphenylene), xanthenes (for example, fluorescein, eosin, erythrosine, rhodamine B, and rose bengal), cyanines (for example, thiacarbocyanine and oxacarbocyanine), merocyanines (for example, merocyanine and carbomerocyanine), thiazines (for example, thionine, methylene blue, and toluyzine blue), acridines (for examples, acridine orange, chloroflavin, and acriflavin), anthraquinones (for example, anthraquinone), squaryliums (for example, squarylium), and cumarins (for example, 7-diethylamino-4-methylcumarin).

Examples of the preferred sensitizing dyes are the compounds represented by the following Formulas (IX) to (XIII).

(IX)

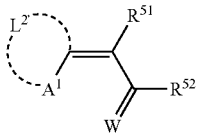

(X)

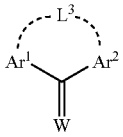

(XI)

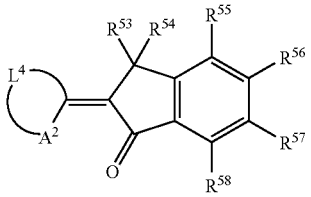

(XII)

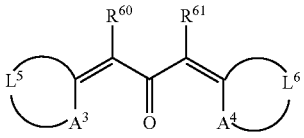

-continued (XIII)

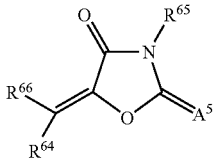

In Formula (IX), $A^1$ represents a sulfur atom or —$NR^{50}$—, $R^{50}$ represents an alkyl group or an aryl group, $L^2$ represents a non-metal atomic group that forms a basic nucleus of a dye together with the adjacent $A^1$ and the adjacent carbon atom, $R^{51}$ and $R^{52}$ each independently represent a hydrogen atom or a monovalent non-metal atomic group, wherein $R^{51}$ and $R^{52}$ may form an acid nucleus of a dye by bonding to each other. W represents an oxygen atom or a sulfur atom.

In Formula (X), $Ar^1$ and $Ar^2$ each independently represent an aryl group, and connect with each other via a bond by -$L^3$-, wherein $L^3$ represents —O— or —S—W represents an oxygen atom or a sulfur atom.

In Formula (XI), $A^2$ represents a sulfur atom or —$NR^{59}$—, $L^4$ represents a non-metal atomic group that forms a basic nucleus of a dye together with the adjacent $A^2$ and the carbon atom. $R^{53}$, $R^{54}$, $R^{55}$, $R^{56}$, $R^{57}$, and $R^{58}$ each independently represent a group of a monovalent non-metal atomic group, and $R^{59}$ represents an alkyl group or an aryl group.

In Formula (XII), $A^3$ and $A^4$ each independently represent —S—, —$NR^{62}$, or —$NR^{63}$—, $R^{62}$ and $R^{63}$ each independently represent a substituted or unsubstituted alkyl group or a substituted or unsubstituted aryl group, $L^5$ and $L^6$ each independently represent a non-metal atomic group that forms a basic nucleus of a dye together with the adjacent $A^3$, $A^4$, and the adjacent carbon atom, and $R^{60}$ and $R^{61}$ each independently represent a hydrogen atom or a monovalent non-metal atomic group, or can form an aliphatic or aromatic ring by bonding to each other.

In Formula (XIII), $R^{66}$ represents an aromatic ring or a hetero ring that may have a substituent, and $A^5$ represents an oxygen atom, a sulfur atom, or —$NR^{67}$—$R^{64}$, $R^{65}$, and $R^{67}$ each independently represent a hydrogen atom or a monovalent non-metal atomic group, and $R^{67}$ and $R^{64}$, and $R^{65}$ and $R^{67}$ can bond to each other to form an aliphatic or an aromatic ring.

Specific examples of the compounds represented with the Formulae (IX) to (XIII) include Exemplary Compounds (A-1) to (A-20) shown as follows.

(A-1)

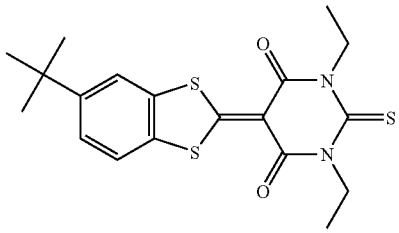

(A-2)

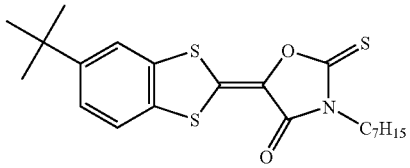

-continued
(A-3)
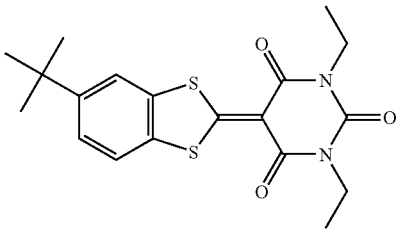
(A-4)
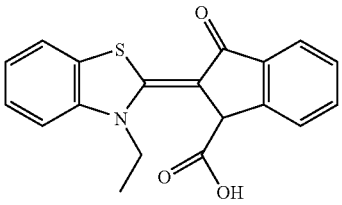
(A-5)
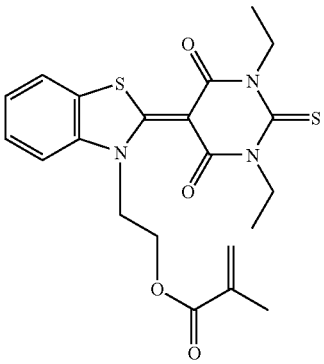
(A-6)
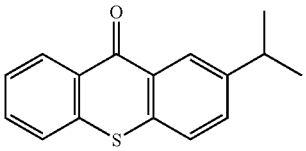
(A-7)
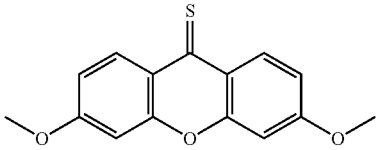
(A-8)
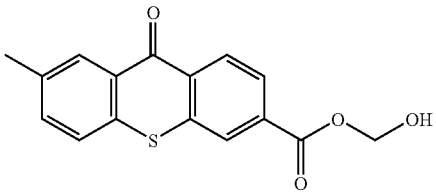
(A-9)
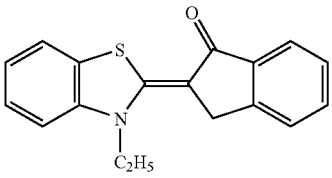
-continued
(A-10)
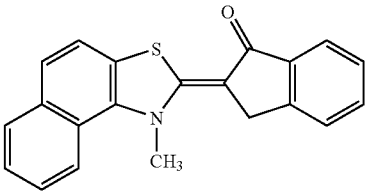
(A-11)
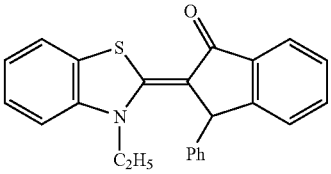
(A-12)
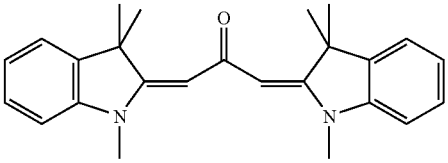
(A-13)
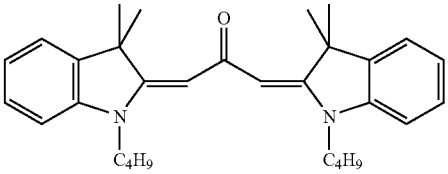
(A-14)
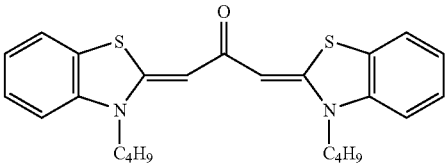
(A-15)
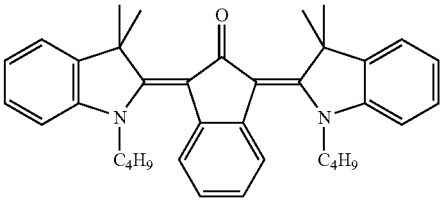
(A-16)
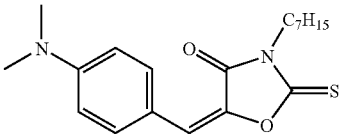
(A-17)
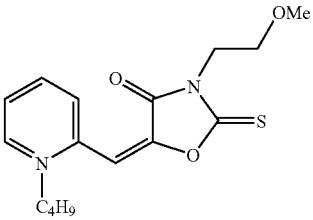

-continued (A-18)

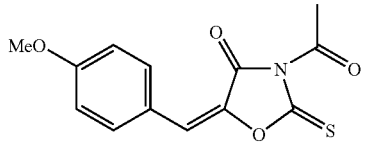

(A-19)

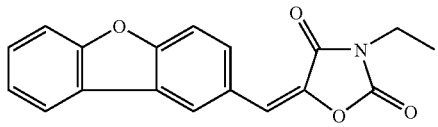

(A-20)

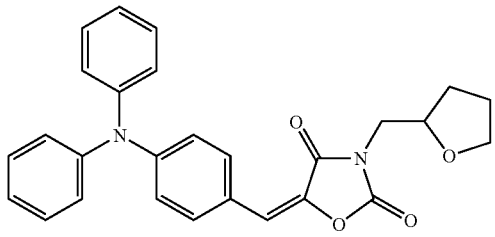

(Cosensitizer)

Known compounds having the capacity to further improve sensitivity or suppress the inhibition of polymerization by oxygen may be added as a cosensitizer.

Examples of the cosensitizers include amines such as the compounds described in M. R. Sander et al., *Journal of Polymer Society*, vol. 10, 3173 (1972), JP-B No. 44-20189, JP-A Nos. 51-82102, 52-134692, 59-138205, 60-84305, 62-18537 and 64-33104, and *Research Disclosure* No. 33825. Specific compounds thereof include triethanolamine, p-dimethylaminobenzenethylester, p-formyldimethyaniline, and p-methylthiodimethylaniline.

Other examples of the cosensitizers include thiols and sulfides such as the thiol compounds described in JP-A No. 53-702, JP-B No. 55-500806, and JP-A No. 5-142772, and the disulfide compounds described in JP-A No. 56-75643. Specific examples thereof include 2-mercaptobenzothiazole, 2-mercaptobenzoxazole, 2-mercaptobenzoimidazole, 2-mercapto-4-(3H)-quinazoline, and β-mercaptonaphthalene.

Other examples of the cosensitizers further include amino acid compounds (for example, N-phenylglycine), the organic metal compounds described in JP-B No. 48-42965 (for example, tributyl tin acetate), the hydrogen donors described in JP-B No. 55-34414, the sulfur compounds described in JP-A No. 6-308727 (for example, trithiane), the phosphor compounds described in JP-A No. 6-250387 (for example, diethylphosphite), and the compounds of Si—H and Ge—H described in JP-A No. 8-65779.

(Coloring Agent)

The ink and the undercoating liquid preferably contain at least one coloring agent, and more preferably a coloring agent is contained at least in the ink. The coloring agent may be included in the undercoating liquid and other liquids other than the ink.

The coloring agent is not particularly limited, and may be appropriately selected from known water-soluble dyes, oil-soluble dyes, and pigments. The ink and the undercoating liquid in the invention are preferably composed as a non-water soluble organic solvent system from the viewpoint of the effect of the invention, and oil-soluble dyes or pigments that readily dissolve and uniformly disperse in a non-water soluble medium are preferably used.

The content of the coloring agent in the ink is preferably from 1 to 30% by mass, more preferably from 1.5 to 25% by mass, and particularly preferably from 2 to 15% by mass. When the undercoating liquid contains a white pigment, the content thereof in the undercoating liquid is preferably from 2 to 45% by mass, and more preferably from 4 to 35% by mass.

Details of the pigments will be explained focusing on the preferable examples thereof in the invention.

(Pigment)

In the invention, it is preferable that a pigment is used as the coloring agent. Either of organic pigments and inorganic pigments can be used as the pigment, but a carbon black pigment can be named as a preferable black pigment. The pigments of black and the three basic colors of cyan, magenta, and yellow are generally used, but pigments having other hues such as red, green, blue, brown and white, metallic-glossy pigments such as gold and silver, and body pigments of colorless or a light color can also be used depending on the purposes.

Examples of the organic pigments are not limited by the hues thereof, and include the pigments of perylene, perynone, quinacridone, quinacridone quinone, anthraquinone, anthoanthrone, benzimidazolone, disazo condensation, disazo, azo, indanthrone, phthalocyanine, triarylcarbonium, dioxadine, aminoanthraquinone, diketopyrrolopyrrole, thio indigo, isoindoline, isoindolinone, pyranthrone and isoviolanthrone, and mixtures thereof.

Further specific examples of the pigments include perylene-based pigments such as C. I. Pigment Red 190 (C. I. No. 71140), C. I. Pigment Red 224 (C. I. No. 71127), and C. I. Pigment Violet 29 (C. I. No. 71129); perynone-based pigments such as C. I. Pigment Orange 43 (C. I. No. 71105) and C. I. Pigment Red 194 (C. I. No. 71100); quinacridone-based pigments such as C. I. Pigment Violet 19 (C. I. No. 73900), C. I. Pigment Violet 42, C.I. Pigment Red 122 (C. I. No. 73915), C. I. Pigment Red 192, C. I. Pigment Red 202 (C. I. No. 73907), C. I. Pigment Red 207 (C. I. No. 73900 and No. 73906), and C. I. Pigment Red 209 (C. I. No. 73905); quinacridone quinone-based pigments such as C. I. Pigment Red 206 (C. I. No. 73900/73920), C. I. Pigment Orange 48 (C. I. No. 73900/73920), and C. I. Pigment Orange 49 (C. I. No. 73900/73920); anthraquinone-based pigments such as C. I. Pigment Yellow 147 (C. I. No. 60645); anthoanthrone-based pigments such as C. I. Pigment Red 168 (C. I. No. 59300); benzimidazolone-based pigments such as C. I. Pigment Brown 25 (C. I. No. 12510), C. I. Pigment Violet 32 (C. I. No. 12517), C. I. Pigment Yellow 180 (C. I. No. 21290), C. I. Pigment Yellow 181 (C. I. No. 11777), C. I. Pigment Orange 62 (C. I. No. 11775), and C. I. Pigment Red 185 (C. I. No. 12516); disazo condensation-based pigments such as C. I. Pigment Yellow 93 (C. I. No. 20710), C. I. Pigment Yellow 94 (C. I. No. 20038), C. I. Pigment Yellow 95 (C. I. No. 20034), C. I. Pigment yellow 128 (C. I. No. 20037), C. I. Pigment Yellow 166 (C. I. No. 20035), C. I. Pigment Orange 34 (C. I. No. 21115), C. I. Pigment Orange 13 (C. I. No. 21110), C. I. Pigment Orange 31 (C. I. No. 20050), C. I. Pigment Red 144 (C. I. No. 20735), C. I. Pigment Red 166 (C. I. No. 20730), C. I. Pigment Red 220 (C. I. No. 20055), C. I. Pigment Red 221 (C. I. No. 20065), C. I. Pigment Red 242 (C. I. No. 20067), C. I. Pigment Red 248, C. I. Pigment Red 262, and C. I. Pigment Brown 23 (C. I. No. 20060);

Disazo-based pigments such as C. I. Pigment Yellow 13 (C. I. No. 21100), C. I. Pigment Yellow 83 (C. I. No. 21108), and C. I. Pigment Yellow 188 (C. I. No. 21094); azo-based pigments such as C. I. Pigment Red 187 (C. I. No. 12486), C. I. Pigment Red 170 (C. I. No. 12475), C. I. Pigment Yellow 74

(C. I. No. 11714), C. I. Pigment Yellow 150 (C. I. No. 48545), C. I. Pigment Red 48 (C. I. No. 15865), C. I. Pigment Red 53 (C. I. No. 15585), C. I. Pigment Orange 64 (C. I. No. 12760), and C. I. Pigment Red 247 (C. I. No. 15915); indanthrone-based pigments such as C. I. Pigment Blue 60 (C. I. No. 69800); phthalocyanine-based pigments such as C. I. Pigment Green 7 (C. I. No. 74260), C. I. Pigment Green 36 (C. I. No. 74265), C. I. Pigment Green 37 (C. I. No. 74255), C. I. Pigment Blue 16 (C. I. No. 74100), C. I. Pigment Blue 75 (C. I. No. 74160: 2), and 15 (C. I. No. 74160); triarylcarbonium-based pigments such as C. I. Pigment Blue 56 (C. I. No. 42800) and C. I. Pigment Blue 61 (C. I. No. 42765:1); dioxadine-based pigments such as C. I. Pigment Violet 23 (C. I. No. 51319) and C. I. Pigment Violet 37 (C. I. No. 51345); aminoanthraquinone-based pigments such as C. I. Pigment Red 177 (C. I. No. 65300); diketopyrrolopyrrole-based pigments such as C. I. Pigment Red 254 (C. I. No. 56110), C. I. Pigment 255 (C. I. No. 561050), C. I. Pigment Red 264, C. I. Pigment Red 272 (C. I. No. 561150), C. I. Pigment Orange 71, and C. I. Pigment Orange 73; thio indigo-based pigments such as C. I. Pigment Red 88 (C. I. No. 73312); isoindoline-based pigments such as C. I. Pigment Yellow 139 (C. I. No. 56298) and C. I. Pigment Orange 66 (C. I. No. 48210); isoindolinone-based pigments such as C. I. Pigment Yellow 109 (C. I. No. 56284) and C. I. Pigment Orange 61 (C. I. No. 11295); pyranthrone-based pigments such as C. I. Pigment Orange 40 (C. I. No. 59700) and C. I. Pigment Red 216 (C. I. No. 59710); and isoviolanthrone-based pigments such as C. I. Pigment Violet 31(60010).

In the invention, two or more kinds of the organic pigments or solid solutions of the organic pigments can be combined and used.

Other materials such as particles composed of a core of silica, alumina, resin or the like having a dye or a pigment fixed on the surface, an insoluble laked compound of a dye, colored emulsion and colored latex can also be used as the pigment. Further, a pigment coated with a resin can be also used, which is called a micro capsule pigment and the products thereof are commercially available from Dainippon Ink and Chemicals, Inc., Toyo Ink MFG Co., Ltd. and the like.

The volume average particle diameter of the pigment particles contained in the liquid is preferably in the range of from 10 to 250 nm, from the viewpoint of the balance between optical concentration and storage stability, and further preferably from 50 to 200 nm. The volume average particle diameter of the pigment particles can be measured with a particle diameter distribution analyzer such as LB-500 (manufactured by HORIBA, Ltd.).

The coloring agents may be used alone or in the form of a mixture of two or more kinds thereof. Further, different coloring agents may be used in different liquid droplets to be ejected and liquids, or the same coloring agent may be used therein.

(Other Components)

Components other than the ones described above such as known additives can also be used as appropriate according to usage.

<Storage Stabilizer>

A storage stabilizer can be added in the ink and the undercoating liquid according to the invention (preferably in the ink) for the purpose of suppressing undesired polymerization during storage. The storage stabilizer is preferably used together with the polymerizable or crosslinkable material, and is preferably soluble in the liquid droplets or liquid or other coexistent components in which the storage stabilizer is contained.

Examples of the storage stabilizers include a quaternary ammonium salt, hydroxylamines, cyclic amides, nitriles, substituted ureas, heterocyclic compounds, organic acids, hydroquinone, hydroquinone monoethers, organic phosphines and copper compounds, and specific examples thereof include benzyltrimethylammonium chloride, diethylhydroxylamine, benzothiazole, 4-amino-2,2,6,6-tetramethylpiperizine, citric acid, hydroquinone monomethylether, hydroquinone monobutylether and copper naphthenate.

The addition amount of the storage stabilizer is preferably adjusted as appropriate according to the activity of the polymerization initiator, polymerization capability of the polymerizable or crosslinkable material, or the type of the storage stabilizer, but is preferably from 0.005 to 1% by mass in terms of the solid content, more preferably from 0.01 to 0.5% by mass, and further preferably 0.01 to 0.2% by mass, in view of the balance between storage stability and curing property <Conductive Salt>

Conductive salts are solid compounds that improve conductivity. In the invention, it is preferable that the conductive salt is not substantially used since there is a large possibility that they deposit at the time of storage, but appropriate amount thereof may be added when the solubility is in good condition by enhancing the solubility of the conductive salt or using a substance having high solubility in the liquid component, and the like.

Examples of the conductive salts include potassium thiocyanate, lithium nitrate, ammonium thiocyanate and dimethylamine hydrochloride.

<Solvent>

Known solvents can be used in the invention, as necessary. The solvent can be used for the purpose of improving the polarity, viscosity or the surface tension of the liquid (ink), improving the solubility or dispersibility of the coloring agent, adjusting the conductivity, or adjusting the printing performance.

The solvent in the invention is preferably a non-water soluble liquid that does not contain an aqueous solvent from the viewpoint of recording a high quality image that dries quickly and is uniform in line width, and is more preferably a solvent composed of a high boiling point organic solvent. The high boiling point organic solvent used in the invention preferably has a good compatibility with the constituent materials, especially with the monomers.

Preferable examples of the solvents include tripropylene glycol monomethylether, dipropylene glycol monomethylether, propylene glycol monomethylether, ethylene glycol monobutylether, diethylene glycol monobutylether, triethylene glycol monobutylether, ethylene glycol monobenzylether and diethylene glycol monobenzylether.

Although there are known low boiling point organic solvents having a boiling point of 100° C. or less, it is preferable to avoid using such solvents in consideration of unfavorable effects on the curing ability and the possibility of causing environmental pollution. In the case of using these solvents, it is preferable to select a solvent with high safety, i.e., a solvent with high control concentration (the index indicated according to the working environment evaluation standard), which is preferably 100 ppm or more and further preferably 200 ppm or more. Examples of such solvents include alcohols, ketones, esters, ethers and hydro carbons, and specifically include methanol, 2-butanol, acetone, methylethylketone, ethyl acetate, tetrahydrofuran.

The solvent can be used alone or in combination of two or more kinds. However, when water and/or a low boiling point organic solvent are used, the total amount thereof in each liquid is preferably from 0 to 20% by mass, more preferably from 0 to 10% by mass, and it is further preferable that they are substantially not contained. It is preferable that the ink and the undercoating liquid in the invention substantially does not contain water from the viewpoint of achieving temporal stability without decreasing the uniformity or increasing the turbidity of the liquid due to precipitation of a dye and the like, with the lapse of time, and from the viewpoint of securing the drying property when an impermeable or slowly-permeable recording medium is used. The term "Substantially does not contain" here means that the admissible level of inevitable impurities may exist.

<Other Additives>

Known additives such as a polymer, a surface tension regulator, an ultraviolet absorber, an antioxidant, an anti-fading agent, and a pH regulator can be used in combination.

Known compounds may be appropriately selected and used as the above additives, and specific examples thereof include the additives described in JP-A 2001-181549.

Further, a pair of compounds that generate an aggregate or increase viscosity when they react with each other upon mixing can be contained separately in the ink and the undercoating liquid in the invention. The above pair of compounds has a characteristic of rapidly forming the aggregate or rapidly increasing viscosity of the liquid, thereby suppressing coalescence of adjacent liquid droplets more effectively.

Examples of the reaction of the above pair of compounds include an acid/base reaction, a hydrogen bonding reaction by a carbonic acid/amide group containing compound, a crosslinking reaction such as a reaction of boronic acid/diol, and a reaction by electrostatic interaction by cation/anion.

The following are the details of the ink jet recording device of the invention.

The ink jet recording device of the invention comprises an undercoating liquid application unit that applies an undercoating liquid containing a monomer represented by the above-described formulae (I) or (II) onto a recording medium; an undercoating liquid curing unit that is provided downstream of the undercoating liquid application unit and that partially cures the undercoating liquid by applying energy onto at least a part of the undercoating liquid; and an image recording unit that is provided downstream of the undercoating liquid curing unit and that records an image by ejecting, onto the partially cured undercoating liquid, an ink that is curable by irradiation with actinic energy rays.

Details of the monomer represented by the above-described formulae (I) or (II) is the same as those discussed above, and the monomer represented by formula (II) is preferably that represented by the above-described formulae (III), (IV) or (V).

The ink jet recording device of the invention may further comprise a conveyance unit that conveys the recording medium and actinic energy irradiation unit that is provided downstream of the image forming unit and that irradiates, with actinic energy rays, the recording medium on which an image is recorded by the image recording unit and further promotes the curing of the ink and the undercoating liquid.

The image recording unit is preferably an image recording unit that ejects the ink from at least one line-formation ink jet head, the head having a length corresponding to at least the entire width of a recordable width of the recording medium and being arranged in a direction substantially perpendicular to a direction in which the recording medium is conveyed.

—Mechanism of Image Recording and Recording Device—

One example of the mechanism of the invention to form an image on a recording medium while avoiding interdroplet interference will be explained by referring to FIGS. 1A to 1D.

The undercoating liquid that does not contain a coloring agent is applied onto a recording medium 16 to form a liquid film 81 consisting of the undercoating liquid on the surface of the recording medium 16, as shown in FIG. 1A. The undercoating liquid is applied by coating in FIG. 1A, but may also be applied by ejection using an ink jet head (also referred to as "ejection"), spray coating or the like.

The thickness of the liquid film of the applied undercoating liquid is determined as an average thickness obtained by dividing the value of the volume of the applied undercoating liquid by the value of the area onto which the undercoating liquid is applied. In the case where the undercoating liquid is applied by ejection, the thickness of the liquid film can be obtained from the value of the ejected volume and the value of the area onto which the undercoating liquid has been ejected. The thickness of the liquid film of the undercoating liquid is desirably uniform with no local unevenness. From this point of view, the undercoating liquid preferably wets the recording medium well and spreads thereon, i.e., has a small degree of static surface tension, as long as the liquid can be ejected stably from the ink jet head.

Figure 1B:
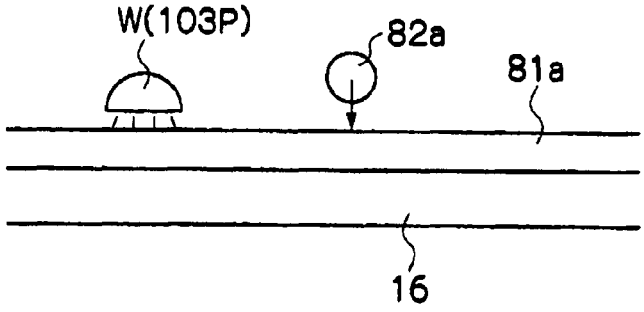
Figure 1C:
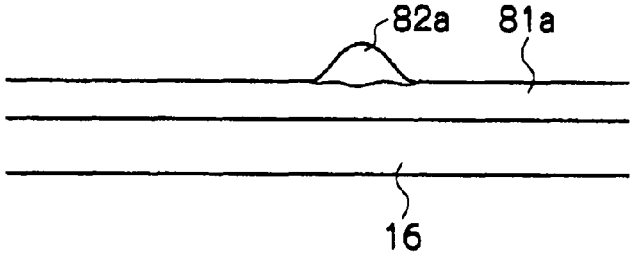

After the undercoating liquid is partially cured by irradiation with active light from a light source W (partially cured undercoating liquid (partially cured undercoating liquid layer); 81*a*), an ink droplet 82*a* is ejected as shown in FIG. 1B, thereby depositing the ink droplet 82*a* onto the undercoating film 81 as shown in FIG. 1C. At this time, the surface of the undercoating layer is partially cured and has good compatibility with the ink droplet 82*a*.

Figure 1D:
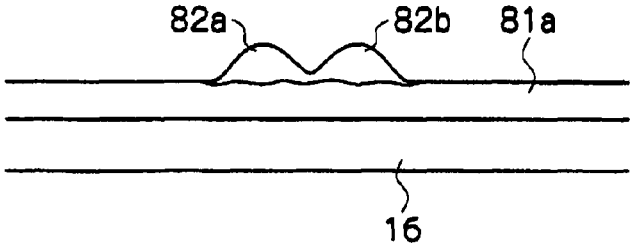

Subsequently, another ink droplet 82*b* is ejected onto the recording medium 16 in the region where the layer of the undercoating liquid 81*a* is formed and near the position where the first liquid droplet 82*a* has been ejected, as shown in FIG. 1D. At this time, the surface of the undercoating layer liquid layer 81 is partially cured and has good compatibility with the ink droplet 82*b*. Although a force works to make the ink droplet 82*a* and the ink droplet 82*b* to coalesce with each other, the interdroplet interference can be suppressed since the adhesion of the ink droplet and the surface of the undercoating layer is strong and the inside of the undercoating layer which has been cured acts as a resistance force against the coalescence between the ink droplets.

A substance that causes a chemical reaction by which a coloring material contained in the ink aggregates or becomes insoluble has conventionally been contained in the undercoating liquid, in order to avoid the interdroplet interference. However, according to the invention, the interdroplet interference can be avoided without containing such a substance in the undercoating liquid.

While the interdroplet interference is avoided and the shapes of the ink droplets of 82*a* and 82*b* are maintained (in the case of the invention, during a period of from a few hundred milliseconds to 5 seconds) as shown in FIG. 1D, i.e., before the shapes of the droplets are lost, the ink droplets 82*a* and 82*b* are cured or partially cured to such a level that the shapes thereof are kept, and the color material in the ink droplets 82*a* and 82*b* are fixed onto the recording medium 16. At least the ink contains an actinic energy ray curing-type polymerizable compound and is cured by a so-called polymerization reaction when irradiated with actinic energy rays such as ultraviolet rays. The polymerization compound can also be contained in the undercoating liquid, which is preferable for promoting adhesion since the whole liquid that has been ejected is cured.

Next, the entire configuration of an inline label printer, an example of the image recording device provided with the ink jet recording device in the invention, will be explained by reference with the figures.

Figure 2:
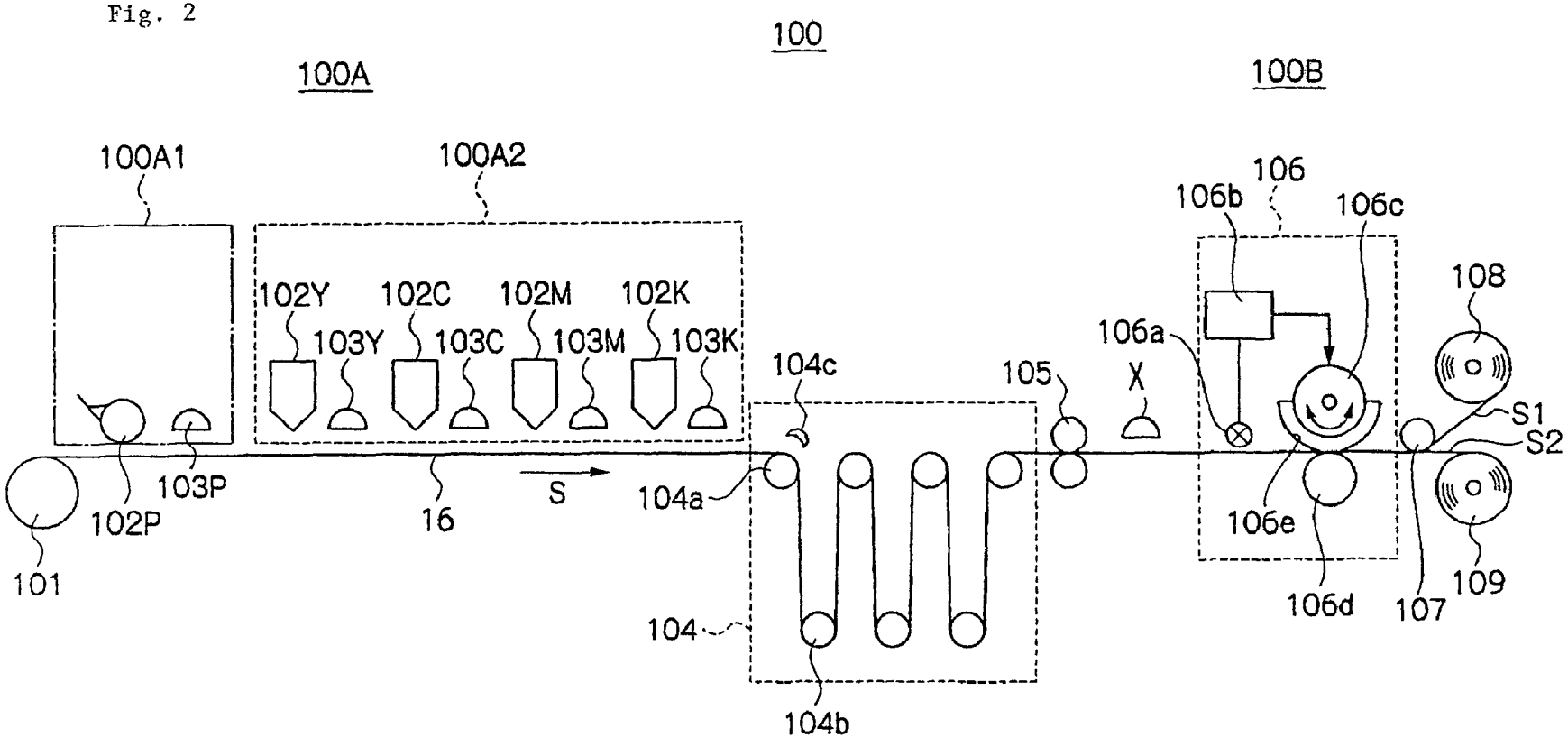
FIG. 2 is a schematic sectional view showing the entire configuration of an image recording device that records an image in accordance with the ink jet recording method of the invention.

FIG. 2 is an entire configuration diagram showing one example of an inline label printer (image recording device) 100. The image recording device 100 consists of an ink jet recording part 100A in the invention, a post-processing part 100B that performs a post-processing to the recording medium that has been recorded an image, and a buffer 104 as a cushioning unit provided between the ink jet recording part 100A and the post-processing part 100B.

The ink jet recording device in the invention is applied to the ink jet recording part 10A. The ink jet recording part 100A consists of an undercoating liquid film forming unit 100A1 that forms a partially cured undercoating liquid film that does not contain a coloring agent on the recording medium (label) 16, and an image forming unit 100A2 that forms a desired image on the recording medium 16 by applying four inks containing a coloring material on the prescribed position of the recording medium 16.

Favorable images can be formed particularly when a recording medium that does not have permeability (for example, OPP (Oriented Polypropylene Film), CPP (Casted Polypropylene Film), PE (Polyethylene), PET (Polyethylene Terephthalate), PP (Polypropylene), a soft wrapping material with low permeability, laminate paper, coated paper and art paper is used as the recording medium.

In FIG. 2, the ink jet recording part 100A is provided with the image forming unit 100A2 where an ink is applied by ink jetting onto the recording medium 16 on which the undercoating liquid has been applied with a roll coater 102P.

The image recording device 100 is provided with a liquid storage/loading unit that is prevented from light-transmittance (not shown) and store the undercoating liquid and the ink to be supplied to the undercoating liquid film forming part 100A1 and the image forming part 100A2; a paper supplying unit 101 that supplies the recording medium 16; an image detecting unit 104*c* that reads an image as the result of ejection of the ink (the state of the deposited ink droplets) by the image forming part 100A2; and a rewinding unit 109 that rewinds the recorded recording medium 16.

The paper supplying unit 101 is described in FIG. 2 as a paper supplying unit that supplies a roll paper (continuous paper), but the unit may be the type that supplies precut sheets of paper.

Further details of the ink jet recording unit 100A will now be explained. The ink jet recording unit 100A has the image forming part 100A2 including ejecting heads 102Y, 102C, 102M, and 102K that eject ink onto the recording medium 16 in a single pass, and the undercoating liquid film forming part 100A1 including the roll coater 102P and a light source for partially curing 103P. Specifically, it is a so-called full line-formation head which is a line-formation head having a length corresponding to the entire width of the recordable area of the recording medium 16, the head being arranged in a direction perpendicular to a direction of conveying the recording medium (shown by an arrow S in FIG. 2). Further, the pinning light sources 103Y, 103C, and 103M may be respectively arranged downstream of the ejecting heads 102Y, 102C and 102M, which cure the dots of ejected ink of each color at least to such a level that the dots do not lose their shape.

The roll coater 102P and the ejecting heads 102Y, 102C, 102M, and 102K having plural nozzles (liquid ejecting ports) are arranged in the length longer than at least one side of the recording medium 16 of the maximum size for which the ink jet recording part 100A is intended.

The ejecting heads 102Y, 102C, 102M, and 102K corresponding to each liquid are arranged in the order of yellow ink (Y), cyan ink (C), magenta ink (M), and black ink (K) from the upstream side (the left side of FIG. 2) along with the direction S of conveying the recording medium, and by which a color image can be formed on the recording medium 16.

Specifically, the undercoating liquid is first uniformly applied onto the recording medium 16 with the roll coater (102P), then partially curing of the undercoating liquid is performed by the ultraviolet light source for partially curing 103P. Next, the ink is ejected from the ejecting head for yellow ink 102Y toward the recording medium 16, where the yellow ink on the recording medium may be partially cured to such a level that the surface thereof is not cured and the shape thereof is kept by the pinning light source 103Y arranged downstream of the ejecting head 102Y Subsequently, the same processes as that of the yellow ink are repeated with the heads 102C and 102M, and after the ejection by the ejecting head for black ink 102K, curing may be completed by the final curing light source 103K capable of completely curing the undercoating liquid and all of the inks. In this process, by partially curing the undercoating liquid and the inks after application, interdroplet interference can be avoided.

According to the image forming part 100A2 consisting of a full line-formation ejecting head, an image can be recorded on the entire surface of the recording medium 16 at one operation of relatively moving the recording medium 16 and the image forming part 100A2 in a direction of conveying the recording medium. Therefore, high-speed printing can be performed as compared with a case of using a shuttle type head in which the ejecting head moves back and forth in a direction perpendicular to the direction of conveying the recording medium while conveying the recording medium, thereby improving the productivity.

In the embodiments, inks of the standard colors YCMK (4 colors) are used, but the number of the colors or the combination thereof is not limited to the examples shown here, and other inks of a light color, dark color, white or other spot colors, or transparent inks may also be used depending on necessity. Examples of the possible constitutions thereof include using an ejecting head that ejects an ink of light colored type such as light cyan and light magenta in combination; delineating the background with a white ink; and adjusting the glossiness with a transparent ink.

UV light source 103P (also including 103Y, 103C, 103M, and 103K in some cases) irradiates ultraviolet rays to the recording medium 16 in order to cure the ink containing a polymerizable compound. Known light sources such as a medium-pressure mercury lamp, a high-pressure mercury lamp, an ultrahigh-pressure mercury lamp, a metal-halide lamp, a xenon lamp, a carbon arc lamp, an ultraviolet fluorescent lamp, an ultraviolet LED, and an ultraviolet LD can be used as the ultraviolet light source. Among these, a high-pressure mercury lamp, an ultrahigh-pressure mercury lamp, and a metal-halide lamp are preferably used from the aspect of practicality. The UV light source preferably has a peak of the amount of light in the wavelength range of from 200 nm to 400 nm, and preferably has an irradiation light intensity in the range of from 1 to 500 $mW/cm^2$ in the wavelength at the peak amount of light. The UV light source is preferably constituted using a cold mirror in a reflector and an infrared cut glass in a cover glass so as to prevent the increase in temperature of the recording medium by the irradiation with heat rays.

An electron beam irradiation device (not shown) may also be used as a means of curing the ink containing a polymerizable compound.

In the above, the use of a UV light source and an electron beam irradiation device is discussed as a means of curing the polymerizable compound, but the means is not limited to thereto, and other radiant rays such as α-rays, γ-rays, and X-rays may also be used.

The image detecting unit 104*c* includes an image sensor (such as a line sensor) to pick up the image of the result of the ejection by the image forming part 100A2, and functions as a means of checking the presence of ejection abnormalities, such as clogging of the nozzles, from the image read by the image sensor.

A buffer 104 is provided as a cushioning unit between the ink jet recording part 100A and the post-processing part 100B. The recording medium that has been subjected to ink jet recording passes through the buffer 104 consisting of several upper rollers 104*a* and several lower rollers 104*b*, while repeating going up and down a few times. The buffer 104 serves as a regulator that absorbs the difference between the operation speeds (the speeds for conveying the recording medium 16) in the ink jet recording part 100A positioned upstream of the buffer and in a later-described post-processing part 100B positioned downstream of the buffer.

In the downstream of the buffer 104 is provided a varnish coater 105. In the varnish coater 105, the surface of a label is slightly coated with a varnish to improve scratch-resistance of the label surface.

A drier X is provided downstream of the varnish coater 105. For example, a UV lamp (same as the final curing light source 103K) can be used for the drier X when a UV varnish is used. A label cutting unit 106 provided downstream of the varnish coater 105 is composed of a marking reader 106*a*, a die cutter driver 106*b*, a dye cutter 106*c* equipped with a roll (a plate) 106*e* having a blade, and a facing roller 106*d*.

A label cut by the die cutter 106*c* in the label cutting unit 106 is wound up by a label winding unit 109 into the form of a product, and other parts are peeled off by a scrap removing unit 108 and disposed as a waste.

*Structure of Ejecting Head

Figure 3A:
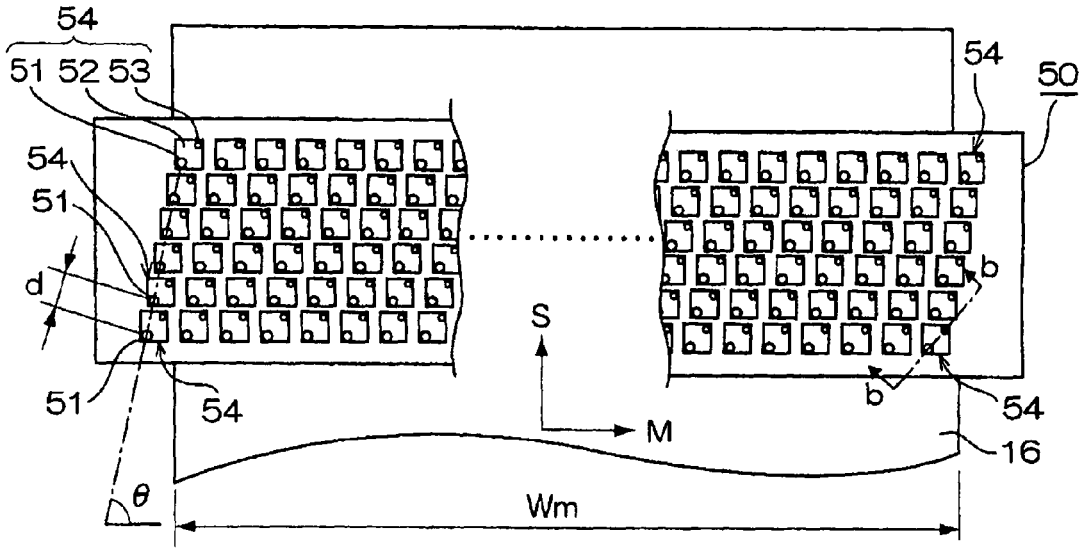
FIG. 3A is a plan view showing an example of a basic entire structure of the ejecting head shown in FIG. 2.

FIG. 3A is a plan perspective view showing an example of the entire basic structure of an ejecting head marked with the number 50 which is representative of the ejecting heads 102Y, 102C, 102M, and 102K.

The ejecting head 50 shown as one example in FIG. 3A is a so-called full line-formation head equipped with a number of nozzles 51 (liquid ejection ports) that eject a liquid toward the recording medium 16 arranged in a two-dimensional manner over the length corresponding to the width Wm of the recording medium 16 in a direction (the main scanning direction indicated by an arrow M) which is perpendicular to a direction of conveying the recording medium 16 (the vertical scanning direction indicated by an arrow S).

In the ejecting head 50, plural pressure chamber units 54 each consisting of a nozzle 51, a pressure chamber 52 communicating to the nozzle 51 and a liquid supplying port 53 are arranged along two directions, i.e., the main scanning direction M and an inclined direction at a prescribed acute angle θ (0 degree <θ<90 degrees) with the main scanning direction M. For illustration purpose, only a part of the pressure chamber unit 54 is shown in FIG. 3A.

The nozzles 51 are arranged at a regular pitch d in the inclined direction at a prescribed acute angle θ with the main scanning direction M, which can be equated to that in which the nozzles are arranged in a straight line along with the main scanning direction M at an interval of "d×cos θ".

Figure 3B:
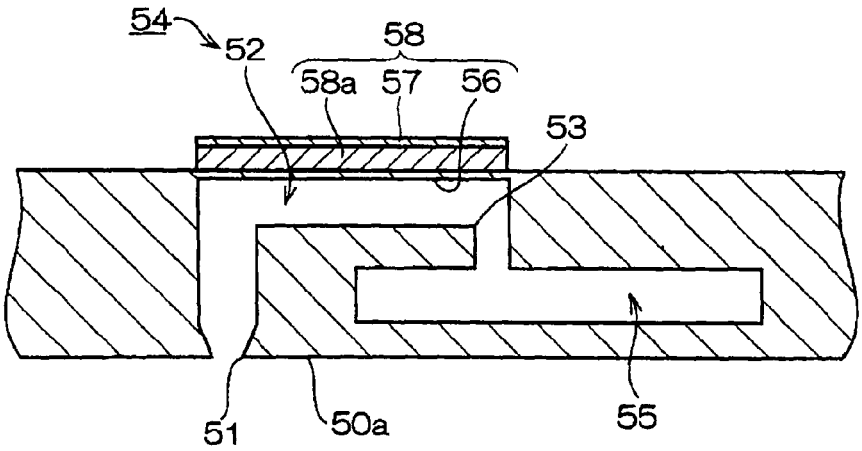
FIG. 3B is a b-b line section of FIG. 3A.

FIG. 3B shows a cross section along the b-b line shown in FIG. 3A of the pressure chamber unit 54 as an ejection element that constitutes the ejection head 50.

Each pressure chamber 52 communicates with a common liquid chamber 55 via the liquid supplying port 53. The common liquid chamber 55 communicates with a tank as a liquid supplying source (not shown), from which the liquid is supplied and distributed to each pressure chamber 52 via the common liquid chamber 55.

A piezoelectric body 58*a* is positioned on a vibrating plate 56 that forms a top face of the pressure chamber 52, and an individual electrode 57 is positioned on the piezoelectric body 58*a*. The vibrating plate 56 is grounded and functions as a common electrode. These vibrating plate 56, individual electrode 57 and piezoelectric body 58*a* constitute a piezoelectric actuator 58 that serves as a means of generating liquid ejection force.

When a prescribed driving voltage is applied to the individual electrode 57 in the piezoelectric actuator 58, the piezoelectric body 58*a* is deformed to change the volume of the pressure chamber 52, resulting in the change in pressure in the pressure chamber 52, and thereby a liquid is ejected from the nozzle 51. When the volume of the pressure chamber 52 returns back to the initial state after the ejection of the liquid, a new liquid is supplied to the pressure chamber 52 from the common liquid chamber 55 via the liquid supplying port 53.

In FIG. 3A, an example is shown in which plural nozzles 51 are arranged in a two-dimensional manner as the structure capable of forming an image with high resolution on the recording medium 16 at high-speed. However, the structure of the ejecting head in the invention is not particularly limited to the above structure and may be a structure in which the nozzles are arranged in a one-dimensional manner. The structure of the pressure chamber unit 54 as an ejection element that constitutes the ejecting head is also not particularly limited to the example shown in FIG. 3B. For example, the common liquid chamber 55 may be positioned above the pressure chamber 52 (i.e., the opposite side of the ejection face 50*a*) instead of positioning the same under the pressure chamber 52 (i.e., the ejection face 50*a* side of the pressure chamber 52). Further, the liquid ejection force may be generated by an exothermic body instead of the piezoelectric body 58*a*.

In the ink jet recording device in the invention, other means such as ejection of the undercoating liquid from nozzles may also be used for the application of the undercoating liquid onto the recording medium, instead of coating.

The device used for the coating is not particularly limited, and known coating devices can be selected as appropriate according to usage. Examples thereof include an air doctor coater, a blade coater, a rod coater, a knife coater, a squeeze coater, an impregnating coater, a reverse roll coater, a transfer roll coater, a gravure coater, a kiss roll coater, a cast coater, a spray coater, a curtain coater, and an extruding coater.

*Liquid Supply System

Figure 4:
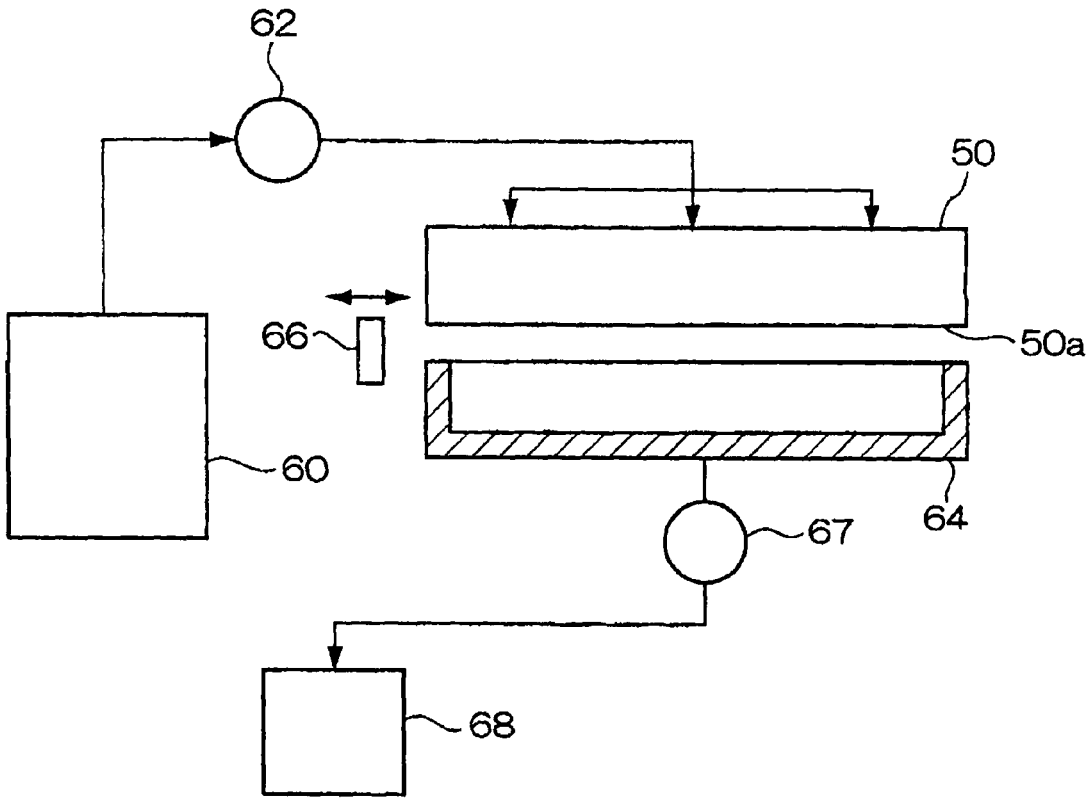
FIG. 4 is a schematic view showing an exemplary configuration of a liquid supplying system that constitutes the image recording device.

FIG. 4 is a schematic view showing a configuration of the liquid supply system in the image recording device 100.

A liquid tank 60 supplies a liquid to the ejecting head 50 as a base tank. In the midstream of a tube that connects the liquid tank 60 and the ejecting head 50, a liquid supplying pump 62 that sends the liquid to the ejecting head 50 is provided. The tube, liquid tank 60 and the ejecting head 50 preferably have a temperature which is regulated together with the ink contained therein, by a temperature detecting means and a heater. The ink temperature is preferably regulated to a range of from 40° C. to 80° C.

The image recording device 100 is provided with a cap 64 as a means for preventing a meniscus of the nozzle 51 from drying during the intermission of ejection, or from increasing in viscosity in the vicinity of the meniscus, and a cleaning blade 66 as a means for cleaning the ejection face 50*a*. A maintenance unit including the cap 64 and the cleaning blade 66 can be transferred relatively to the ejecting head 50 by a transfer system (not shown), and can be transferred to a maintenance position positioned below the ejecting head 50 from a prescribed retracting position as necessary.

The cap 64 is elevated relatively to the ejecting head 50 with an elevation mechanism (not shown). The elevation mechanism is designed to cover at least the region of the nozzle in the ejection face 50*a* with the cap 64, by elevating the cap 64 up to a prescribed position and attaching the cap 64 to the ejecting head 50.

The cap 64 preferably has the inside thereof divided into plural areas each corresponding to each row of the nozzles by dividing walls, and each of the divided areas can be selectively suctioned using a selector or the like.

The cleaning blade is composed of an elastic member such as rubber, and is capable of sliding on the ejection face 50*a* of the ejecting head 50 with a transfer mechanism for the cleaning blade (not shown). When the liquid droplets or foreign materials are attached onto the ejection face 50*a*, the ejection face 50*a* is wiped off by sliding the cleaning blade 66 on the ejection face 50*a* and cleaned.

A suction pump 67 sucks a liquid from the nozzle 51 of the ejecting head 50 while the ejection face 50*a* of the ejecting head 50 is covered with the cap 64, and sends the sucked liquid to a collection tank 68.

The above suction operation is also performed when the liquid tank 60 is loaded in the image recording device 100 and the liquid tank 60 is filled with a liquid from the liquid tank 60 (at the time of the initial filling) or when the liquid having viscosity that has been increased during the long-term cessation is removed (at the time of starting the operation after a long-term intermission).

Note that there are two types of ejections from the nozzle: first, a normal ejection performed onto a recording medium such as paper in order to form an image; and second, a purge performed onto the cap 64 serving as a liquid receiver (also referred to as a blank ejection).

Further, when air bubbles are mixed into the nozzle 51 or the pressure chamber 52 in the ejecting head 50 or increase in the viscosity in the nozzle 51 exceeds a certain level, the liquid cannot be ejected from the nozzle 51 by the above-described blank ejection. In this case, the liquid with the air bubbles or increased viscosity in the pressure chamber 52 in the ejecting head 50 is sucked by the suction pump 67 by applying the cap 64 onto the ejection face 50*a* in the ejecting head 50.

The ejecting head 50, liquid tank 60, liquid supplying pump 62, cap 64, cleaning blade 66, suction pump 67, collection tank 68 and an ink flowing route that connects these units, as well as other members and equipments with which the ink directly contact, preferably have dissolution resistance and swelling resistance. Further, these members and equipments preferably have a light shielding property.

*Control System

Figure 5:
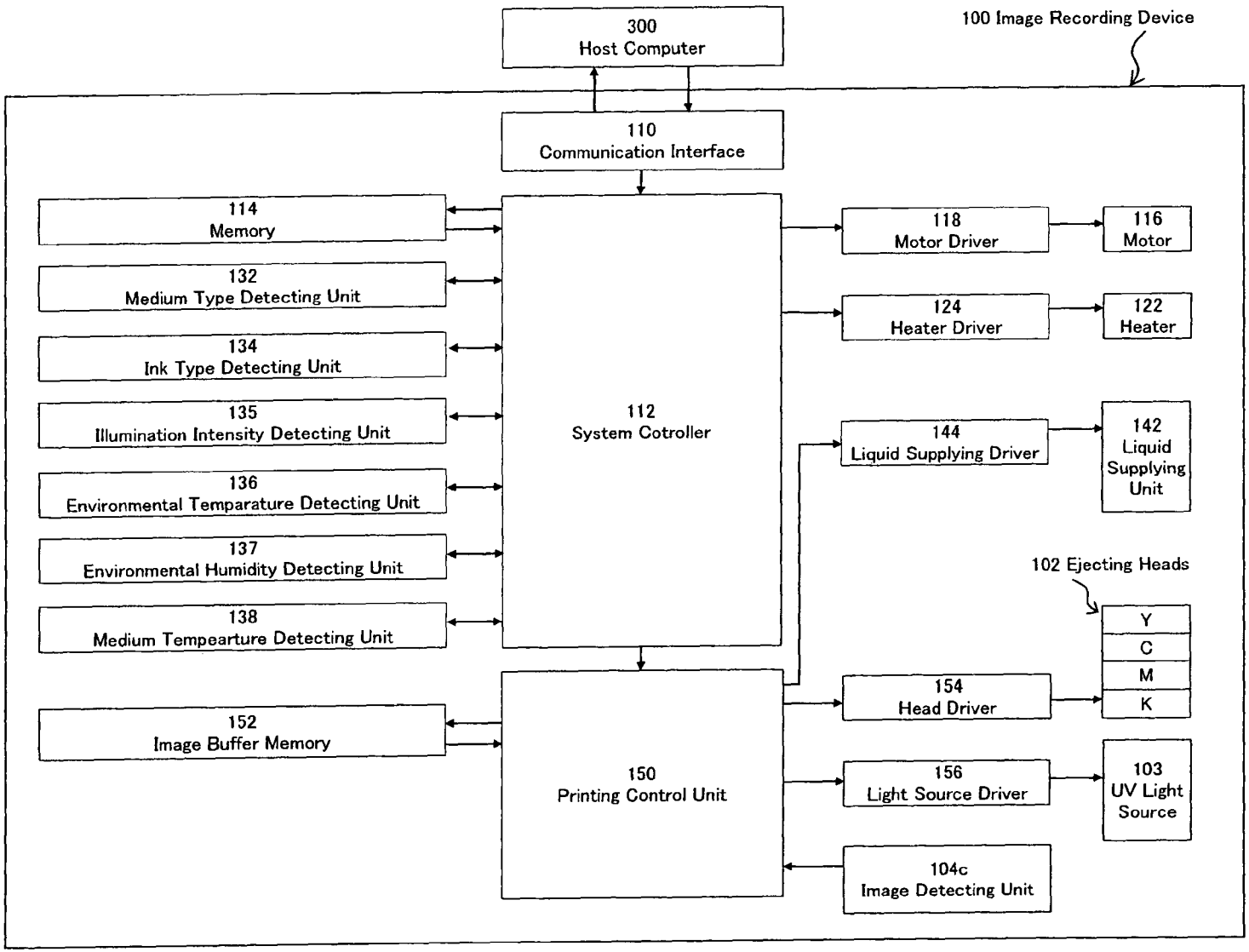
FIG. 5 is a block diagram showing an exemplary configuration of a control system that constitutes the image recording device.

FIG. 5 is a block diagram of the main part showing a system configuration of the image recording device 100.

In FIG. 5, the image recording device 100 is mainly composed of an image forming unit 102, image detecting unit 104*c*, UV light source 103, communication interface 110, system controller 112, memory 114, image buffer memory 152, motor for transportation 116, motor driver 118, heater 122, heater driver 124, medium type detecting unit 132, ink type detecting unit 134, illumination intensity detecting unit 135, environmental temperature detecting unit 136, environmental humidity detecting unit 137, medium temperature detecting unit 138, liquid supplying unit 142, liquid supplying driver 144, printing control unit 150, head driver 154, and a light source driver 156.

Since the image forming unit 102 is shown as a representative of the ejecting heads 102Y, 102C, 102M and 102K shown in FIG. 2, the UV light source is shown as a representative of the curing light sources 103P, 103Y, 103C, 103M and 103K shown in FIG. 2, and the image detecting unit 104*c* is the same as the one described in FIG. 2 which have been mentioned above, further explanations thereof are omitted here.

The communication interface 110 is an image data inputting means that receives the image data sent from a host computer 300. For the communication interface 110, wired interfaces such as USB (Universal Serial Bus) or IEEE1394, or wireless interfaces can be applied. The image data inputted into the image recording device 100 via the communication interface 110 are temporarily memorized in a first memory 114 for memorizing image data.

The system controller 112 is composed of a central processing unit (CPU), its surrounding circuit, and the like, and is a main controlling means of controlling the entire image recording device 100 according to a prescribed program that has been previously memorized in the first memory 114. That is, the system controller 112 controls each unit of the communication interface 110, motor driver 118, heater driver 124, medium type detecting unit 132, ink type detecting unit 134, printing control unit 150 and the like.

The motor for transportation 116 imparts a driving force to rollers, belts or the like that transport a recording medium. By this motor for transportation 116, the ejecting head 50 that constitutes the image forming unit 102 and the recording medium move relatively to each other. The motor driver 118 is a circuit that drives the motor for transportation 116 in accordance with the instructions given from the system controller 112.

The heater 122 is a circuit that drives a heater (or a cooling element) 122 which is not shown in the Figure, and maintains the temperature of the recording medium to be constant. The heater driver 124 is a circuit that drives the heater 122 in accordance with the instructions given from the system controller 112.

The medium type detecting unit 132 detects the type of the recording medium. There are various embodiments of detecting the type of the recording medium, and examples thereof include an embodiment of detecting the type by a sensor provided at a paper supplying unit which is not shown in the Figure; an embodiment of inputting the type by the operation of a user; an embodiment of inputting the type from the host computer 300; and an embodiment in which the type is automatically detected by analyzing the image data (for example, resolution or color) inputted from the host computer 300 or supplemental data of the image data.

The ink type detecting unit 134 detects the type of the ink. There are various embodiments of detecting the type of the ink and examples thereof include an embodiment of detecting by a sensor provided in the liquid storage/loading unit which is not shown in the Figure; an embodiment of inputting the type by the operation of a user; an embodiment of inputting the type from the host computer 300; and an embodiment in which the type is automatically detected by analyzing the image data (for example, resolution or color) inputted from the host computer 300 or supplemental data of the image data.

The illumination intensity detecting unit 135 detects the illumination intensity of the UV rays emitted from the UV light source 103. Examples of the embodiments of detecting the illumination intensity include an embodiment of detecting the illumination intensity by a sensor provided near the UV light source 103 shown in FIG. 2. The feedback of the output of this illumination intensity sensor is sent to the output of the UV light source.

The environmental temperature detecting unit 136 detects the temperatures of the outside air and the inside of the image recording device. Examples of the embodiments of detecting the environmental temperature include an embodiment of detecting the environmental temperature by a sensor provided at the outside or inside of the device.

The environmental humidity detecting unit 137 detects the humidity of the outside air and the inside of the image recording device. Examples of the embodiments of detecting the environmental humidity include an embodiment of detecting the humidity by a sensor provided at the outside or the inside of the device.

The medium temperature detecting unit 138 detects the temperature of the recording medium at the time of forming an image. There are various embodiments of detecting the medium temperature and examples thereof include an embodiment of detecting the temperature by a contact type temperature sensor and an embodiment of detecting the temperature by a non-contact type temperature sensor provided above the recording medium 16. The temperature of the recording medium is maintained to be constant by the heater 122.

The liquid supplying unit 142 is composed of a tube through which the ink flows from the liquid tank 60 shown in FIG. 4 to the image forming unit 102, the liquid supplying pump 62, and the like.

The liquid supplying driver 144 is a circuit that drives the liquid supplying pump that constitutes the liquid supplying unit and the like so that the liquid can be supplied to the image forming unit 102.

The printing control unit 150 produces the data (ejection data) necessary for each ejecting head 50 that constitute the image forming unit 102 to perform ejection (jetting) toward the recording medium based on the image data inputted in the image recording device 100. That is, the printing control unit 150 functions as an image processing means that performs image processing such as various processes, corrections or the like to generate the ejection data from the image data stored in the first memory 114 in accordance with the control of the system controller 112, and supplies the generated ejection data to the head driver 154.

The printing control unit 150 is accompanied with a second memory 152, and the ejection data and the like are temporarily stored in the second memory 152 at the time of performing the image processing in the printing control unit 150.

In FIG. 5, the second memory 152 is shown as an embodiment in which it accompanies the printing control unit 150. However, the first memory 114 can also function as the second memory 152 at the same time. Further, the printing control unit 150 and the system controller 112 can also be integrated and configured with a single processor.

The head driver 154 outputs a driving signal for the ejection to each ejecting head 50 that constitute the image forming unit 12 based on the ejection data given from the printing control unit 150 (practically, it is the ejection data stored in the second memory 152). The driving signal for the ejection outputted from this head driver 154 is given to each ejecting head 50 (specifically, the actuator 58 shown in FIG. 3B), the liquid (liquid droplets) is ejected onto the recording medium from the ejecting head 50.

A light source driver 156 is a circuit that controls the voltage, time and the timing to be inputted in the UV light source 103 based on the instructions given from the printing control unit 150, illumination intensity detected by the illumination intensity detecting unit 135, environmental temperature detected by the environmental temperature detecting unit 136, environmental humidity detected by the environmental humidity detecting unit 137 and the medium temperature detected by the medium temperature detecting unit 138, and drives the UV light source 103.

The following are the exemplary embodiments according to the invention:

1. An ink jet recording method comprising:

applying an undercoating liquid comprising a monomer represented by the following formula (I) or formula (II) onto a recording medium;

partially curing the undercoating liquid that has been applied onto the recording medium; and recording an image by ejecting an ink that is curable by irradiation with actinic energy rays onto the partially cured undercoating liquid, (I)

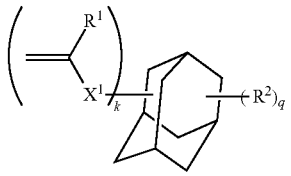

(II)

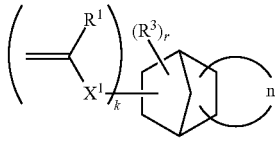

wherein, in formula (I) and formula (II): $R^1$ represents a hydrogen atom, a halogen atom, or an alkyl group having from 1 to 4 carbon atoms; $X^1$ represents a divalent linking group; $R^2$ and $R^3$ each independently represent a substituent; n represents an atom group that is necessary for formation of a cyclic hydrocarbon structure that may contain a carbonyl linkage (—C(O)—) and/or an ester linkage (—C(O)O—) together with a hydrocarbon linkage; k represents an integer of from 1 to 6; q and r each independently represent an integer of from 0 to 5, and wherein k, q and/or r are 2 or more, two or more of $R^1$, $X^1$, $R^2$ and/or $R^3$ may be the same as or different from each other.

2. The ink jet recording method of 1, wherein at least one of the monomers represented by formula (I) or formula (II) is a monofunctional monomer.

3. The ink jet recording method of 1, wherein at least one of the monomer represented by formula (I) or formula (II) is a monofunctional acrylate.

4. The ink jet recording method of 1, the monomer represented by formula (II) is a monomer further represented by any of the following formulae (III), (IV) or (V), (III)

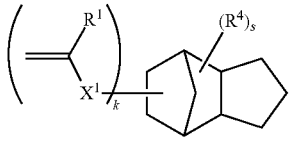

(IV)

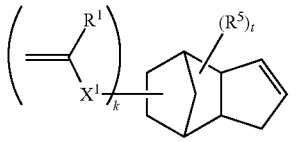

(V)

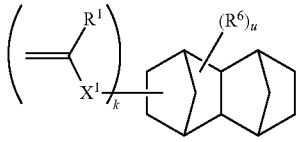

wherein, in formulae (III), (IV) and (V): $R^1$ represents a hydrogen atom, a halogen atom, or an alkyl group having from 1 to 4 carbon atoms; $X^1$ represents a divalent linking group; $R^4$, $R^5$ and $R^6$ each independently represent a substituent; k represents an integer of from 1 to 6; s, t and u each independently represent an integer of from 0 to 5, and wherein k, s, t and/or u are 2 or more, two or more of $R^1$, $X^1$, $R^4$, $R^5$ and/or $R^6$ may be the same as or different from each other.

5. The ink jet recording method of 1, wherein the undercoating liquid is partially cured by irradiation with actinic energy rays.

6. The ink jet recording method of 1, wherein the undercoating liquid further comprises a radical polymerizable compound that is not the monomer represented by formula (I) or formula (II).

7. The ink jet recording method of 1, wherein the image is recorded with a multi-color ink set, and the method further comprises partially curing the ink of at least one color ejected that has been onto the recording medium.

8. The ink jet recording method of 1, further comprising promoting the curing of the undercoating liquid and the ink that that has been ejected.

9. The ink jet recording method of 1, wherein the curing sensitivity of the ink is equal to or higher than the curing sensitivity of the undercoating liquid.

10. The ink jet recording method of 1, wherein the recording medium is non-permeable or slowly permeable.

11. The ink jet recording method of 1, wherein the undercoating liquid is applied by a coater.

12. An ink jet recording device comprising:

an undercoating liquid application unit that applies an undercoating liquid containing a monomer represented by the following formula (I) or formula (II) onto a recording medium;

an undercoating liquid curing unit that is provided downstream in the recording medium moving direction of the undercoating liquid application unit and that partially cures the undercoating liquid by imparting energy to at least a portion of the undercoating liquid; and an image recording unit that is provided downstream in the recording medium moving direction of the undercoating liquid curing unit and that forms an image by ejecting, onto the partially cured undercoating liquid, an ink that is curable by irradiation with actinic energy rays, (I)

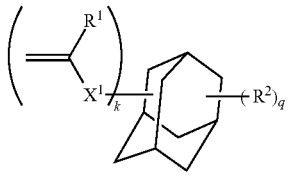

(II)

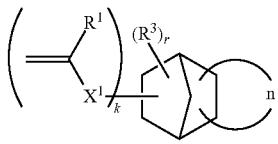

wherein, in formulae (I) and (II): $R^1$ represents a hydrogen atom, a halogen atom, or an alkyl group having carbon atoms of from 1 to 4; $X^1$ represents a divalent linking group; $R^2$ and $R^3$ each independently represent a substituent; n represents an atom group that is necessary for formation of a cyclic hydrocarbon structure that may contain a carbonyl linkage (—C(O)—) and/or an ester linkage (—C(O)O—) together with a hydrocarbon linkage; k represents an integer of from 1 to 6; q and r each independently represent an integer of from 0 to 5, and wherein k, q and/or r are 2 or more, two or more of $R^1$, $X^1$, $R^2$ and/or $R^3$ may be the same as or different from each other.

13. The ink jet recording device of 12, further comprising:

a conveyance unit that conveys the recording medium; and an actinic energy ray irradiation unit that is provided downstream of the image recording unit in a direction in which the recording medium is conveyed, and that irradiates with actinic energy rays the recording medium on which an image has been recorded by the image recording unit and further promotes the curing of the undercoating liquid and the ink that has been ejected; wherein, the image recording unit ejects the ink from at least one full-line ink jet head, the head having a length corresponding to the at least the entire width of a recordable width of the recording medium and being arranged in a direction substantially perpendicular to the direction in which the recording medium is conveyed.

14. The ink jet recording device of 12, wherein at least one of the monomers represented by formula (I) or formula (II) is a monofunctional monomer.

15. The ink jet recording device of 12, wherein at least one of the monomers represented by formula (I) or formula (II) is a monofunctional acrylate.

16. The ink jet recording device of 12, the monomer represented by formula (II) is a monomer further represented by any of the following formulae (III), (IV) or (V), (III)

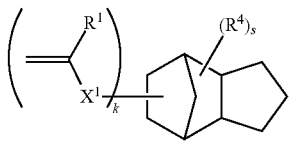

(IV)

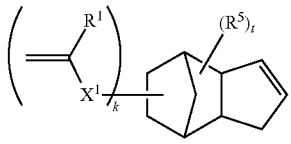

-continued (V)

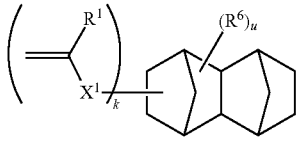

wherein, in formulae (III), (IV) and (V): $R^1$ represents a hydrogen atom, a halogen atom, or an alkyl group having from 1 to 4 carbon atoms; $X^1$ represents a divalent linking group; $R^4$, $R^5$ and $R^6$ each independently represent a substituent; k represents an integer of from 1 to 6; s, t and u each independently represent an integer of from 0 to 5, and wherein k, s, t and/or u are 2 or more, two or more of $R^1$, $X^1$, $R^4$, $R^5$ and/or $R^6$ may be the same as or different from each other.

17. The ink jet recording device of 12, wherein the undercoating liquid is partially cured by irradiation with actinic energy rays.

18. The ink jet recording device of 12, wherein the undercoating liquid further comprises a radical polymerizable compound that is not the monomer represented by formula (I) or formula (II).

19. The ink jet recording device of 12, wherein the curing sensitivity of the ink is equal to or higher than the curing sensitivity of the undercoating liquid.

20. The ink jet recording device of 12, wherein the recording medium is non-permeable or slowly permeable.

EXAMPLES

Further details of the invention will now be explained by reference to Examples. However, the invention is not limited to the following examples as long as its main purport is not exceeded.

Example 1

Preparation of Cyan Pigment Dispersion P-1

PB15:3 (trade name: IRGALITE BLUE GLO, a pigment manufactured by Ciba Specialty Chemicals K.K.) 16 g, dipropylene glycol diacrylate (DPGDA, manufactured by DAICEL-CYTEC Company, Ltd) 48 g, and SOLSPERSE 32000 (a dispersant manufactured by Zeneca) 16 g were mixed with a stirrer for an hour. The resulting mixture was then dispersed with an Eiger mill and a cyan pigment dispersion P-1 was obtained.

The dispersion was conducted under the conditions that the mill was filled with zirconia beads having a diameter of 0.65 mm at a filling rate of 70%, the peripheral velocity was 9 m/s, and the dispersion time was 1 hours.

Preparation of Liquid for Cyan Ink Jet Recording I-1

The following components were mixed by stirring and dissolved, and a liquid for cyan ink jet recording I-1 was prepared. The surface tension at 25° C. of the liquid for cyan ink jet recording I-1 was 27 mN/m, and the viscosity at 25° C. thereof was 15 mPa·s.

—Components—

| | |
|---|---|
| Pigment dispersion P-1 | 2.16 g |
| Dipropylene glycol diacrylate (polymerizable compound, DPGDA; manufactured by DAICEL-CYTEC Company, Ltd) | 9.84 g |
| Irg 907 (a photopolymerization initiator shown below; manufactured by Ciba Specialty Chemicals K.K.) | 1.5 g |
| DAROCURE ITX (a sensitizer shown below; manufactured by Ciba Specialty Chemicals K.K.) | 0.75 g |
| DAROCURE EDB (a sensitizer shown below; manufactured by Ciba Specialty Chemicals K.K.) | 0.75 g |

Irg 907

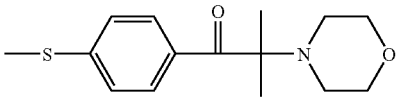

DAROCURE ITX

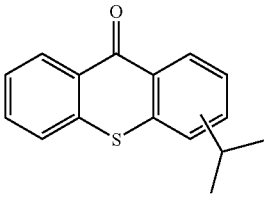

DAROCURE EDB

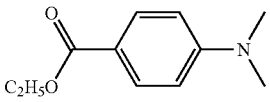

Preparation of Magenta Pigment Dispersion P-2

The magenta pigment dispersion P-2 was prepared in the same manner as that in the preparation of the cyan pigment dispersion P-1, except that a pigment PV 19 (Cinquasia Mazenta RT-355D; a pigment manufactured by Ciba Specialty Chemicals K.K.) and DISPERBYK-168 (a dispersant manufactured by BYK-Chemie Japan K.K.) were used instead of PB15:3 and SOLSPERSE 32000, respectively.

Preparation of Yellow Pigment Dispersion P-3

The yellow pigment dispersion P-3 was prepared in the same manner as that in the preparation of the cyan pigment dispersion P-1, except that a pigment PY 120 (NOVOPERM YELLOW H2G; a pigment manufactured by Clariant Japan K.K.) and DISPERBYK-168 (a dispersant manufactured by BYK-Chemie Japan K.K.) were used instead of PB 15:3 and SOLSPERSE 32000, respectively.

Preparation of Black Pigment Dispersion P-4

The black pigment dispersion P-4 was prepared in the same manner as that in the preparation of the cyan pigment dispersion P-1, except that a carbon black (SPECIAL BLACK 250; manufactured by Degussa Japan Co., Ltd.) and SOLSPERSE 5000 (a dispersant manufactured by Zeneca) were used instead of PB15:3 and SOLSPERSE 32000, respectively.

Preparation of Liquid for Magenta Ink Jet Recording I-2

The following components were mixed by stirring and dissolved, and a liquid for magenta ink jet recording I-2 was prepared. The surface tension at 25° C. of the liquid for magenta ink jet recording I-2 was 27 mN/m, and the viscosity at 25° C. thereof was 16 mPa·s.

—Components—

| | |
|---|---|
| Pigment dispersion P-2 | 5.86 g |
| Dipropylene glycol diacrylate (polymerizable compound, DPGDA; manufactured by DAICEL-CYTEC Company, Ltd) | 6.14 g |
| Irg 907 (a photopolymerization initiator shown below; manufactured by Ciba Specialty Chemicals K.K.) | 1.5 g |
| DAROCURE ITX (a sensitizer shown below; manufactured by Ciba Specialty Chemicals K.K.) | 0.75 g |
| DAROCURE EDB (a sensitizer shown below; manufactured by Ciba Specialty Chemicals K.K.) | 0.75 g |

Preparation of Liquid for Yellow Ink Jet Recording I-3

The following components were mixed by stirring and dissolved, and a liquid for yellow ink jet recording I-3 was prepared. The surface tension at 25° C. of the liquid for yellow ink jet recording I-3 was 27 mN/m, and the viscosity at 25° C. thereof was 16 mPa·s.

—Components—

| | |
|---|---|
| Pigment dispersion P-3 | 4.68 g |
| Dipropylene glycol diacrylate (polymerizable compound, DPGDA; manufactured by DAICEL-CYTEC Company, Ltd) | 7.32 g |
| Irg 907 (a photopolymerization initiator shown below; manufactured by Ciba Specialty Chemicals K.K.) | 1.5 g |

-continued

| | |
|---|---|
| DAROCURE ITX (a sensitizer shown below; manufactured by Ciba Specialty Chemicals K.K.) | 0.75 g |
| DAROCURE EDB (a sensitizer shown below; manufactured by Ciba Specialty Chemicals K.K.) | 0.75 g |

Preparation of Liquid for Black Ink Jet Recording I-4

The following components were mixed by stirring and dissolved, and a liquid for black ink jet recording I-4 was prepared. The surface tension at 25° C. of the liquid for black ink jet recording I-4 was 27 mN/m, and the viscosity at 25° C. thereof was 15 mPa·s.

—Components—

| | |
|---|---|
| Pigment dispersion P-4 | 3.3 g |
| Dipropylene glycol diacrylate (polymerizable compound, DPGDA; manufactured by DAICEL-CYTEC Company, Ltd) | 8.7 g |
| Irg 907 (a photopolymerization initiator shown below; manufactured by Ciba Specialty Chemicals K.K.) | 1.5 g |
| DAROCURE ITX (a sensitizer shown below; manufactured by Ciba Specialty Chemicals K.K.) | 0.75 g |
| DAROCURE EDB (a sensitizer shown below; manufactured by Ciba Specialty Chemicals K.K.) | 0.75 g |

Preparation of Undercoating Liquid II-1

The following components were mixed by stirring and dissolved, and the undercoating liquid II-1 that does not contain a monomer represented by the above described formulae (I) or (II). The surface tension at 25° C. of the undercoating liquid II-1 was 22 mN/m, and the viscosity at 25° C. thereof was 22 mPa·s.

—Components—

| | |
|---|---|
| Dipropylene glycol diacrylate (polymerizable compound, DPGDA; manufactured by DAICEL-CYTEC Company, Ltd) | 11.85 g |
| Irg 907 (a photopolymerization initiator shown below; manufactured by Ciba Specialty Chemicals K.K.) | 1.5 g |
| DAROCURE ITX (a sensitizer shown below; manufactured by Ciba Specialty Chemicals K.K.) | 0.75 g |
| DAROCURE EDB (a sensitizer shown below; manufactured by Ciba Specialty Chemicals K.K.) | 0.75 g |
| BYK-307 (manufactured by BYK-Chemie Japan K.K.) | 0.15 g |

Preparation of Undercoating Liquids II-2 to II-13

The undercoating liquids II-2 to II-13 were prepared in the same manner as in the preparation of the undercoating liquid II-1, except that the monomers of the same amount as the amount of DPGDA used in the undercoating liquid II-1 shown in the following Table 1 were used in place of DPGDA.

TABLE 1

| Undercoating liquid Standard | Monomer |
|---|---|
| II-1 | DPGDA |
| II-2 | FA512A (Exemplary Compound M-11) |
| II-3 | FA511A (Exemplary Compound M-10) |
| II-4 | FA513A (Exemplary Compound M-13) |

TABLE 1-continued

| Undercoating liquid Standard | Monomer |
|---|---|
| II-5 | FA512M (Exemplary Compound M-17) |
| II-6 | FA513M (Exemplary Compound M-19) |
| II-7 | Exemplary Compound M-1 |
| II-8 | IRR214 (Exemplary Compound M-35) |
| II-9 | R-684 (Exemplary Compound M-33) |
| II-10 | Mixture of FA-512A (Exemplary Compound M-11)/ DPGDA (=30/70) |
| II-11 | Mixture of FA-512A (Exemplary Compound M-11)/ DPGDA (=50/50) |
| II-12 | Mixture of FA-512A (Exemplary Compound M-11)/ DPGDA (=70/30) |
| II-13 | Exemplary Compound M-21 |

Notes:
FA511A, FA512A, FA513A, FA512M, FA513M are products of HITACHI CHEMICAL Co., Ltd.; IRR214 is a product of DAICEL-CYTEC Company, Ltd; and R-684 is a product of NIPPON KAYAKU Co., Ltd.

The surface tensions and viscosities of the above undercoating liquids II-2 to II-13 at 25° C. are shown in the following Table 2.

TABLE 2

| Undercoating liquid Standard | Surface tension [mN/m] | Viscosity [mPa · s] |
|---|---|---|
| II-2 | 22 | 19 |
| II-3 | 22 | 14 |
| II-4 | 22 | 13 |
| II-5 | 22 | 20 |
| II-6 | 22 | 14 |
| II-7 | 22 | 32 |
| II-8 | 22 | 165 |
| II-9 | 22 | 180 |
| II-10 | 22 | 14 |
| II-11 | 22 | 16 |
| II-12 | 22 | 17 |
| II-13 | 22 | 45 |

In the Examples, the surface tension was measured by a surface tensiometer (CBVP-Z, manufactured by KYOWA INTERFACE SCIENCE Co., Ltd.) and the viscosity was measured by a portable digital viscometer for laboratory use (VISCOSTICK, manufactured by MARUYASU INDUSTRIES Co., Ltd.)

Image Recording and Evaluation

An experimental apparatus having the following units were prepared for an image recording apparatus: a conveying unit that conveys a recording medium by rotating a driving roll; a roll coater that applied an undercoating liquid on the recording medium; a light source that partially cures the applied undercoating liquid consisting of an array of extra-high voltage mercury lamps arranged in parallel with a direction perpendicular to a direction in which the recording medium is conveyed, i.e., the main scanning direction (in a width direction) upon recording onto the recording medium; an ink jet printing device that records an image mounted with four full-line head sets, wherein each head set consists of two heads (manufactured by TOSHIBA TEC CORPORATION, droplet frequency; 6.2 KHz, number of nozzles; 636, nozzle density; 300 npi (nozzle/inch, hereinafter the same), droplet size; from 6 pL to 42 pl which is changeable in seven levels), and thus the total nozzle density of each head set is 600 npi; and a metal halide lamp that irradiates actinic energy rays to perform further curing of the undercoating liquid and the recorded image.

On a conveyor route for the recording medium, the roll coater and the light source that partially cures the undercoating liquid are arranged in this order from upstream to downstream, as shown in FIG. 2, and the head unit having four heads for yellow, cyan, magenta and black and the extra-high mercury lamps that partially cure the ink are arranged downstream of the light source, wherein each of the light sources is respectively arranged downstream of each head, in such a manner that the recording medium can be conveyed right under the heads. The heads are fixed to the apparatus in the order of yellow, cyan, magenta and black, from upstream of the direction in which a recording medium is conveyed. Further, the metal halide lamp is provided downstream of the head for black.

In the Examples, the experimental apparatus was charged with the undercoating liquid II-1 and the ink jet recording liquids I-1 to I-4 of four colors in the ink jet printing part thereof, then an image of 600 dpi×600 dpi was recorded onto the recording medium in accordance with the method as described below.

First, the undercoating liquid was uniformly applied to a thickness of 5 μm by a roll coater (application rate; 400 mm/s). After the application of the undercoating liquid, exposure was performed with the light source for partially curing of the undercoating liquid (light intensity; 500 mW/cm$^2$), then the applied undercoating liquid was partially cured.

At this time, the viscosity at 25° C. of the scraped undercoating liquid measured by the aforementioned digital viscometer was 1000 mPa·s.

A transferring test was conducted using a plain paper sheet as a permeable medium (copy paper C2, product code; V436, manufactured by FUJI XEROX CO., LTD.). The paper sheet was pressed against a partially cured undercoating liquid or colored liquid on a sample recording medium with uniform force (500 mN/cm$^2$) and left for about a minute. Thereafter, the paper sheet was gently peeled off and measured the weight thereof to calculate the amount of uncured liquid.

Subsequently, the ink jet recording liquids I-1 to I-4 were respectively ejected onto the recording medium on which the undercoating liquid has been applied, by the heads charged with the above ink jet recording liquids (here, irradiation for partially curing of the ink by the extra-high voltage mercury lamps provided together was not performed), and the liquids were cured by irradiating ultraviolet rays having a wavelength of 365 nm at a light intensity of 300 mW/cm$^2$ with the metal halide lamp.

In this way, mono-color images were printed in the form of a line of 600 dpi in a main scanning direction and 150 dpi in a sub-scanning direction (one drop is used, drop size; 6 pL), and in the form of a checkered pattern of 2 cm square of 150 dpi in a main scanning direction and 150 dpi in a sub-scanning direction (two drops are used, drop size; 12 pL), by ejecting the ink jet recording liquids I-1 to I-4, respectively.

Further, images of multi-color checkered pattern were formed in the same manner as the above (except that one drop is used, drop size; 6 pL) by superimposing all colors.

The amounts of the uncured liquid were in the range of from 0.10 mg/cm$^2$ to 0.12 mg/cm$^2$ when the drop size for image formation was 12 pL. In the Examples, the largest masses per area of the ejected ink (m) were in the range of from 0.74 mg/cm$^2$ to 0.87 mg/cm$^2$ when the images were recorded at 600 dpi×600 dpi and 12 pL.

Accordingly, the mass per area of the uncured part of the undercoating liquid "M (undercoating liquid)" and the largest mass per area of the ejected color liquid "m (recording liquid)" satisfied a relation "m (recording liquid)/10<M (undercoating liquid)<m (recording liquid)/5".

Further, full-color images of a woman were printed by ejecting all of the ink jet recording liquids I-1 to I-4 using the head charged with these recording liquids under the condition of 600 dpi in a main scanning direction and 600 dpi in a sub-scanning direction, after applying and partially curing the undercoating liquid (conveying rate of the recording medium; 400 mm/s, printed with three tones of from 6 to 12 pL, an anti-aliasing process was performed). Thereafter, irradiation with ultraviolet rays (wavelength; 365 nm) was performed at a light intensity of 3000 mW/cm$^2$ by the metal halide lamp to fix the image.

In the above process, the interval between the completion of partially curing of the undercoating liquid and the ejection of the first color liquid (yellow ink jet recording liquid I-3) was set to be 0.2 second.

A recording sheet LINTEC YUPO 80 (manufactured by Lintec Corporation) was used as the recording medium.

After recording images using the undercoating liquid II-1, the same processes were performed by using the above-mentioned undercoating liquids II-2 to II-13 in place of the undercoating liquid II-1.

The largest mass per area of the ejected ink (m) was from 0.74 mg/cm$^2$ to 0.87 mg/cm$^2$ when the image was recorded at 600 dpi×600 dpi and a drop size of 12 pL.

Further, the uncured portions of the liquids of yellow, cyan and magenta after respective pinning exposures were sampled and the amounts thereof were measured by a transferring test. The amounts of the uncured portions of the above liquids were from 0.10 mg/cm$^2$ to 0.12 mg/cm$^2$, respectively, when a drop size for image formation was 12 pL.

Accordingly, in a case of using the liquids of different colors in combination, the mass per area of the uncured liquid A to be applied first "M (liquid A)" and the largest mass per area of the liquid B to be applied subsequent to the liquid A "m (liquid B)" satisfied a relation "m (liquid B)/10<M (liquid A)<m (liquid B)/5".

Measurement and evaluation of the obtained images were performed as below. The results are shown in Tables 3 to 7.

1. Evaluation of Line Width

The line width of the image in the form of a line was measured by a dot analyzer (DA6000, manufactured by OJI SCIENTIFIC INSTRUMENTS).

2. Evaluation of Mono- and Multi-colored Checkered Pattern

The areas onto which the ink has been ejected in the checkered pattern were observed by a microscope and the ratio of a dot diameter at the center and a dot diameter at the periphery of the ejected area (dot diameter at the periphery Dp/dot diameter at the center Dc) was calculated. When the value of the ratio Dp/Dc is closer to 1, which indicates that the dot shape at the periphery remains closer to the same level as that at the center with no local increase in density at the edge of the pattern, the image quality are rated higher.

3. Evaluation of Practical Image

The full-color images of a woman were evaluated by visual observation in accordance with the following criteria:

A: A favorable image with sufficient density and sharpness was obtained.

B: The outline of the hair of the woman slightly blurred, but the image was relatively clear and was considered to have no practical problem.

C: The part of the hair with a color gradation appeared outlined on the edge.

D: The image appeared indistinct.

TABLE 3

<Cyan Ink>

| Undercoating liquid Standard | Partial curing | Line width | Dp/Dc | Notes |
|---|---|---|---|---|
| II-1 | Performed | 50 μm | 2.5 | Comp. Example |
| II-2 | Performed | 50 μm | 1.0 | The invention |
| II-3 | Performed | 50 μm | 1.0 | The invention |
| II-4 | Performed | 50 μm | 1.0 | The invention |
| II-5 | Performed | 50 μm | 1.2 | The invention |
| II-6 | Performed | 50 μm | 1.2 | The invention |
| II-7 | Performed | 50 μm | 1.3 | The invention |
| II-8 | Performed | 50 μm | 1.5 | The invention |
| II-9 | Performed | 50 μm | 1.5 | The invention |
| II-10 | Performed | 50 μm | 1.5 | The invention |
| II-11 | Performed | 50 μm | 1.1 | The invention |
| II-12 | Performed | 50 μm | 1.0 | The invention |
| II-13 | Performed | 50 μm | 1.5 | The invention |
| II-1 | Not performed | 50 μm | 3.5 | Comp. Example |
| II-2 | Not performed | 50 μm | 3.5 | Comp. Example |
| II-3 | Not performed | 50 μm | 3.5 | Comp. Example |
| II-4 | Not performed | 50 μm | 3.5 | Comp. Example |
| II-5 | Not performed | 50 μm | 3.5 | Comp. Example |
| II-6 | Not performed | 50 μm | 3.5 | Comp. Example |
| II-7 | Not performed | 50 μm | 3.5 | Comp. Example |
| II-8 | Not performed | 50 μm | 3.5 | Comp. Example |
| II-9 | Not performed | 50 μm | 3.5 | Comp. Example |
| II-10 | Not performed | 50 μm | 3.5 | Comp. Example |
| II-11 | Not performed | 50 μm | 3.5 | Comp. Example |
| II-12 | Not performed | 50 μm | 3.5 | Comp. Example |
| II-13 | Not performed | 50 μm | 3.5 | Comp. Example |

TABLE 4

<Magenta Ink>

| Undercoating liquid Standard | Partial curing | Line width | Dp/Dc | Notes |
|---|---|---|---|---|
| II-1 | Performed | 50 μm | 2.5 | Comp. Example |
| II-2 | Performed | 50 μm | 1.0 | The invention |
| II-3 | Performed | 50 μm | 1.0 | The invention |
| II-4 | Performed | 50 μm | 1.0 | The invention |
| II-5 | Performed | 50 μm | 1.2 | The invention |
| II-6 | Performed | 50 μm | 1.2 | The invention |
| II-7 | Performed | 50 μm | 1.3 | The invention |
| II-8 | Performed | 50 μm | 1.5 | The invention |
| II-9 | Performed | 50 μm | 1.5 | The invention |
| II-10 | Performed | 50 μm | 1.5 | The invention |
| II-11 | Performed | 50 μm | 1.1 | The invention |
| II-12 | Performed | 50 μm | 1.0 | The invention |
| II-13 | Performed | 50 μm | 1.5 | The invention |
| II-1 | Not performed | 50 μm | 3.5 | Comp. Example |
| II-2 | Not performed | 50 μm | 3.5 | Comp. Example |
| II-3 | Not performed | 50 μm | 3.5 | Comp. Example |
| II-4 | Not performed | 50 μm | 3.5 | Comp. Example |
| II-5 | Not performed | 50 μm | 3.5 | Comp. Example |
| II-6 | Not performed | 50 μm | 3.5 | Comp. Example |
| II-7 | Not performed | 50 μm | 3.5 | Comp. Example |
| II-8 | Not performed | 50 μm | 3.5 | Comp. Example |
| II-9 | Not performed | 50 μm | 3.5 | Comp. Example |
| II-10 | Not performed | 50 μm | 3.5 | Comp. Example |
| II-11 | Not performed | 50 μm | 3.5 | Comp. Example |
| II-12 | Not performed | 50 μm | 3.5 | Comp. Example |
| II-13 | Not performed | 50 μm | 3.5 | Comp. Example |

TABLE 5

| <Yellow Ink> | | | | |
|---|---|---|---|---|
| Undercoating liquid Standard | Partial curing | Line width | Dp/Dc | Notes |
| II-1 | Performed | 50 μm | 2.5 | Comp. Example |
| II-2 | Performed | 50 μm | 1.0 | The invention |
| II-3 | Performed | 50 μm | 1.0 | The invention |
| II-4 | Performed | 50 μm | 1.0 | The invention |
| II-5 | Performed | 50 μm | 1.2 | The invention |
| II-6 | Performed | 50 μm | 1.2 | The invention |
| II-7 | Performed | 50 μm | 1.3 | The invention |
| II-8 | Performed | 50 μm | 1.5 | The invention |
| II-9 | Performed | 50 μm | 1.5 | The invention |
| II-10 | Performed | 50 μm | 1.5 | The invention |
| II-11 | Performed | 50 μm | 1.1 | The invention |
| II-12 | Performed | 50 μm | 1.0 | The invention |
| II-13 | Performed | 50 μm | 1.5 | The invention |
| II-1 | Not performed | 50 μm | 3.5 | Comp. Example |
| II-2 | Not performed | 50 μm | 3.5 | Comp. Example |
| II-3 | Not performed | 50 μm | 3.5 | Comp. Example |
| II-4 | Not performed | 50 μm | 3.5 | Comp. Example |
| II-5 | Not performed | 50 μm | 3.5 | Comp. Example |
| II-6 | Not performed | 50 μm | 3.5 | Comp. Example |
| II-7 | Not performed | 50 μm | 3.5 | Comp. Example |
| II-8 | Not performed | 50 μm | 3.5 | Comp. Example |
| II-9 | Not performed | 50 μm | 3.5 | Comp. Example |
| II-10 | Not performed | 50 μm | 3.5 | Comp. Example |
| II-11 | Not performed | 50 μm | 3.5 | Comp. Example |
| II-12 | Not performed | 50 μm | 3.5 | Comp. Example |
| II-13 | Not performed | 50 μm | 3.5 | Comp. Example |

TABLE 6

| <Black Ink> | | | | |
|---|---|---|---|---|
| Undercoating liquid Standard | Partial curing | Line width | Dp/Dc | Notes |
| II-1 | Performed | 50 μm | 2.5 | Comp. Example |
| II-2 | Performed | 50 μm | 1.0 | The invention |
| II-3 | Performed | 50 μm | 1.0 | The invention |
| II-4 | Performed | 50 μm | 1.0 | The invention |
| II-5 | Performed | 50 μm | 1.2 | The invention |
| II-6 | Performed | 50 μm | 1.2 | The invention |
| II-7 | Performed | 50 μm | 1.3 | The invention |
| II-8 | Performed | 50 μm | 1.5 | The invention |
| II-9 | Performed | 50 μm | 1.5 | The invention |
| II-10 | Performed | 50 μm | 1.5 | The invention |
| II-11 | Performed | 50 μm | 1.1 | The invention |
| II-12 | Performed | 50 μm | 1.0 | The invention |
| II-13 | Performed | 50 μm | 1.5 | The invention |
| II-1 | Not performed | 50 μm | 3.5 | Comp. Example |
| II-2 | Not performed | 50 μm | 3.5 | Comp. Example |
| II-3 | Not performed | 50 μm | 3.5 | Comp. Example |
| II-4 | Not performed | 50 μm | 3.5 | Comp. Example |
| II-5 | Not performed | 50 μm | 3.5 | Comp. Example |
| II-6 | Not performed | 50 μm | 3.5 | Comp. Example |
| II-7 | Not performed | 50 μm | 3.5 | Comp. Example |
| II-8 | Not performed | 50 μm | 3.5 | Comp. Example |
| II-9 | Not performed | 50 μm | 3.5 | Comp. Example |
| II-10 | Not performed | 50 μm | 3.5 | Comp. Example |
| II-11 | Not performed | 50 μm | 3.5 | Comp. Example |
| II-12 | Not performed | 50 μm | 3.5 | Comp. Example |
| II-13 | Not performed | 50 μm | 3.5 | Comp. Example |

TABLE 7

| <Practical Image> | | | | |
|---|---|---|---|---|
| Under-coating liquid Standard | Partial curing | Multi-color Checkered Pattern Dp/Dc | Practical Image | Notes |
| II-1 | Performed | 3.2 | D | Comp. Example |
| II-2 | Performed | 1.0 | A | The invention |
| II-3 | Performed | 1.0 | A | The invention |
| II-4 | Performed | 1.0 | A | The invention |
| II-5 | Performed | 1.2 | A | The invention |
| II-6 | Performed | 1.2 | A | The invention |
| II-7 | Performed | 1.3 | A | The invention |
| II-8 | Performed | 1.5 | B | The invention |
| II-9 | Performed | 1.5 | B | The invention |
| II-10 | Performed | 1.5 | B | The invention |
| II-11 | Performed | 1.1 | A | The invention |
| II-12 | Performed | 1.0 | A | The invention |
| II-13 | Performed | 1.5 | B | The invention |
| II-1 | Not performed | 4.3 | D | Comp. Example |
| II-2 | Not performed | 4.3 | D | Comp. Example |
| II-3 | Not performed | 4.3 | D | Comp. Example |
| II-4 | Not performed | 4.3 | D | Comp. Example |
| II-5 | Not performed | 4.3 | D | Comp. Example |
| II-6 | Not performed | 4.3 | D | Comp. Example |
| II-7 | Not performed | 4.3 | D | Comp. Example |
| II-8 | Not performed | 4.3 | D | Comp. Example |
| II-9 | Not performed | 4.3 | D | Comp. Example |
| II-10 | Not performed | 4.3 | D | Comp. Example |
| II-11 | Not performed | 4.3 | D | Comp. Example |
| II-12 | Not performed | 4.3 | D | Comp. Example |
| II-13 | Not performed | 4.3 | D | Comp. Example |

From the results shown in Tables 3 to 7, it can be concluded that in the Examples in which a monomer represented by the aforementioned formulae (I) or (II) was used and partial curing was performed, the dot shape was maintained, even at the border between the region where the ink was ejected and the region where the ink was not ejected, to the same level as the dot shape at the center of the ejected region, as well as maintaining fine-line reproducibility.

On the other hand, in the comparative examples in which the above specified monomer was not used or partial curing was not performed, uniformity of the dot shape failed to be maintained depending on whether the ink was ejected or how the ejection conditions were, which caused image bleeding or change in density along the outline, thereby failing to obtain clear, high-quality images.

In the above Examples, some of the monomers represented by the aforementioned formulae (I) or (II) were selected and used. However, similar effects can also be obtained when other monomers represented by the formulae (I) or (II) having an adamantane or norbornene skeleton.

All publications, patent applications, and technical standards mentioned in this specification are herein incorporated by reference to the same extent as if each individual publication, patent application, or technical standard was specifically and individually indicated to be incorporated by reference.

What is claimed is:

1. An ink jet recording method comprising:

applying an undercoating liquid comprising a monomer represented by the following formula (I) or formula (II) onto a recording medium;

partially curing the undercoating liquid that has been applied onto the recording medium; and recording an image by ejecting an ink that is curable by irradiation with actinic energy rays onto the partially cured undercoating liquid, wherein the image is recorded with a multi-color ink set, and the method further comprises partially curing the ink of at least one color ejected onto the recording medium, and promoting the curing of the undercoating liquid and the ink that has been ejected, (I)

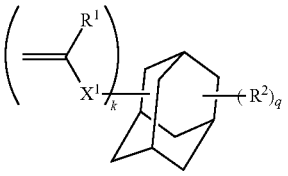

(II)

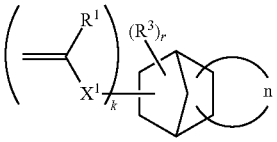

wherein, in formula (I) and formula (II): $R^1$ represents a hydrogen atom, a halogen atom, or an alkyl group having from 1 to 4 carbon atoms; $X^1$ represents a divalent linking group; a vinyl part including $R^1$ and $X^1$ may link at any position on the alicyclic hydrocarbon structure; $R^2$ and $R^3$ each independently represent a substituent that may link at any position on the alicyclic hydrocarbon structure; n represents an atom group that is necessary for formation of a cyclic hydrocarbon structure that may contain a carbonyl linkage (—C(O)—) and/or an ester linkage (—C(O)O—) together with a hydrocarbon linkage; k represents an integer of from 1 to 6; q and r each independently represent an integer of from 0 to 5, when k is 2 or more, two or more of $R^1$ may be the same as or different from each other and two or more of $X^1$ may be the same as or different from each other, when q is 2 or more, two or more of $R^2$ may be the same as or different from each other, and when r is 2 or more, two or more of $R^3$ may be the same as or different from each other.

2. The ink jet recording method of claim 1, wherein at least one of the monomers represented by formula (I) or formula (II) is a monofunctional monomer.

3. The ink jet recording method of claim 1, wherein at least one of the monomer represented by formula (I) or formula (II) is a monofunctional acrylate.

4. The ink jet recording method of claim 1, the monomer represented by formula (II) is a monomer further represented by any of the following formulae (III), (IV) or (V), (III)

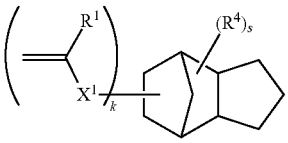

(IV)

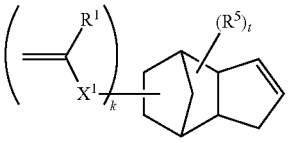

-continued (V)

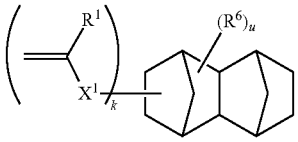

wherein, in formulae (III), (IV) and (V): $R^1$ represents a hydrogen atom, a halogen atom, or an alkyl group having from 1 to 4 carbon atoms; $X^1$ represents a divalent linking group; $R^4$, $R^5$ and $R^6$ each independently represent a substituent which may link at any position in the alicyclic hydrocarbon structures of formulae (III) to (V); k represents an integer of from 1 to 6; s, t and u each independently represent an integer of from 0 to 5, and when k is 2 or more, two or more of $R^1$ may be the same as or different from each other and two or more of $X^1$ may be the same as or different from each other, when s is 2 or more, two or more of $R^4$ may be the same as or different from each other, when t is 2 or more, two or more of $R^5$ may be the same as or different from each other, and when u is 2 or more, two or more of $R^6$ may be the same as or different from each other.

5. The ink jet recording method of claim 1, wherein the undercoating liquid is partially cured by irradiation with actinic energy rays.

6. The ink jet recording method of claim 1, wherein the undercoating liquid further comprises a radical polymerizable compound that is not the monomer represented by formula (I) or formula (II).

7. The ink jet recording method of claim 1, wherein the curing sensitivity of the ink is equal to or higher than the curing sensitivity of the undercoating liquid.

8. The ink jet recording method of claim 1, wherein the recording medium is non-permeable or slowly permeable.

9. The ink jet recording method of claim 1, wherein the undercoating liquid is applied by a coater.

10. The ink jet recording method of claim 1, wherein the content of the monomer represented by the formula (I) or the formula (II) in the undercoating liquid is 50% by mass or more with respect to the total mass of the undercoating liquid.

11. An ink jet recording device comprising:

an undercoating liquid application unit that applies an undercoating liquid containing a monomer represented by the following formula (I) or formula (II) onto a recording medium;

an undercoating liquid curing unit that is provided downstream in the recording medium moving direction of the undercoating liquid application unit and that partially cures the undercoating liquid by imparting energy to at least a portion of the undercoating liquid; and an image recording unit that is provided downstream in the recording medium moving direction of the undercoating liquid curing unit and that forms an image by ejecting, onto the partially cured undercoating liquid, an ink that is curable by irradiation with actinic energy rays, (I)

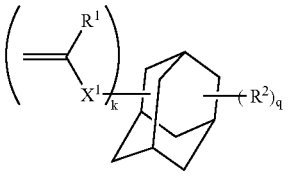

(II)

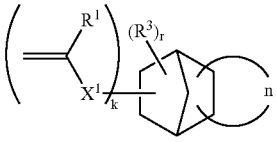

wherein, in formula (I) and formula (II): $R^1$ represents a hydrogen atom, a halogen atom, or an alkyl group having carbon atoms of from 1 to 4; $X^1$ represents a divalent linking group; the vinyl part including $R^1$ and $X^1$ may link at any position on the alicyclic hydrocarbon structure; $R^2$ and $R^3$ each independently represent a substituent that may link at any position on the alicyclic hydrocarbon structure; n represents an atom group that is necessary for formation of a cyclic hydrocarbon structure that may contain a carbonyl linkage (—C(O)—) and/or an ester linkage (—C(O)O—) together with a hydrocarbon linkage; k represents an integer of from 1 to 6; q and r each independently represent an integer of from 0 to 5, when k is 2 or more, two or more of $R^1$ may be the same as or different from each other and two or more of $X^1$ may be the same as or different from each other, when q is 2 or more, two or more of $R^2$ may be the same as or different from each other, and when r is 2 or more, two or more of $R^3$ may be the same as or different from each other.

12. The ink jet recording device of claim 11, further comprising:

a conveyance unit that conveys the recording medium; and an actinic energy ray irradiation unit that is provided downstream of the image recording unit in a direction in which the recording medium is conveyed, and that irradiates with actinic energy rays the recording medium on which an image has been recorded by the image recording unit and further promotes the curing of the undercoating liquid and the ink that has been ejected; wherein, the image recording unit ejects the ink from at least one full-line ink jet head, the head having a length corresponding to the at least the entire width of a recordable width of the recording medium and being arranged in a direction substantially perpendicular to the direction in which the recording medium is conveyed.

13. The ink jet recording device of claim 11, wherein at least one of the monomers represented by formula (I) or formula (II) is a monofunctional monomer.

14. The ink jet recording device of claim 11, wherein at least one of the monomers represented by formula (I) or formula (II) is a monofunctional acrylate.

15. The ink jet recording device of claim 11, the monomer represented by formula (II) is a monomer further represented by any of the following formulae (III), (IV) or (V), (III)

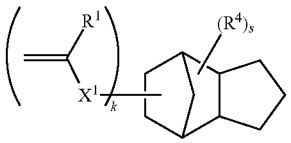

(IV)

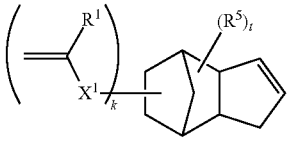

(V)

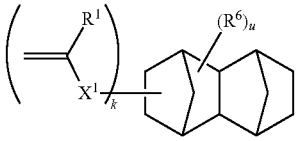

wherein, in formulae (III), (IV) and (V): $R^1$ represents a hydrogen atom, a halogen atom, or an alkyl group having from 1 to 4 carbon atoms; $X^1$ represents a divalent linking group; $R^4$, $R^5$ and $R^6$ each independently represent a substituent which may link at any position in the alicyclic hydrocarbon structures of formulae (III) to (V); k represents an integer of from 1 to 6; s, t and u each independently represent an integer of from 0 to 5, when k is 2 or more, two or more of $R^1$ may be the same as or different from each other and two or more of $X^1$ may be the same as or different from each other, when s is 2 or more, two or more of $R^4$ may be the same as or different from each other, when t is 2 or more, two or more of $R^5$ may be the same as or different from each other, and when u is 2 or more, two or more of $R^6$ may be the same as or different from each other.

16. The ink jet recording device of claim 11, wherein the undercoating liquid is partially cured by irradiation with actinic energy rays.

17. The ink jet recording device of claim 11, wherein the undercoating liquid further comprises a radical polymerizable compound that is not the monomer represented by formula (I) or formula (II).

18. The ink jet recording device of claim 11, wherein the curing sensitivity of the ink is equal to or higher than the curing sensitivity of the undercoating liquid.

19. The ink jet recording device of claim 11, wherein the recording medium is non-permeable or slowly permeable.

* * * * *